US008678374B2

(12) United States Patent
Ikeuchi et al.

(10) Patent No.: US 8,678,374 B2
(45) Date of Patent: Mar. 25, 2014

(54) MEDIUM FEEDING DEVICE AND IMAGE FORMING APPARATUS

(75) Inventors: Hiroyuki Ikeuchi, Tokyo (JP); Hajime Yoshii, Kanagawa (JP); Yuji Otsuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/442,409

(22) Filed: Apr. 9, 2012

(65) Prior Publication Data

US 2013/0026698 A1 Jan. 31, 2013

(30) Foreign Application Priority Data

Jul. 29, 2011 (JP) ..... 2011-166388

(51) Int. Cl.
*B65H 3/12* (2006.01)
*B65H 3/08* (2006.01)

(52) U.S. Cl.
USPC ..... 271/96; 271/108

(58) Field of Classification Search
USPC ..... 271/108, 96
See application file for complete search history.

(56) References Cited

U.S. PATENT DOCUMENTS 7,537,208 B2 * 5/2009 Fukusaka et al. ..... 271/96

FOREIGN PATENT DOCUMENTS

| | | | |
|---|---|---|---|
| JP | 09-144546 | A | 6/1997 |
| JP | 2002-019978 | A | 1/2002 |
| JP | 2005-194027 | A | 7/2005 |
| JP | 2005-337209 | A | 12/2005 |
| JP | 2007-106567 | A | 4/2007 |
| JP | 2008-094603 | A | 4/2008 |
| JP | 2010-024057 | A | 2/2010 |
| JP | 2010-143658 | A | 7/2010 |
| JP | 2010-149982 | A | 7/2010 |

* cited by examiner

*Primary Examiner* — David H Bollinger
(74) *Attorney, Agent, or Firm* — Sughrue Mion, PLLC

(57) ABSTRACT

A medium feeding device includes a loading member; a holding member that includes a movable holding-member body having a gas suction opening, and a suction device connected to the gas suction opening, the holding member being configured to attract and hold each of mediums on the loading member while the suction device performs suction; a holding-member-moving mechanism that moves the holding member between a suction position where the medium is attracted to the holding member and a feed position on a downstream side with respect to the suction position; a transport member that transports the medium held by the holding member at the feed position toward the downstream side; and a suction-force-changing mechanism that reduces a suction force after the medium is attracted to the holding member and before a trailing end of the medium attracted to the holding member passes over the gas suction opening.

20 Claims, 32 Drawing Sheets

MEDIUM FEEDING DEVICE AND IMAGE FORMING APPARATUS

CROSS-REFERENCE TO RELATED APPLICATIONS

This application is based on and claims priority under 35 USC 119 from Japanese Patent Application No. 2011-166388 filed Jul. 29, 2011.

BACKGROUND

Technical Field

The present invention relates to a medium feeding device and an image forming apparatus.

SUMMARY

According to an aspect of the invention, there is provided a medium feeding device including a loading member on which mediums are stacked; a holding member that includes a holding-member body that faces the loading member and is supported in such a manner as to be movable in a medium transport direction, the holding-member body having a gas suction opening, and a suction device that is connected to the gas suction opening and performs suction of gas, the holding member being configured to attract and hold each of the mediums while suction is performed by the suction device; a holding-member-moving mechanism that faces the loading member and moves the holding member between a suction position where each of the mediums on the loading member is attracted to the holding member and a feed position defined on a downstream side in the medium transport direction with respect to the suction position; a transport member that transports the medium held by the holding member that is at the feed position toward the downstream side; and a suction-force-changing mechanism that changes a suction force with which the medium is attracted to the holding member, the suction force being reduced after the medium is attracted to the holding member and before a trailing end, in the medium transport direction, of the medium attracted to the holding member passes over the gas suction opening.

BRIEF DESCRIPTION OF THE DRAWINGS

Exemplary embodiments of the present invention will be described in detail based on the following figures, wherein.

DETAILED DESCRIPTION

Figure 1:
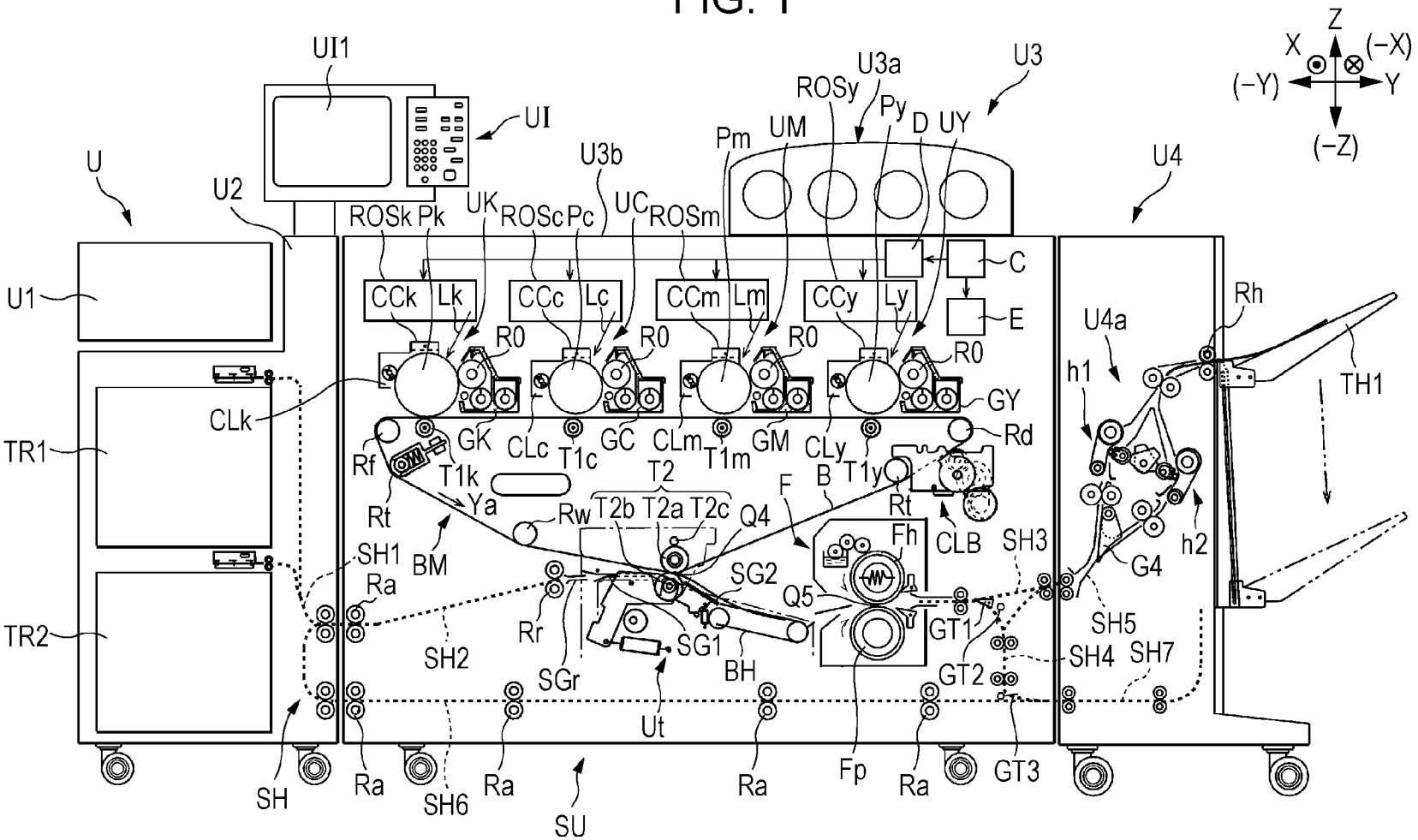
FIG. 1 illustrates the entirety of an image forming apparatus according to a first exemplary embodiment of the present invention.

Exemplary embodiments of the present invention will now be described with reference to the accompanying drawings. Note that the invention is not limited to the following exemplary embodiments.

For ease of understanding of the following description, directions in the drawings are defined as follows: the antero-posterior direction is represented by the X axis, the lateral direction is represented by the Y axis, and the vertical direction is represented by the Z axis. Furthermore, arrows X, −X, Y, −Y, Z, and −Z represent the directions toward the front, the rear, the right, the left, the top, and the bottom, respectively. Furthermore, in the drawings, the encircled dot represents an arrow extending from the back side toward the front side of the page, and the encircled cross represents an arrow extending from the front side toward the back side of the page.

In the following description and the drawings referred to therein, descriptions and illustrations of irrelevant elements are omitted for ease of understanding.

First Exemplary Embodiment

FIG. 1 illustrates the entirety of an image forming apparatus U according to a first exemplary embodiment of the present invention.

Referring to FIG. 1, the image forming apparatus U includes a user interface UI as an exemplary operation unit, an image scanner U1 as an exemplary image-information-inputting device, a sheet feeding device U2 as an exemplary medium feeding device, an image-forming-apparatus body U3, and a sheet processing device U4.

The user interface UI includes input keys as exemplary input members, such as a copy start key, a key for setting the number of copies, a numeric keypad, and so forth, and a display UI1.

The image scanner U1 includes an automatic document transport device that automatically transports each page of a document, a scanner body as an exemplary image reading device, and so forth. Referring to FIG. 1, the image scanner U1 reads each page of the document (not illustrated), converts the read data into image information, and inputs the image information to the image-forming-apparatus body U3.

The sheet feeding device U2 is an exemplary storage container and includes plural feed trays TR1 and TR2 as exemplary feeders, a feed path SH1 as an exemplary transport path along which each sheet S as an exemplary medium that is fed from one of the feed trays TR1 and TR2 is transported to the image-forming-apparatus body U3, and so forth.

Referring to FIG. 1, the image-forming-apparatus body U3 includes an image recording section that records an image on the sheet S transported from the sheet feeding device U2, a toner dispenser device U3*a* as an exemplary developer supplying unit, a sheet transport path SH2, a sheet output path SH3, a sheet reversal path SH4, a sheet circulation path SH6, and so forth. The image recording section will be described separately below.

The image-forming-apparatus body U3 further includes a controller C, a laser driving circuit D as an exemplary driving circuit for latent image writing that is controlled by the controller C, a power circuit E controlled by the controller C, and so forth. The laser driving circuit D controlled by the controller C outputs, at preset timings, laser driving signals corresponding to pieces of image information on respective colors of yellow (Y), magenta (M), cyan (C), and black (K) that are input thereto from the image scanner U1 to respective latent-image-forming devices ROSy, ROSm, ROSc, and ROSk provided for the foregoing colors.

Referring to FIG. 1, an image carrier unit UK for the K color includes a photoconductor Pk as an exemplary image carrier, a charger CCk as an exemplary discharger, and a photoconductor cleaner CLk as an exemplary image carrier cleaner. Image carrier units UY, UM, and UC for the other M, and C colors also include respective photoconductors Py, Pm, and Pc, respective chargers CCy, CCm, and CCc, and respective photoconductor cleaners CLy, CLm, and CLc. In the first exemplary embodiment, the photoconductor Pk for the K color is used more frequently and the surface thereof wears more than others. Therefore, the photoconductor Pk has a larger diameter, is capable of rotating at a higher speed, and has a longer life than the photoconductors Py, Pm, and Pc for the other colors.

The image carrier units UY, UM, UC, and UK and development units GY, GM, GC, and GK each including a development roller R0 together form toner-image-forming members "UY and GY", "UM and GM", "UC and GC", and "UK and GK".

Referring to FIG. 1, the photoconductors Py, Pm, Pc, and Pk are evenly charged by the respective chargers CCy, CCm, CCc, and CCk. Subsequently, electrostatic latent images are formed on the surfaces of the respective photoconductors Py, Pm, Pc, and Pk with laser beams Ly, Lm, Lc, and Lk as exemplary latent-image-writing light emitted from the respective latent-image-forming devices ROSy, ROSm, ROSc, and ROSk. The electrostatic latent images on the photoconductors Py, Pm, Pc, and Pk are developed into toner images as exemplary visible images in colors of yellow (Y), magenta (M), cyan (C), and black (K) by the respective development units GY, GM, GC, and GK.

The toner images on the photoconductors Py, Pm, Pc, and Pk are first-transferred onto an intermediate transfer belt B as an exemplary intermediate transfer member in such a manner as to be sequentially superposed one on top of another by first transfer rollers T1*y*, T1*m*, T1*c*, and T1*k* as exemplary first transfer members, whereby a multi-color image, i.e., a color image, is formed on the intermediate transfer belt B. The color image on the intermediate transfer belt B is transported to a second transfer area Q4 as an exemplary image recording area.

If the image data only includes data on the black (K) color, only the photoconductor Pk and the development unit GK are used, whereby a black toner image is formed.

After the first transfer, toners remaining on the surfaces of the photoconductors Py, Pm, Pc, and Pk are removed by the respective photoconductor cleaners CLy, CLm, CLc, and CLk.

A belt module BM as an exemplary intermediate transfer device is provided below the image carrier units UY, UM, UC, and UK. The belt module BM includes the intermediate transfer belt B as an exemplary intermediate transfer member, belt supporting rollers Rd, Rt, Rw, Rf, and T2*a* as exemplary intermediate-transfer-member-supporting members, and the first transfer rollers T1*y*, T1*m*, T1*c*, and T1*k*. The belt supporting rollers Rd, Rt, Rw, Rf, and T2*a* are specifically a belt driving roller Rd as an exemplary driving member, a tension roller Rt as an exemplary tension applying member, a working roller Rw as an exemplary meandering prevention member, plural idler rollers Rf as exemplary follower members, and a backup roller T2*a* as an exemplary second-transfer counter member. The intermediate transfer belt B is supported by the belt supporting rollers Rd, Rt, Rw, Rf, and T2*a* in such a manner as to be rotatable in a direction of arrow Ya.

A second transfer unit Ut is provided below the backup roller T2*a*. The second transfer unit Ut includes a second transfer roller T2*b* as an exemplary second transfer member. The second transfer roller T2*b* is movable in such a manner as to be pressed against and to be brought away from the backup roller T2*a* with the intermediate transfer belt B interposed therebetween. An area where the second transfer roller T2*b* is pressed against the intermediate transfer belt B forms the second transfer area Q4. A contact roller T2*c* as an exemplary voltage-applying contact member is provided in contact with the backup roller T2*a*. The rollers T2*a* to T2*c* together form a second transfer device T2.

The power circuit E controlled by the controller C applies a second transfer voltage with the same polarity as the toner to the contact roller T2*c* at a predetermined timing.

The sheet transport path SH2 runs below the belt module BM. The sheet S fed from the sheet feeding device U2 along the feed path SH1 is transported into the sheet transport path SH2 by transport rollers Ra as exemplary transport members. And the sheet S is further transported by registration rollers Rr as exemplary transport-timing-adjusting members through a sheet guiding member SGr and a pre-transfer sheet guiding member SG1 to the second transfer area Q4 in accordance with a timing at which a set of toner images is transported to the second transfer area Q4. The set of toner images on the intermediate transfer belt B is second-transferred to the sheet S by the second transfer device T2 when passing through the second transfer area Q4. In the case of a full-color image, toner images that have been first-transferred to the intermediate transfer belt B in such a manner as to be superposed one on top of another are second-transferred to the sheet S at a time.

The intermediate transfer belt B after the second transfer is cleaned by a belt cleaner CLB as an exemplary intermediate-transfer-member cleaner. The second transfer roller T2*b* is supported in such a manner as to be pressed against and to be brought away from the intermediate transfer belt B.

The first transfer rollers T1*y*, T1*m*, T1*c*, and T1*k*, the intermediate transfer belt B, the second transfer device T2, the belt cleaner CLB, and other associated elements together form a transfer device "T1, B, T2, and CLB" that transfers images formed on the photoconductors Py, Pm, Pc, and Pk to the sheet S.

The photoconductors Py, Pm, Pc, and Pk, the development units GY, GM, GC, and GK, the transfer device T1, B, T2, and CLB, and other associated elements together form a printer section U3*b* as an exemplary image recording device according to the first exemplary embodiment.

The sheet S on which the toner images are second-transferred is transported to a fixing device F through a post-transfer sheet guiding member SG2 and a sheet transport belt BH as an exemplary pre-fixing medium transport member. The fixing device F includes a heat roller Fh as an exemplary thermal fixing member and a pressure roller Fp as an exemplary pressure fixing member. A fixing area Q5 is formed in an area where the heat roller Fh and the pressure roller Fp are pressed against each other.

The set of toner images on the sheet S is thermally fixed by the fixing device F when passing through the fixing area Q5. A first gate GT1 as an exemplary transport-path-switching member is provided on the downstream side with respect to the fixing device F. The first gate GT1 switches the path of the sheet S transported along the sheet transport path SH2 and subjected to thermal fixing in the fixing area Q5, between the sheet output path SH3 in the sheet processing device U4 and the sheet reversal path SH4. The sheet S transported into the sheet output path SH3 is transported into a sheet transport path SH5 in the sheet processing device U4.

A decurling device U4*a* as an exemplary bend straightening device is provided in the sheet transport path SH5. A decurling-direction-switching gate G4 as an exemplary transport-path-switching member is also provided in the sheet transport path SH5. The decurling-direction-switching gate G4 switches the destination of the sheet S transported from the sheet output path SH3 in the image-forming-apparatus body U3, between a first decurling member h1 and a second decurling member h2 in accordance with the direction of bend, i.e., curl of the sheet S. The sheet S transported to the first decurling member h1 or the second decurling member h2 has the curl thereof straightened when passing therethrough. The sheet S whose curl has been straightened is transported by sheet output rollers Rh as exemplary sheet output members. And the sheet S is output face-up, with the side thereof having the fixed image facing upward, onto a sheet output tray TH1 as an exemplary medium output portion of the sheet processing device U4.

The sheet S directed by the first gate GT1 toward the sheet reversal path SH4 in the image-forming-apparatus body U3 pushes away and passes through a second gate GT2 as an exemplary redirecting member made of an elastic thin film, and then, the sheet S is transported into the sheet reversal path SH4 in the image-forming-apparatus body U3.

The downstream end of the sheet reversal path SH4 in the image-forming-apparatus body U3 is connected to the sheet circulation path SH6 and a sheet reversal path SH7. A third gate GT3 as an exemplary redirecting member is provided at the connection between the path SH4 and the paths SH6 and SH7. The sheet S transported through the first gate GT1 into the sheet reversal path SH4 passes through the third gate GT3 into the sheet reversal path SH7 in the sheet processing device U4. In the case of duplex printing, the sheet S transported along the sheet reversal path SH4 passes through the third gate GT3 into the sheet reversal path SH7 and is transported backward, i.e.; switched back, into the sheet circulation path SH6 by being redirected at the third gate GT3. The sheet S transported into the sheet circulation path SH6 is then transported along the feed path SH1 to the second transfer area Q4 again.

If the sheet S that is to be transported in the sheet reversal path SH4 is switched back after the trailing end thereof in a sheet transport direction as an exemplary medium transport direction has passed the second gate GT2 but before the trailing end thereof passes through the third gate GT3, the sheet S is redirected by the second gate GT2 in such a manner as to be turned upside down and to be transported into the sheet transport path SH5. The sheet S turned upside down has the curl thereof straightened by the decurling device U4*a* and is output facedown, with the side thereof having the fixed image facing downward, onto the sheet output tray TH1 of the sheet processing device U4.

The elements denoted by reference numerals SH1 to SH7 together form a sheet transport path SH. The elements denoted by reference numerals SH, Ra, Rr, Rh, SGr, SG1, SG2, BH, and GT1. GT2, and GT3, and other associated elements together form a sheet transport system SU.

Figure 2:
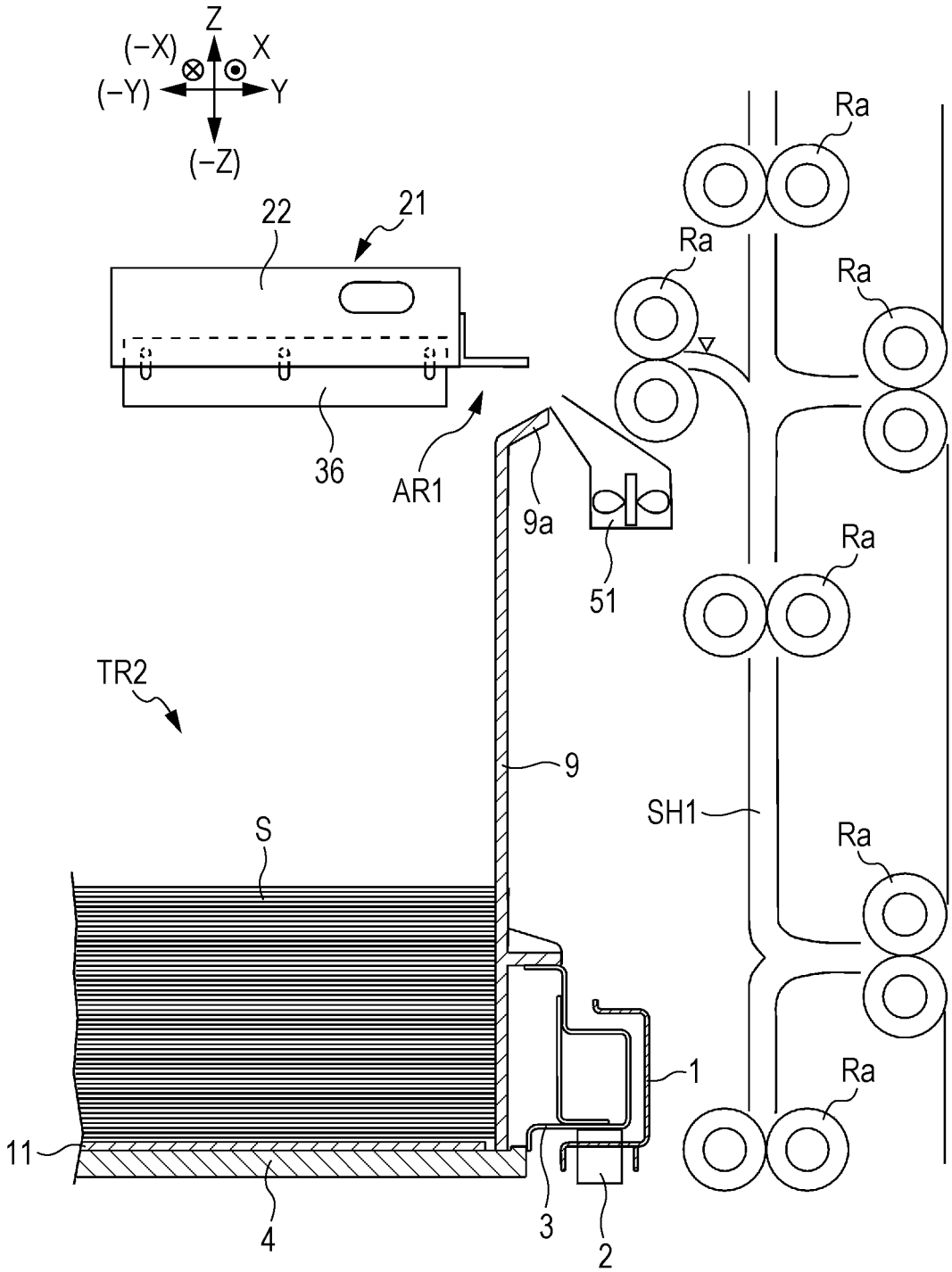
FIG. 2 illustrates a feed tray according to the first exemplary embodiment.

FIG. 2 illustrates one of the feed trays TR1 and TR2, according to the first exemplary embodiment.

Herein, the feed trays TR1 and TR2 according to the first exemplary embodiment will be described in detail focusing on a second feed tray TR2. A first feed tray TR1 has the same configuration as the second feed tray TR2, and detailed description of the first feed tray TR1 is therefore omitted.

Referring to FIG. 2, the second feed tray TR2 has rails 1 as exemplary guiding members at outer left and right ends thereof, respectively. The rails 1 extend in the anteroposterior direction along the X axis. Rollers 2 as exemplary rotary members are rotatably provided on the undersides of the rails 1: The tops of the rollers 2 project upward from holes provided in the undersides of the rails 1.

The feed tray TR2 also has guided rails 3 as exemplary guided members projecting outward from lower left and right ends thereof, respectively. The guided rails 3 extend in the anteroposterior direction. The guided rails 3 are supported at the tops of the rollers 2 provided on the undersides of the rails 1. Thus, the feed tray TR2 is drawable from and insertable into the sheet feeding device U2 in the anteroposterior direction along the left and right rails 1. That is, the feed tray TR2 is movable between a drawn position at which the feed tray TR2 is out of the sheet feeding device U2 and an inserted position at which the feed tray TR2 is in the sheet feeding device U2.

Figure 3:
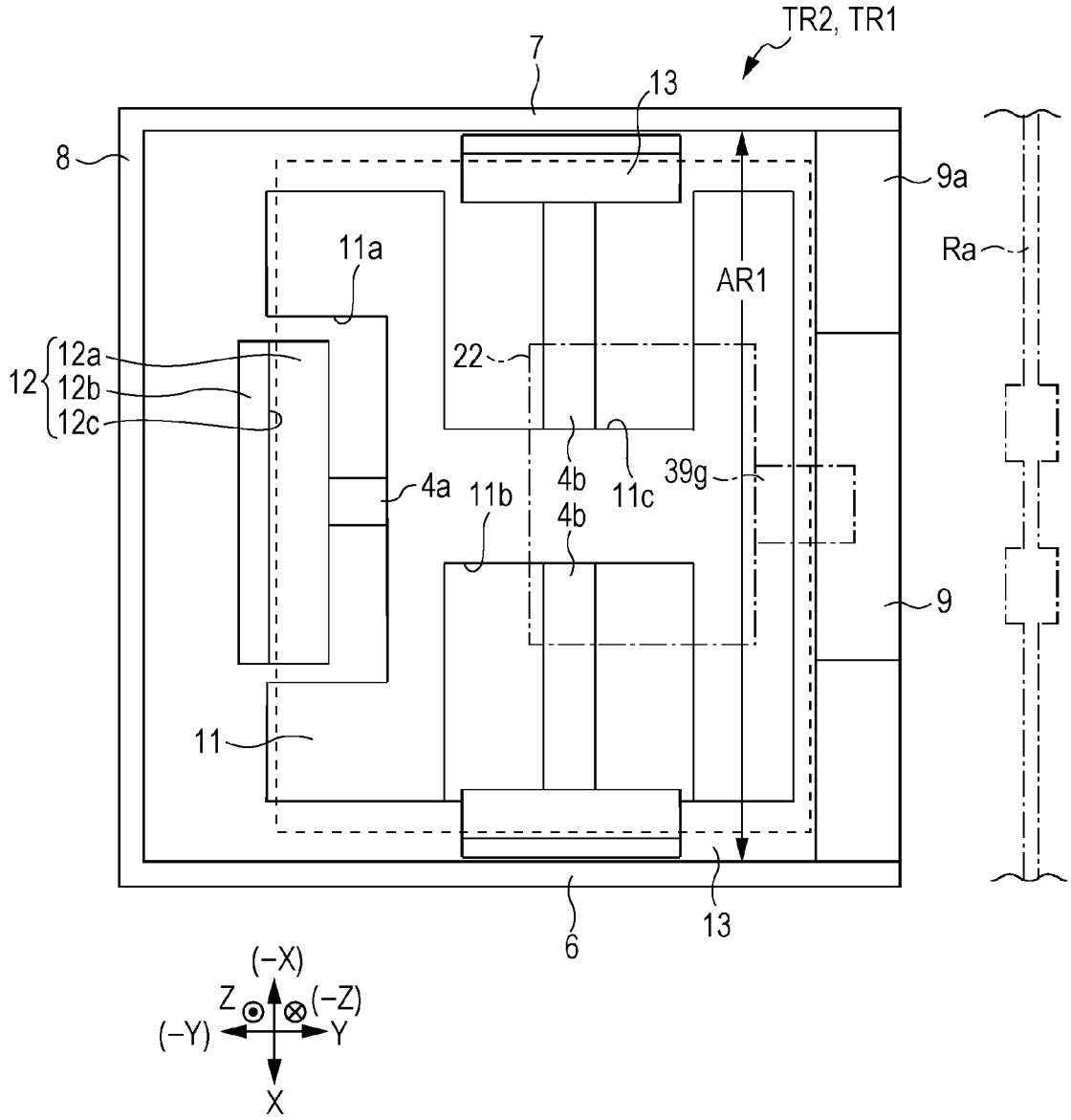
FIG. 3 is a plan view of the feed tray according to the first exemplary embodiment.

FIG. 3 is a plan view of the feed tray TR2 according to the first exemplary embodiment.

Referring to FIGS. 2 and 3, the feed tray TR2 includes a bottom plate 4 and front, rear, left and right walls 6, 7, 8, and 9 that extend upward from the front, rear, left, and right ends, respectively, of the bottom plate 4. Referring to FIG. 3, an end guide groove 4*a* as an exemplary first guide portion is provided in left part of the bottom plate 4 of the feed tray TR2 in such a manner as to extend in the lateral direction. Side guide grooves 4*b* as exemplary second guide portions are provided in right part of the bottom plate 4 in such a manner as to extend in the anteroposterior direction. Referring to FIGS. 2 and 3, the upper end of the right wall 9 forms a sloping portion 9*a* that extend upward while sloping rightward. The sloping portion 9*a* guides the sheet S to be fed toward associated ones of the transport rollers Ra.

Figure 4A:
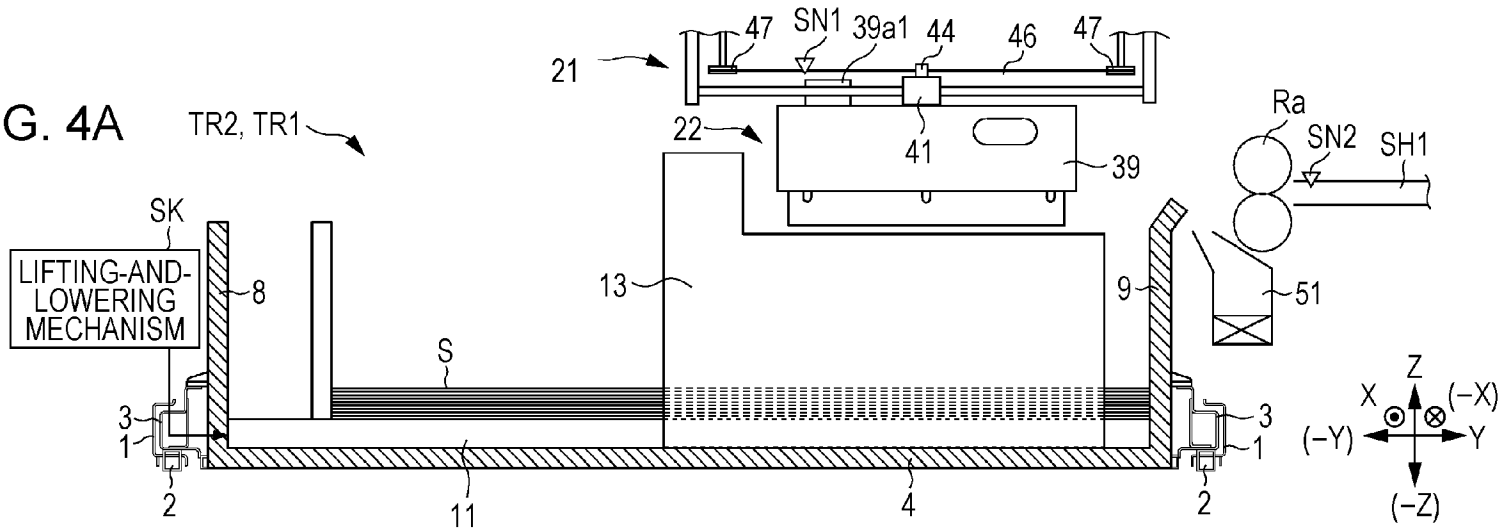
FIGS. 4A and 4B illustrate a loading plate according to the first exemplary embodiment at a lowered position and at a lifted position, respectively.
Figure 4B:
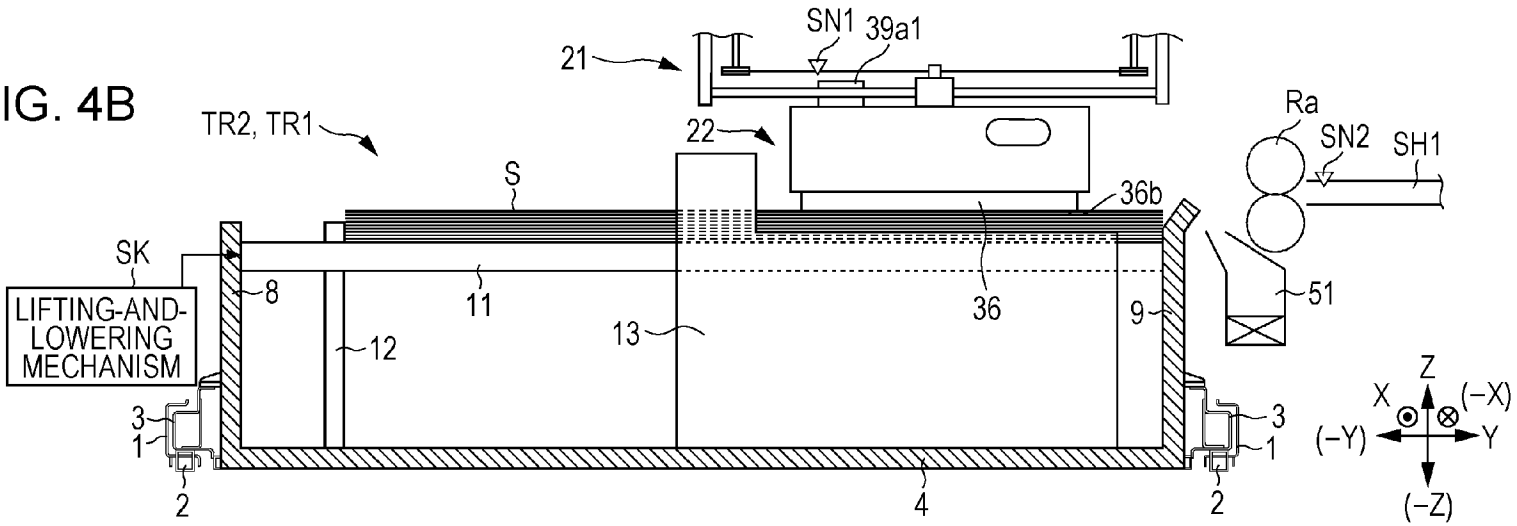

FIGS. 4A and 4B illustrate a loading plate 11 according to the first exemplary embodiment. In FIG. 4A, the loading plate 11 is at a lowered position. In FIG. 4B, the loading plate 11 is at a lifted position.

The loading plate 11, which is a flat plate and is an exemplary loading member, is provided on the upper surface of the bottom plate 4. Sheets S are stacked on the loading plate 11. The loading plate 11 has a left opening 11*a* extending from the left end thereof toward the center, and front and rear openings 11*b* and 11*c* extending from the front and rear ends thereof, respectively, toward the center. The left opening 11*a* corresponds to the end guide groove 4*a*. The front and rear openings 11*b* and 11*c* correspond to the side guide grooves 4*b*. The loading plate 11 according to the first exemplary embodiment is liftable and lowerable by a lifting-and-lowering mechanism SK as an exemplary loading-member-moving mechanism. The lifting-and-lowering mechanism SK employs wires (not illustrated) as exemplary wire members for the lifting-and-lowering movement. Thus, the loading plate 11 is liftable and lowerable between the lowered position as an exemplary retracted position illustrated in FIG. 4A where sheets S are stackable on the loading plate 11 and the lifted position as an exemplary suction position illustrated in FIG. 4B where the sheets S are each fed from the loading plate 11. The lifting-and-lowering mechanism SK employing the wires may be based on a related-art technique, and related-art configurations are applicable thereto Hence, detailed description of the lifting-and-lowering mechanism SK is omitted.

The end guide groove 4*a* supports an end guide 12 as an exemplary first alignment member. The end guide 12 is movable in the lateral direction along the end guide groove 4*a*. The end guide 12 includes a slide portion 12*a* and an alignment contact portion 12*b*. The slide portion 12*a*, which is an exemplary alignment member body, is a flat plate and extends along the bottom plate 4. The alignment contact portion 12*b* extends upward from the left end of the slide portion 12*a*. Thus, the end guide 12 has a substantially L shape when seen from the front. The right side face of the alignment contact portion 12*b* forms a contact surface 12*c* that is to come into contact with the left ends of the sheets S stacked on the loading plate 11. When the contact surface 12*c* comes into contact with the left ends of the sheets S, the left ends of the sheets S are aligned.

The side guide grooves 4*b* support a pair of front and rear side guides 13 as exemplary second alignment members, respectively. The side guides 13 are movable in the anteroposterior direction along the respective side guide grooves 4*b*. The pair of side guides 13 are movable together toward and away from each other with the aid of racks and pinions (not illustrated) as exemplary gears. The racks each include a flat plate having gears. Such a mechanism of moving the side guides 13 together toward and away from each other with the aid of racks and pinions may be based on a related-art technique, and related-art configurations are applicable thereto. Hence, detailed description of the mechanism is omitted.

Figure 5A:
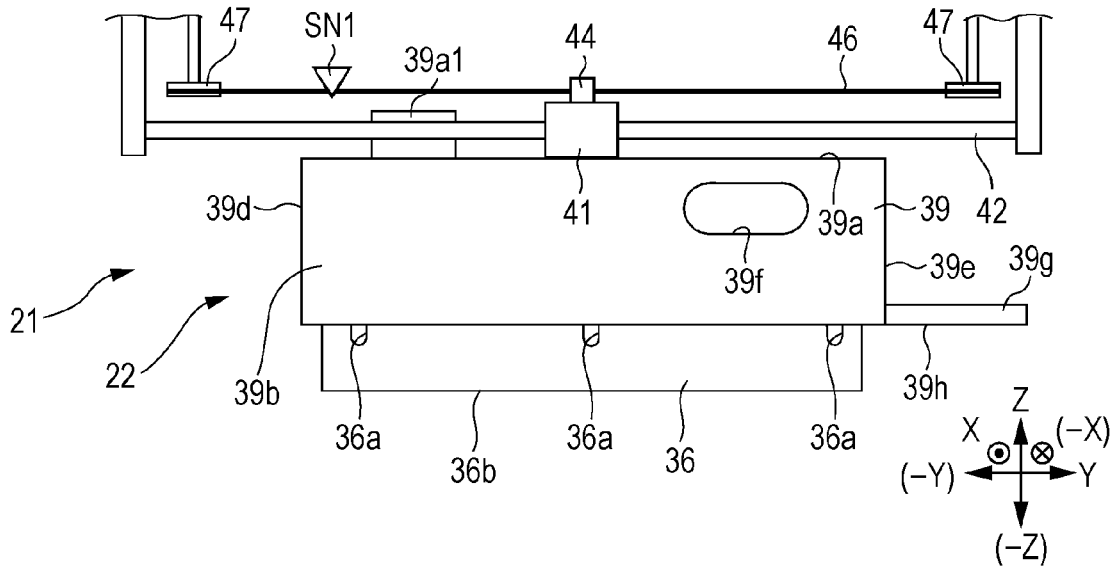
FIGS. 5A and 5B are a front view and a plan view, respectively, of a suction head according to the first exemplary embodiment.
Figure 5B:
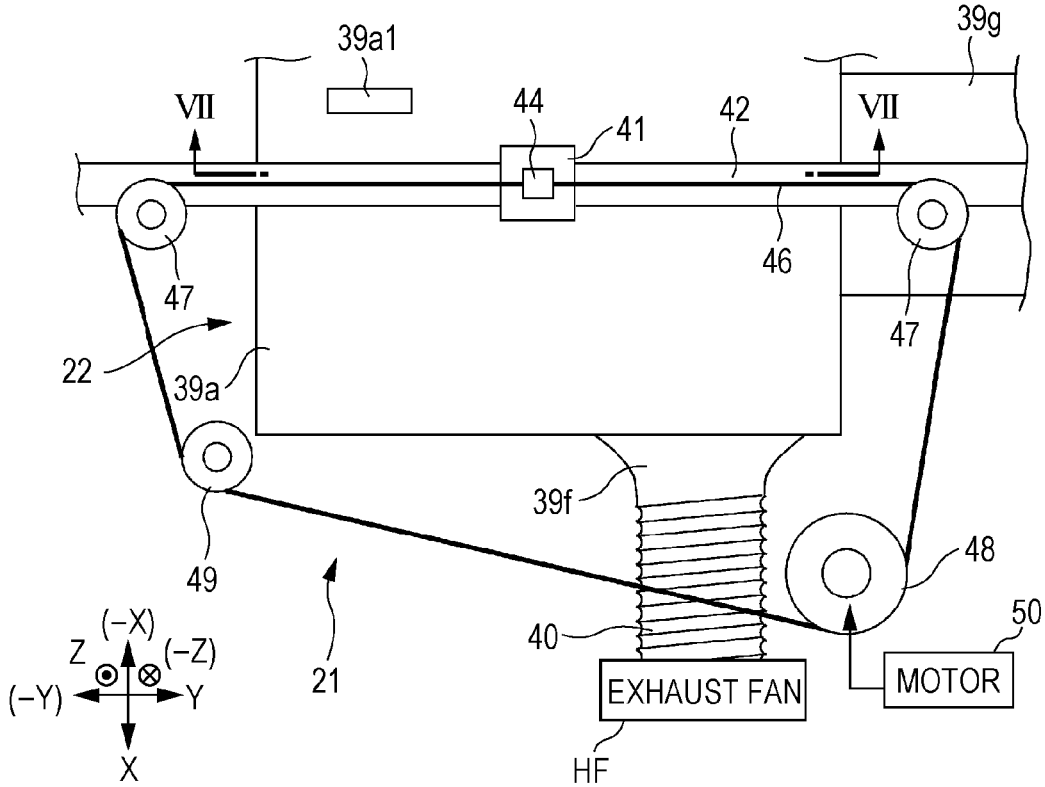

FIGS. 5A and 5B are a front view and a plan view, respectively, of a suction head 22 according to the first exemplary embodiment.

Figure 6:
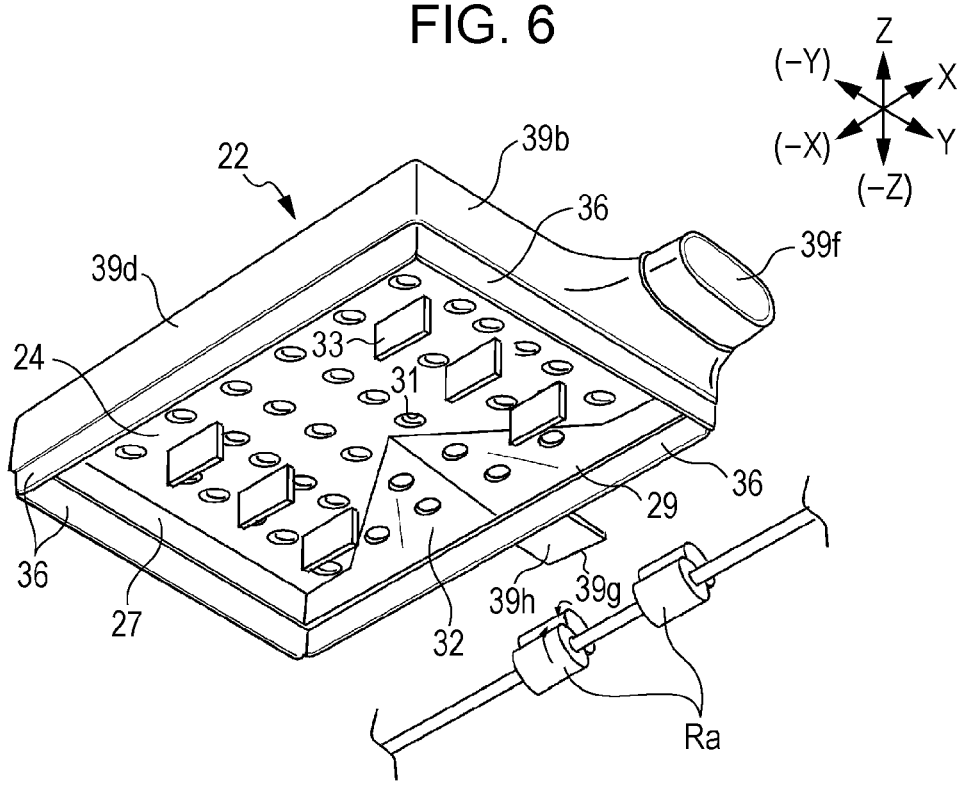
FIG. 6 is a bottom perspective view of the suction head according to the first exemplary embodiment.

FIG. 6 is a bottom perspective view of the suction head 22 according to the first exemplary embodiment.

Figure 7:
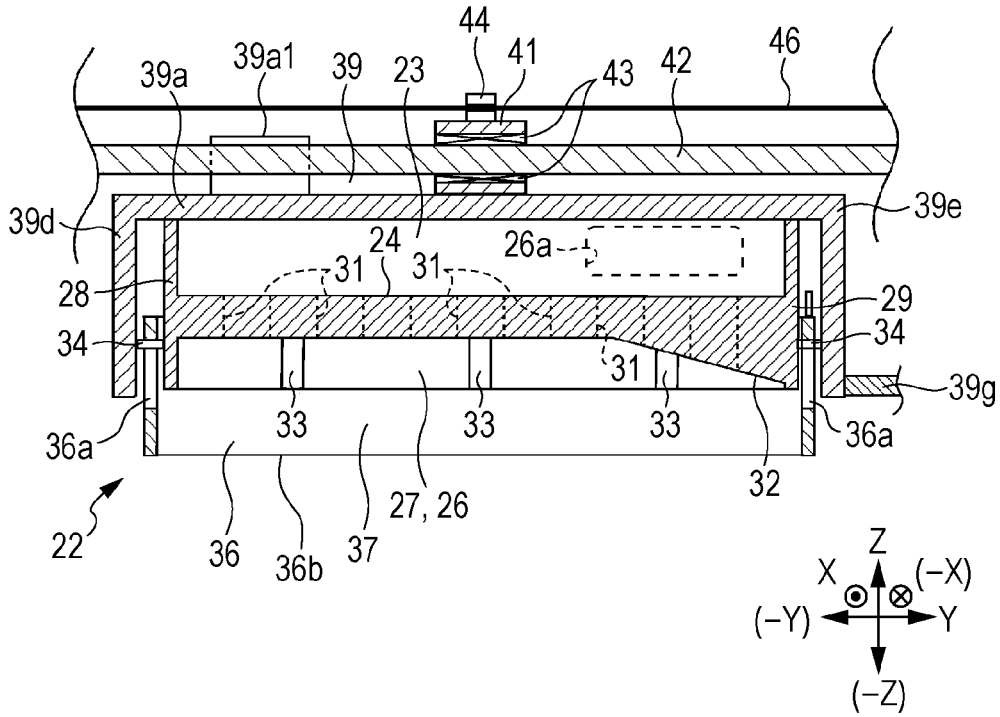
FIG. 7 is a sectional view of the suction head taken along line VII-VII illustrated in FIG. 5B.

FIG. 7 is a sectional view of the suction head 22 taken along line VII-VII illustrated in FIG. 5B.

Referring to FIGS. 2 and 4A to 7, a sheet pickup device 21 as an exemplary medium pickup member is provided above the feed tray TR2. The sheet pickup device 21 includes the suction head 22 as an exemplary holding member. The suction head 22 attracts and holds one of the sheets S on the loading plate 11 by suction.

The suction head 22 includes a box-shaped head body 23 as an exemplary holding-member body. The head body 23 includes a bottom plate 24, which has a flat shape, and sidewalls 26, 27, 28, and 29 extending vertically from the front, rear, left, and right ends, respectively, of the bottom plate 24. The bottom plate 24 has a lower surface 24*a* as an exemplary surface having gas suction openings. The bottom plate 24 has plural suction ports 31 as exemplary gas suction openings each extending vertically therethrough. The lower surface 24*a* includes a sloping surface 32 as an exemplary bending portion in right part thereof. The sloping surface 32 slopes downward from the left to right side and also slopes leftward from the front toward the center. Furthermore, the lower surface 24*a* has on the front and rear sides thereof plural plate-shaped ribs 33 as other exemplary bending portions extending downward and arranged at certain intervals.

Referring to FIG. 7, the sidewalls 26 to 29 have on the outer surfaces thereof plural pins 34 as exemplary peripheral support members that project outward therefrom.

Referring to FIGS. 5A, 6, and 7, a sealing skirt 36 as an exemplary enclosing member is provided around the outer surface of the head body 23. The sealing skirt 36 includes plates extending downward and has oblong holes 36*a* extending vertically at positions corresponding to the respective pins 34. The pins 34 extend through and are supported in the respective oblong holes 36*a*. Thus, the sealing skirt 36 according to the first exemplary embodiment is movable vertically relative to the head body 23, that is, the sealing skirt 36 is movable toward and away from the loading plate 11 and the stack of sheets S on the loading plate 11.

The sealing skirt 36 has a lower surface 36*b* as an exemplary end nearer to the loading member. The suction ports 31 are provided in an area enclosed by the sealing skirt 36 and the sidewalls 26 to 29. A space enclosed by the sealing skirt 36, the lower surface 24*a* of the bottom plate 24, and the sidewalls 26 to 29 forms a suction space 37 according to the first exemplary embodiment.

Referring to FIGS. 5A to 7, the head body 23 supports at the top thereof a lid-shaped covering 39 as an exemplary covering member. The covering 39 includes a top plate 39*a* extending over the space enclosed by the bottom plate 24 and the sidewalls 26 to 29, and side plates 39*b*, 39*c*, 39*d*, and 39*e* extending downward from the front, rear, left, and right ends, respectively, of the top plate 39*a*. The top plate 39*a* has on the rear side of the upper surface thereof an on-head light-blocking portion 39*a*1 as an exemplary portion to be detected for detecting the movement of the holding member. The on-head light-blocking portion 39*a*1 projects upward from the top plate 39*a* and is detected by a position sensor SN1 as an exemplary holding-member-position detecting member. The position sensor SN1 is supported by the body of the sheet feeding device U2.

Referring to FIGS. 5A, 5B, and 6, the front side plate 39*b* has on the right side thereof an exhaust duct 39*f* as an exemplary connector portion extending toward the front. A bellows 40 as an exemplary flexible member has one end thereof connected to the exhaust duct 39*f* and the other end thereof connected to an exhaust fan HF illustrated in FIG. 5B. The exhaust fan HF is an exemplary suction device.

The front sidewall 26 has an exhaust port 26*a* as an exemplary opening. The exhaust fan HF is connected to the suction ports 31 through the exhaust port 26*a*, the exhaust duct 39*f*, and the bellows 40. When the exhaust fan HF is activated, gas, specifically, air, is taken into the suction space 37 from the suction ports 31 and is exhausted to the outside.

The elements denoted by reference numerals 23 to 39 and other associated elements together form the suction head 22 according to the first exemplary embodiment.

Referring to FIGS. 3 to 7, the right side plate 39*e* of the covering 39 supports a plate-shaped leading end guide 39*g* as an exemplary leading-end-supporting portion extending toward the right therefrom. The leading end guide 39*g* according to the first exemplary embodiment has a lower surface 39*h* as an exemplary surface to be in contact with the leading end of the sheet S of the sheet S. The length of the leading end guide 39*g* in the anteroposterior direction is set such that the leading end guide 39*g* can pass through between the transport rollers Ra provided at a certain interval in the anteroposterior direction.

In the first exemplary embodiment, the transport rollers Ra are provided such that at least part of each transport roller Ra resides on the inner side with respect to two outer ends, in the anteroposterior direction, of the head body 23. The distance between the inner ends of the respective transport rollers Ra is set so as to be less than the width of a sheet S of the smallest size. Therefore, a sheet S of the smallest size is transportable toward the downstream side while the sheet S is held between the transport rollers Ra.

In the first exemplary embodiment, the lower surfaces 24*a*, 36*b*, and 39*h* of the bottom plate 24, the sealing skirt 36, and the leading end guide 39*g* as well as the sloping surface 32 and the ribs 33 together form a contact portion "24*a*, 32, 33, 36*b*, and 39*h*".

The covering 39 supports at the top thereof a shaft guide portion 41 as an exemplary guided portion. A guide shaft 42 as an exemplary guiding member extends through the shaft guide portion 41 in the lateral direction, i.e., the sheet transport direction. The guide shaft 42 is supported by the body of the sheet feeding device U2. The shaft guide portion 41 according to the first exemplary embodiment is not rotatable but is movable in the lateral direction along the guide shaft 42 with the aid of a linear ball bearing 43 as an exemplary bearing member.

The shaft guide portion 41 supports at the top thereof a wire securing portion 44 as an exemplary connecting member.

Figure 8A:
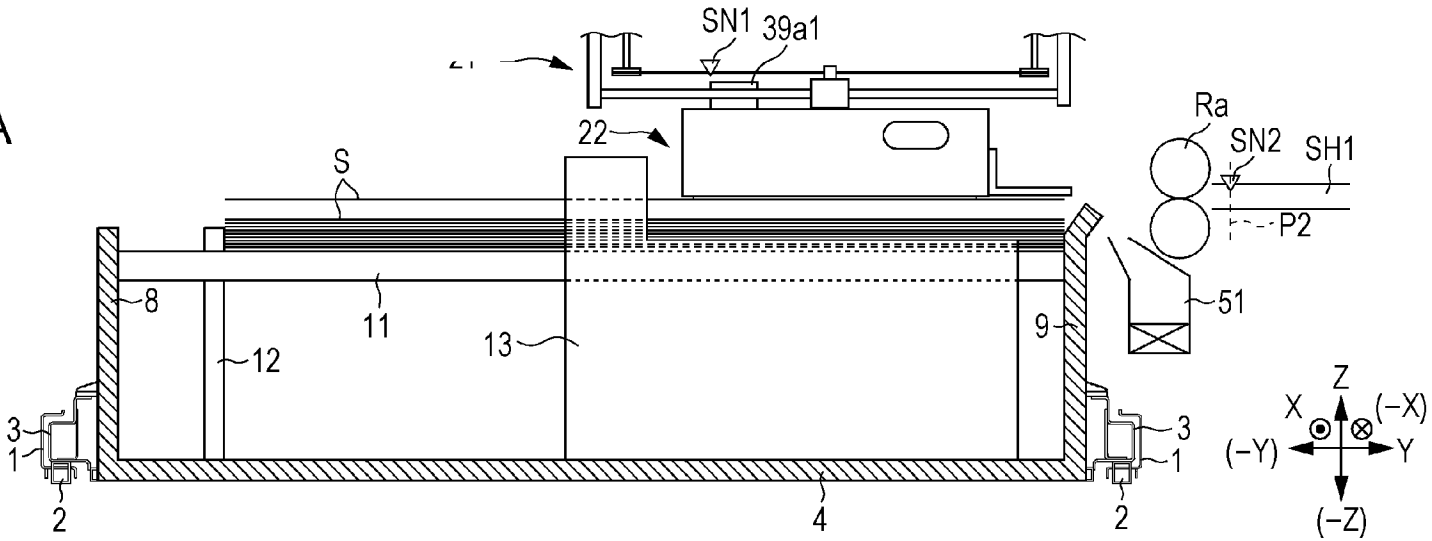
FIGS. 8A and 8B illustrate the suction head according to the first exemplary embodiment at a suction position and at a feed position, respectively.
Figure 8B:
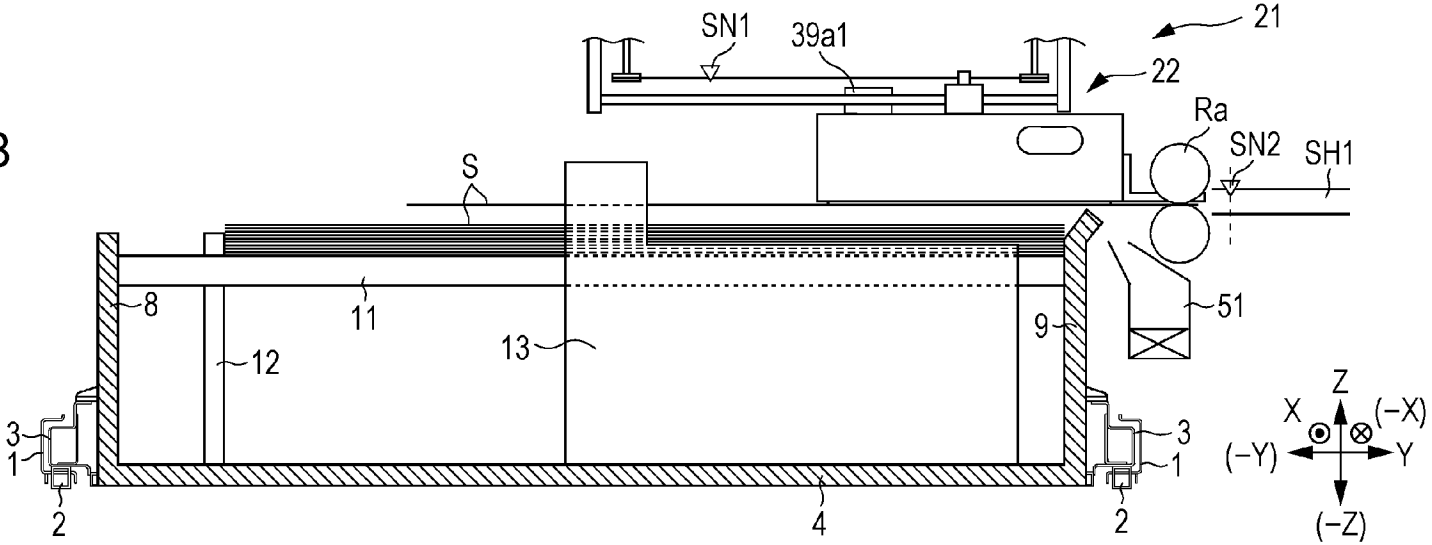

FIGS. 8A and 8B illustrate the suction head 22 according to the first exemplary embodiment. In FIG. 8A, the suction head 22 is at a suction position. In FIG. 8B, the suction head 22 is at a feed position.

A wire 46 as an exemplary wire member is secured by the wire securing portion 44. The wire 46 is stretched around a pair of pulleys 47 provided on the left and right sides of the wire securing portion 44, a driving pulley 48, and a follower pulley 49, all of which are exemplary support members. The rotation of a motor 50 as an exemplary feed driving source is transmitted to the driving pulley 48. The motor 50 is rotatable in the normal and reverse directions. When the motor 50 rotates in the normal or reverse direction, the wire 46 rotates in the clockwise or counterclockwise direction in FIG. 5B, whereby the suction head 22 moves in the lateral direction along the guide shaft 42.

Thus, the suction head 22 is movable between the suction position illustrated in FIG. 8A and the feed position illustrated in FIG. 8B. At the suction position, the suction head 22 faces the sheets S on the loading plate 11 at the lifted position and is ready to attract a sheet S. The feed position is defined on the downstream side in the sheet transport direction with respect to the suction position. In the first exemplary embodiment, the position sensor SN1 detects the on-head light-blocking portion 39*a*1 when the suction head 22 is at the suction position. When the position sensor SN1 has detected the on-head light-blocking portion 39*a*1, it is determined that the suction head 22 has moved to the suction position, which is the home position.

The wire 46, the pulleys 47 to 49, the motor 50, and other associated elements together form a head driving device "46 to 50" according to the first exemplary embodiment, which is an exemplary holding-member-moving mechanism. The suction head 22, the bellows 40, the exhaust fan HF, the head driving device "46 to 50", and other associated elements together form the sheet pickup device 21 according to the first exemplary embodiment.

Referring to FIG. 2, an air blowing mechanism 51 is provided in the body of the sheet feeding device U2 on the right side of the feed tray TR2 that is at the inserted position. The air blowing mechanism 51 is an exemplary cleaning member, an exemplary blower device, and an exemplary medium separating mechanism. The air blowing mechanism 51 blows air, as exemplary gas for sheet separation, from the lower right of the suction head 22 toward a target area AR1 as an exemplary target position predefined to the upper left thereof. The target area AR1 is defined at a position corresponding to the leading end of the sheet S that is attracted to the suction head 22. If plural sheets S are attracted to the suction head 22, the plural sheets S are separated from one another with the air. In the first exemplary embodiment, the target area AR1 extends in a sheet width direction, i.e., in the anteroposterior direction. The air blowing mechanism 51 blows air from'one end to the other end in the sheet width direction, i.e., from the front end to the rear end, of the sheet S.

The air blowing mechanism 51 may be based on a related-art technique, and related-art configurations are applicable thereto. Therefore, detailed description of the air blowing mechanism 51 is omitted.

Referring to FIGS. 2, 8A, and 8B, the feed path SH1 as an exemplary medium feeding path runs on the right side of the suction head 22. The sheet S fed from the suction head 22 that is at the feed position is transported along the feed path SH1 to the image-forming-apparatus body U3. Transport rollers Ra at the entrance of the feed path SH1 (hereinafter simply referred to as transport rollers Ra) are arranged such that, when the suction head 22 having a sheet S attracted thereto has reached the feed position, the leading end of the sheet S attracted to the suction head 22 is nipped by the transport rollers Ra. The transport rollers Ra transport the sheet S fed from the suction head 22 at the feed position to the image-forming-apparatus body U3. A sheet sensor SN2 is provided at a detection position P2 defined on the downstream side in the sheet transport direction with respect to the transport rollers Ra. The sheet sensor SN2 is an exemplary jam detecting member and is also an exemplary transport detecting member. The sheet sensor SN2 detects the sheet S that has been fed from the suction head 22 to the transport rollers Ra.

The loading plate 11, the lifting-and-lowering mechanism SK, the sheet pickup device 21, the air blowing mechanism 51, the transport rollers Ra, the feed path SH1, and other associated elements together form the sheet feeding device U2 according to the first exemplary embodiment.

Figure 9A:
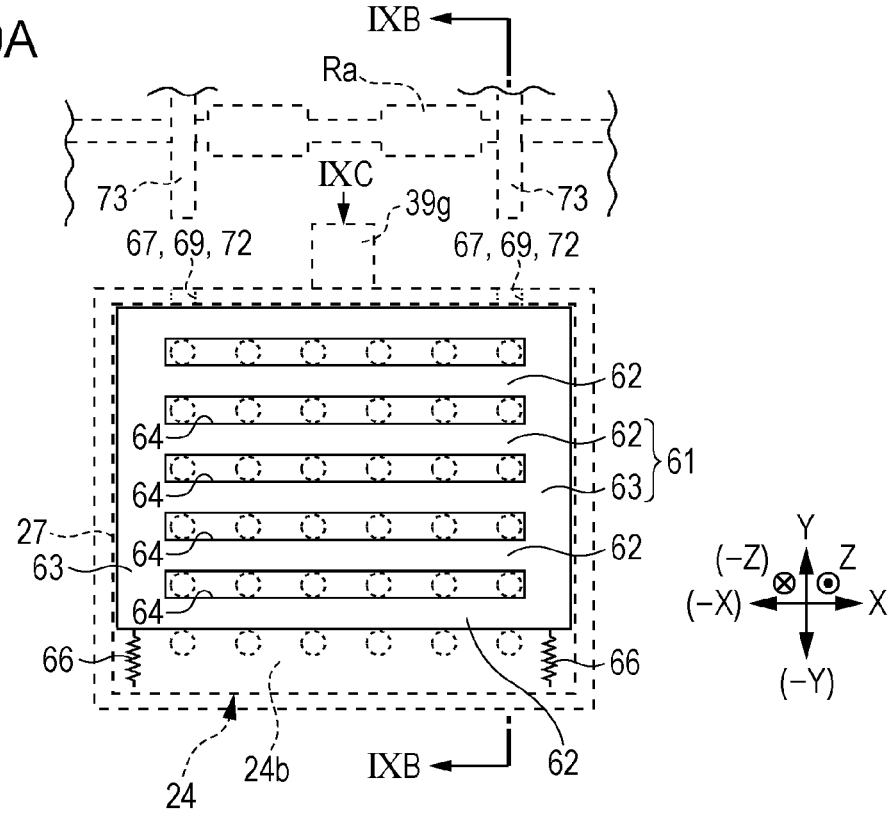
FIGS. 9A to 9C illustrate a suction port shutter according to the first exemplary embodiment as a plan view illustrating the suction port shutter seen from above inside the suction head, as a sectional view taken along line IXB-IXB illustrated in FIG. 9A, and as a view seen in a direction of arrow IXC illustrated in FIG. 9A, respectively.
Figure 9B:
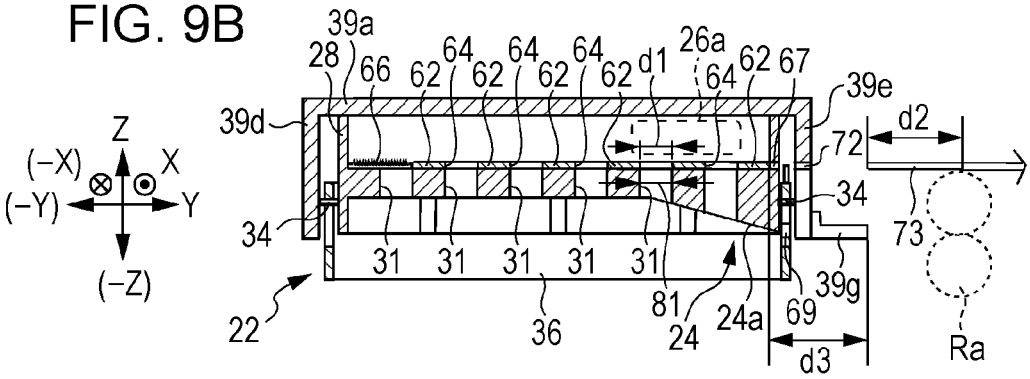
Figure 9C:
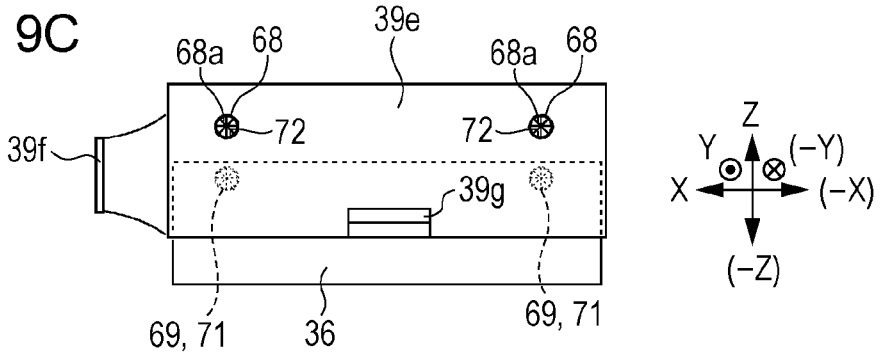

FIGS. 9A to 9C illustrate a suction port shutter 61 according to the first exemplary embodiment. FIG. 9A is a plan view illustrating the suction port shutter 61 seen from above inside the suction head 22. FIG. 9B is a sectional view taken along line IXB-IXB illustrated in FIG. 9A. FIG. 9C is a view seen in a direction of arrow IXC illustrated in FIG. 9A.

Referring to FIGS. 9A to 9C, an upper surface 24*b* of the bottom plate 24 according to the first exemplary embodiment supports the suction port shutter 61 as an exemplary closing member. The suction port shutter 61 is flat plate-shaped. The suction port shutter 61 according to the first exemplary embodiment has plural shutting portions 62 each extending in the anteroposterior direction from one end to the other end of the bottom plate 24. The shutting portions 62 are provided at certain intervals in the lateral direction and are connected to each other with connecting portions 63. The connecting portions 63 are provided at two anteroposterior ends, respectively, of the suction port shutter 61 in such a manner as to extend in the lateral direction. Referring to FIGS. 9A to 9C, the connecting portions 63 according to the first exemplary embodiment are each provided on the outer side in the anteroposterior direction with respect to suction ports 31 provided at a corresponding one of the two anteroposterior ends. That is, the connecting portions 63 are provided in such a manner as not to extend over the suction ports 31. The connecting portions 63 are in contact with the front and rear sidewalls 26 and 27, respectively. Thus, the suction port shutter 61 is movable in the lateral direction along the sidewalls 26 and 27.

The suction port shutter 61 also has plural vent portions 64, which are openings defined by the shutting portions 62 and the connecting portions 63. The vent portions 64 are provided at certain intervals in the lateral direction.

A pair of front and rear urging springs 66 as exemplary support members and exemplary urging members are provided between the leftmost one of the shutting portions 62 of the suction port shutter 61 and the left sidewall 28. The urging springs 66 constantly urge the suction port shutter 61 toward the right.

The right sidewall 29 of the head body 23 has a pair of front and rear inner through holes 67 extending therethrough in the lateral direction. Referring to FIG. 9C, the inner through holes 67 according to the first exemplary embodiment are provided with respective inner covering members 68 as exemplary first flow-suppressing members. The inner covering members 68 according to the first exemplary embodiment are made of resin and each have cuts 68*a* extending radially from the center thereof. Thus, while air suction is performed, the flow of air produced through the inner through holes 67 is suppressed and, if any object is inserted into the inner through holes 67, the inner covering members 68 undergo elastic deformation and get the object through the holes 67.

The sealing skirt 36 has in the right sidewall thereof a pair of front and rear intermediate through holes 69 extending therethrough in the lateral direction. The intermediate through holes 69 face the respective inner through holes 67 when the sealing skirt 36 is lifted together with a sheet S attracted thereto. The intermediate through holes 69 according to the first exemplary embodiment are provided with respective intermediate covering members 71 as exemplary second flow-suppressing members. The intermediate covering members 71 have the same configuration as the inner covering members 68.

The right side plate 39*e* of the covering 39 of the suction head 22 has a pair of front and rear outer through holes 72 extending therethrough in the lateral direction.

A pair of front and rear pushing bars 73 as exemplary pushing members are secured to the frame of the sheet feeding device U2 in such a manner as to project toward the left and to face the through holes 67 and 72 from the right side. In the first exemplary embodiment, as illustrated in FIG. 9B, the tips, i.e., the left ends, of the pushing bars 73 reside on the left side, i.e., on the upstream side in the sheet transport direction, with respect to the area where the sheet S is nipped by the transport rollers Ra, hereinafter referred to as nip area.

Figure 10A:
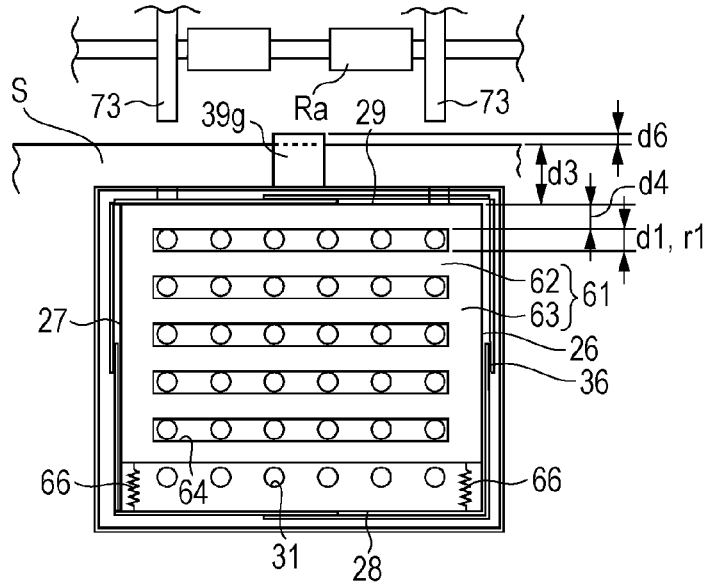
FIGS. 10A to 10C illustrate the suction port shutter according to the first exemplary embodiment at an open position, at a half shut position, and at a fully shut position, respectively.
Figure 10B:
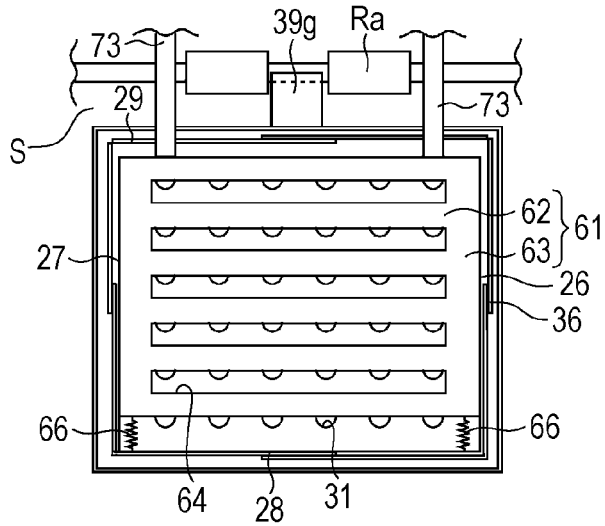
Figure 10C:
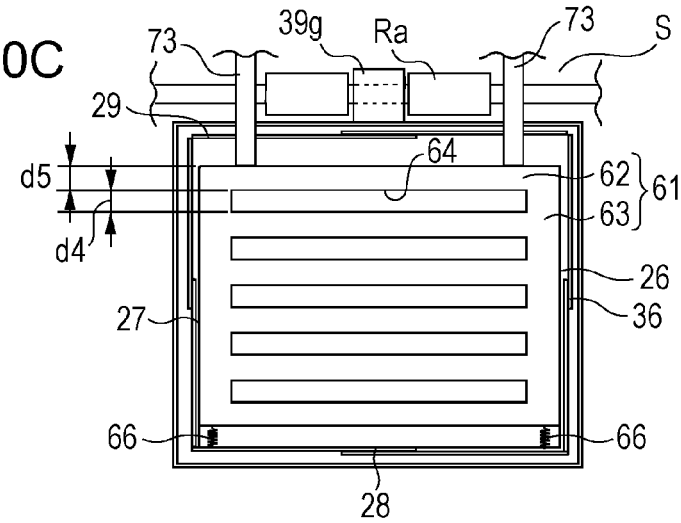

FIGS. 10A to 10C illustrate the suction port shutter 61 according to the first exemplary embodiment. In FIG. 10A, the suction port shutter 61 is at an open position. In FIG. 10B, the suction port shutter 61 is at a half shut position. In FIG. 10C, the suction port shutter 61 is at a fully shut position.

In the first exemplary embodiment, when the suction head 22 is at the suction position illustrated in FIG. 8A, the suction port shutter 61 is at the open position illustrated in FIG. 10A, where the suction port shutter 61 is urged by the urging springs 66 in such a manner as to be in contact with the right sidewall 29. In the first exemplary embodiment, a lateral width d1 of each vent portion 64 is equal to an inside diameter r1 of each suction port 31 as illustrated in FIG. 10A. Therefore, when the suction port shutter 61 is at the open position, the shutting portions 62 do not shut the suction ports 31. That is, when the suction port shutter 61 is at the open position, the vent portions 64 extend over the suction ports 31 and the upper side of the suction ports 31 are open, whereby air suction is performable.

In the first exemplary embodiment, a lateral distance d2 (see FIG. 9B) from the tips of the pushing bars 73 to the transport rollers Ra and a lateral distance d3 from the right end of the leading end guide 39*g* to the left ends of the inner through holes 67 are equal to each other. Therefore, when the suction head 22 is moved toward the feed position illustrated in FIG. 8B, the pushing bars 73 start to pass through the through holes 69 and 72. Subsequently, when the leading end guide 39*g* has reached the transport rollers Ra, the tips of the pushing bars 73 pass through the inner through holes 67 and come into contact with the suction port shutter 61. After the tips of the pushing bars 73 has come into contact with the suction port shutter 61, the pushing bars 73 push the suction port shutter 61 toward the left while the suction head 22 is further moved toward the feed position. Thus, the suction port shutter 61 is moved away from the right sidewall 29 toward the left relative to the suction head 22 against the urging force exerted by the urging springs 66.

In the first exemplary embodiment, a lateral width d4 of each shutting portion 62, illustrated in FIG. 10C, is greater than the inside diameter r1. Furthermore, in the first exemplary embodiment, a length of lateral movement d5 of the suction port shutter 61 is set so as to be equal to the inside diameter r1 and the lateral width d1 of the vent portion 64. Furthermore, in the first exemplary embodiment, a lateral distance d6 from the right end, i.e., the leading end, of the sheet S attracted to the suction head 22 to the right end of the leading end guide 39*g* is set so as to be less than the inside diameter r1, the lateral width d1, and the length of lateral movement d5.

Consequently, in the first exemplary embodiment, when the leading end guide 39*g* reaches the nip area at the transport rollers Ra, the suction port shutter 61 is pushed by the pushing bars 73 and starts to move toward the left relative to the suction head 22. As the suction head 22 moves toward the right, the pushing bars 73 further pushes the suction port shutter 61 and the suction port shutter 61 goes beyond the half shut position, as an exemplary partially closed position, illustrated in FIG. 10B. When the suction port shutter 61 is further moved toward the left by the lateral distance d6, the leading end of the sheet S reaches the nip area. When the suction head 22 is further moved toward the right and the suction port shutter 61 is further moved toward the left by the length of lateral movement d5, the suction port shutter 61 reaches the fully shut position, as an exemplary entirely closed position, illustrated in FIG. 10C. Thus, the suction port shutter 61 according to the first exemplary embodiment goes over the half shut position immediately before the sheet S reaches the transport rollers Ra, and the suction port shutter 61 reaches the fully shut position immediately after the sheet S has reached the transport rollers Ra.

Referring to FIG. 10B, when the suction port shutter 61 is at the half shut position, left part of each shutting portion 62 and right part of each vent portion 64 extend over corresponding ones of the suction ports 31. That is, right part of each suction port 31 is closed. Therefore, the area of the suction port 31 that allows air to flow therethrough, i.e., the area of the suction port 31 seen in the direction of air suction, becomes smaller and the air' suction capability becomes smaller than in the case where the suction port 31 is fully open. Referring now to FIG. 10C, when the suction port shutter 61 is at the fully shut position, the shutting portions 62 extend over the suction ports 31. That is, the entirety of each suction port 31 is closed, and air suction is not performable.

The elements denoted by reference numerals 66 to 73 together form an opening-and-closing mechanism "66 to 73" according to the first exemplary embodiment. The suction head 22, the head driving device "46 to 50", the suction port shutter 61, the opening-and-closing mechanism "66 to 73"

together form a suction-force-changing mechanism "22, 46 to 50, 61, and 66 to 73" according to the first exemplary embodiment.

To summarize, in the first exemplary embodiment, when the leading end guide 39*g* reaches the nip area, the pushing bars 73 start to push the suction port shutter 61 and the suction port shutter 61 starts to move toward the left relative to the suction head 22. As the suction head 22 further moves toward the right, the pushing bars 73 further pushes the suction port shutter 61 and the suction port shutter 61 goes beyond the half shut position as an exemplary partially closed position illustrated in FIG. 10B. When the suction port shutter 61 is further pushed toward the left by the lateral distance d6, the leading end of the sheet S reaches the nip area. When the suction head 22 further moves toward the right and the suction port shutter 61 is further pushed toward the left by the length of lateral movement d5, the suction port shutter 61 reaches the fully shut position as an exemplary entirely closed position illustrated in FIG. 10C. Thus, the suction port shutter 61 according to the first exemplary embodiment goes beyond the half shut position immediately before the sheet S reaches the transport rollers Ra, and reaches the fully shut position immediately after the sheet S has reached the transport rollers Ra.

Figure 11A:
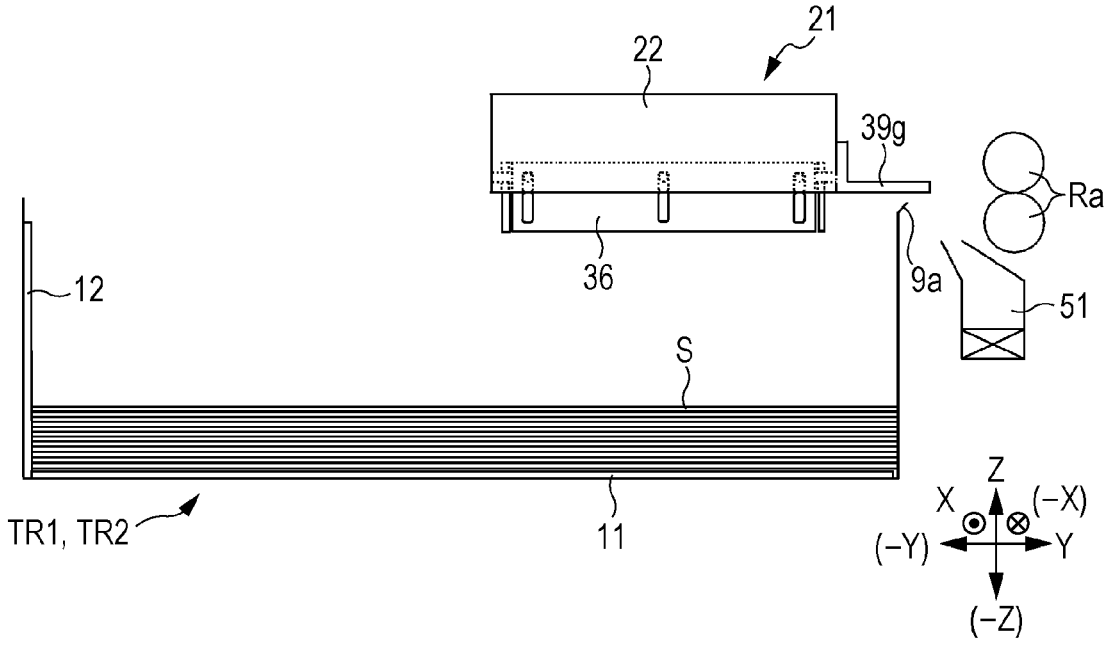
FIG. 11A illustrates a state of the feed tray before a job is started.
Figure 11B:
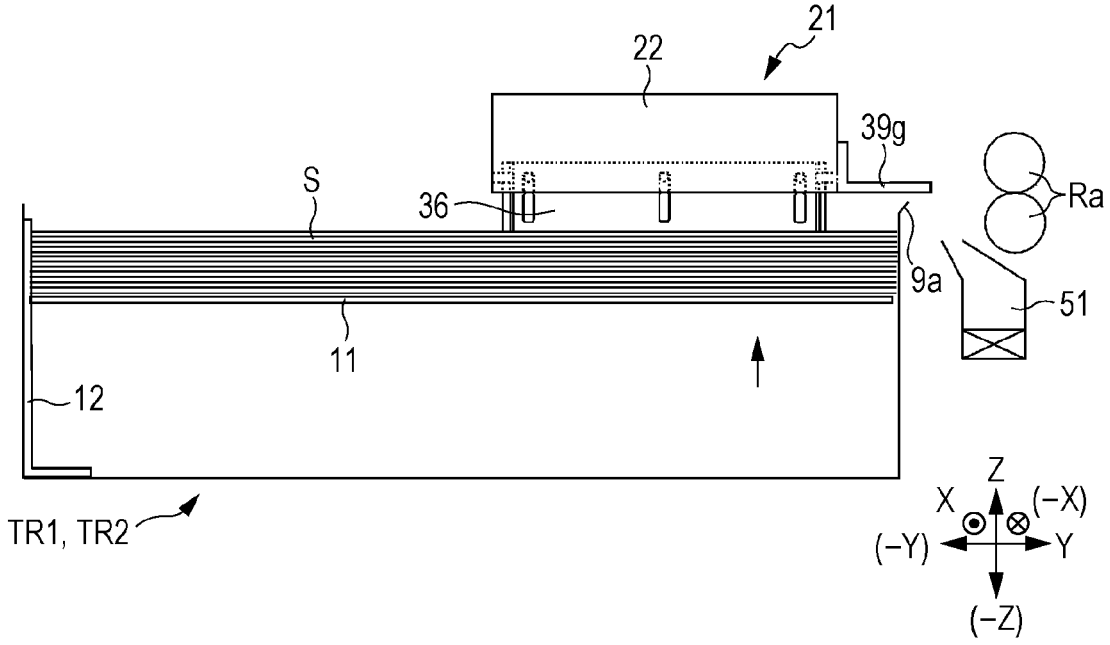
FIG. 11B illustrates a state of the feed tray after a job has been started and the loading plate has been moved to the lifted position from the state illustrated in FIG. 11A.

FIG. 11A illustrates a state of the feed tray TR1 (TR2) before a job is started. FIG. 11B illustrates a state of the feed tray TR1 (TR2) after a job has been started and the loading plate 11 has been moved to the lifted position from the state illustrated in FIG. 11A.

In the image forming apparatus U according to the first exemplary embodiment of the present invention configured as above, when a job is started, one of the sheets S on the loading plate 11 of the feed tray TR1 (TR2) is fed to the image-forming-apparatus body U3 along the feed path SH1. In the first exemplary embodiment, when a job is started, the loading plate 11 is moved from the lowered position illustrated in FIG. 11A to the lifted position illustrated in FIG. 11B, where the top of the stack of sheets S on the loading plate 11 is brought close to the lower surface 36*b* of the sealing skirt 36.

Figure 12A:
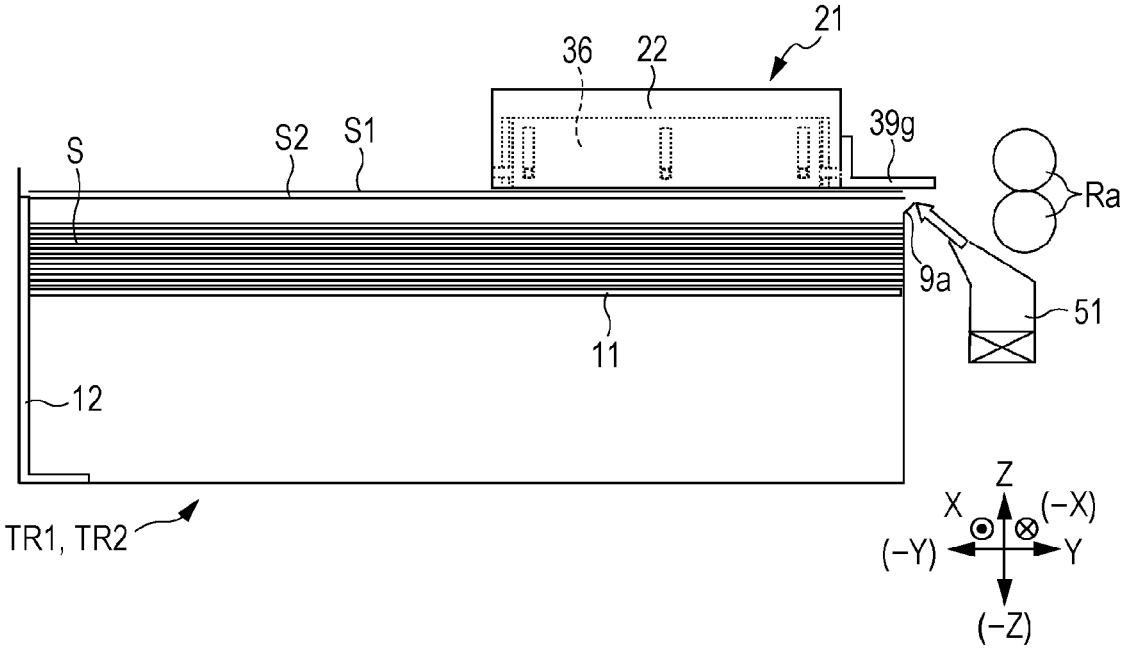
FIG. 12A illustrates a state where plural sheets have been attracted to the suction head at the activation of an exhaust fan after the state illustrated in FIG. 11B, and air is blown toward the sheets by an air blowing mechanism so that the sheets are separated from one another.
Figure 12B:
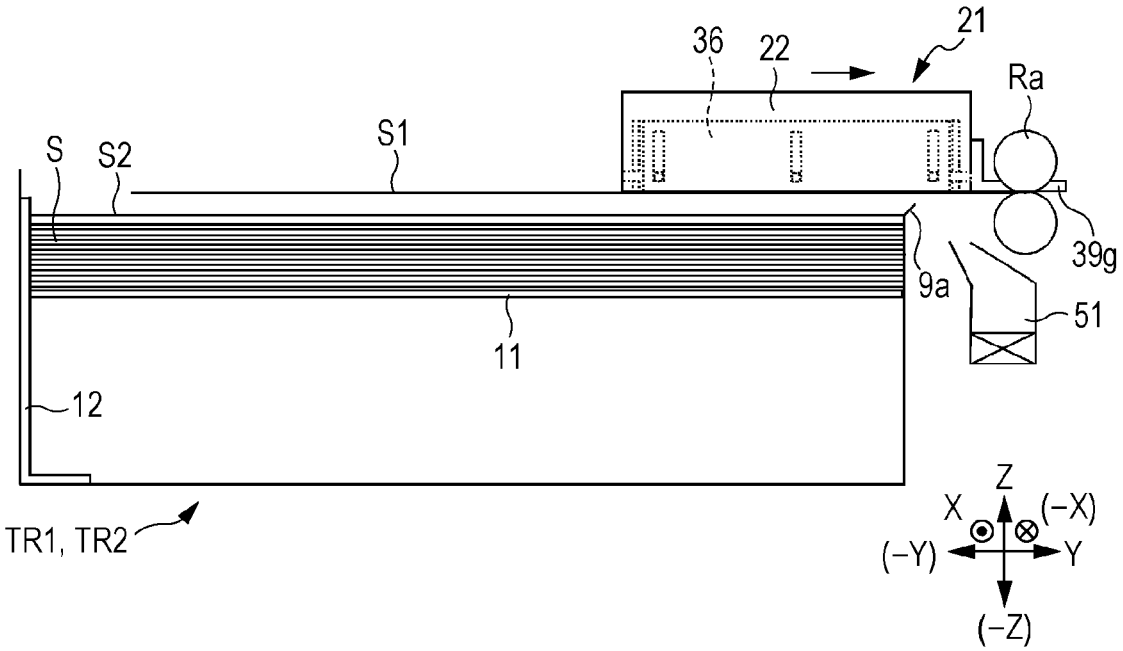
FIG. 12B illustrates a state where the suction head has been moved from the position illustrated in FIG. 12A to the feed position.

FIG. 12A illustrates a state where plural sheets S have been attracted to the suction head 22 at the activation of the exhaust fan HF after the state illustrated in FIG. 11B, and air is blown toward the sheets S by the air blowing mechanism 51 so that the sheets S are separated from one another. FIG. 12B illustrates a state where the suction head 22 has been moved from the position illustrated in FIG. 12A to the feed position.

When it is time to start suction of the sheet S, the exhaust fan HF takes in the air in the suction space 37, whereby a topmost one of the sheets S is attracted to the lower surface 36*b*. Subsequently, while the air suction is continued, the topmost sheet S attracted to the suction head 22 is lifted together with the sealing skirt 36 as illustrated in FIG. 12A.

The sheet S lifted together with the sealing skirt 36 forms a wavy shape with the presence of the sloping surface 32 and the ribs 33. The air blowing mechanism 51 blows air toward the leading end of the sheet S thus attracted. Here, if two or more sheets S have been attracted to the suction head 22 as illustrated in FIG. 12A, air is blown toward between a topmost sheet S1 and second-topmost and subsequent sheets S2, which have different wavy shapes. Thus, the second-topmost and subsequent sheets S2 are separated from the topmost sheet S1 and drop onto the stack of remaining sheets S.

In the first exemplary embodiment, when air is blown to the sheet S, the leading end of the sheet S is supported from above by the leading end guide 39*g*. Therefore, the probability that the leading end of the sheet S may be turned up or curled up is low.

Subsequently, the motor 50 of the head driving device "46 to 50" is rotated in the normal direction, whereby the suction head 22 is moved from the suction position to the feed position as illustrated in FIG. 12B.

In the related art, a suction member, such as a suction head or a suction cup, having a sheet (S) attracted thereto is moved toward the transport rollers (Ra), whereby the transport rollers (Ra) receive the sheet (S). In such a case, it is general that air suction is continued with a constant suction force until the sheet (S) is nipped by the transport rollers (Ra) and is transported by a certain length toward the downstream side in the sheet transport direction. Therefore, when the sheet (S) starts to be transported by the transport rollers (Ra), the sheet (S) is pulled toward the downstream side in the sheet transport direction while the sheet (S) is attracted to the suction member with the constant suction force.

Thus, the sheet (S) is transported toward the downstream side while a suction force that is large enough to attract the sheet (S) and to lift the sealing skirt (36) is acting on the sheet (S). That is, the sheet (S) is transported toward the downstream side while the sheet (S) is subjected to a large suction force as a perpendicular reaction force acting in a direction orthogonal to the sheet transport direction, i.e., the horizontal direction, and a large frictional force produced between the contact portion ("24*a*, 32, 33, 36*b*, and 39*h*") and the sheet (S). Consequently, the upper side of the sheet (S) may be damaged or wrinkled by rubbing against the contact portion ("24*a*, 32, 33, 36*b*, and 39*h*") of the suction member, or part of the sheet (S) that is in contact with the transport rollers (Ra) may be damaged.

Figure 13A:
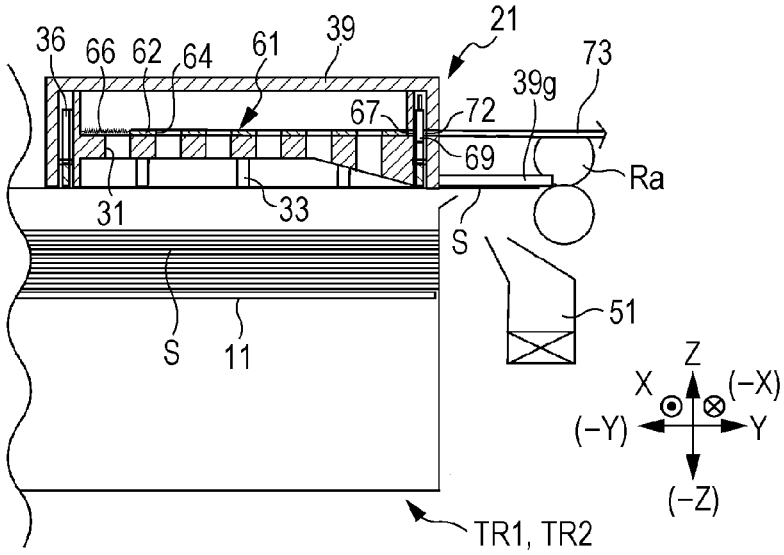
FIGS. 13A to 13C are sectional views illustrating the suction head according to the first exemplary embodiment in a state where a leading end guide has reached transport rollers after the state illustrated in FIG. 12A, in a state where the sheet has reached the transport rollers after the state illustrated in FIG. 13A, and in a state where the suction head has been moved to the feed position, illustrated in FIG. 12B, after the state illustrated in FIG. 13B, respectively.
Figure 13B:
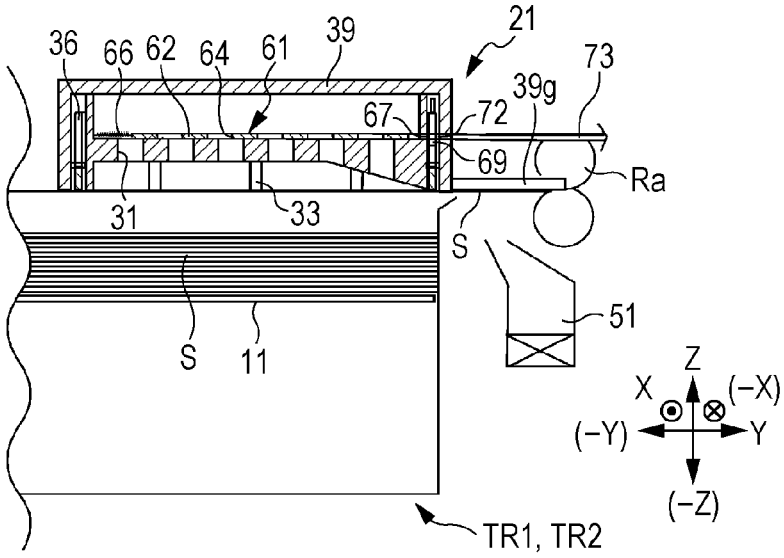
Figure 13C:
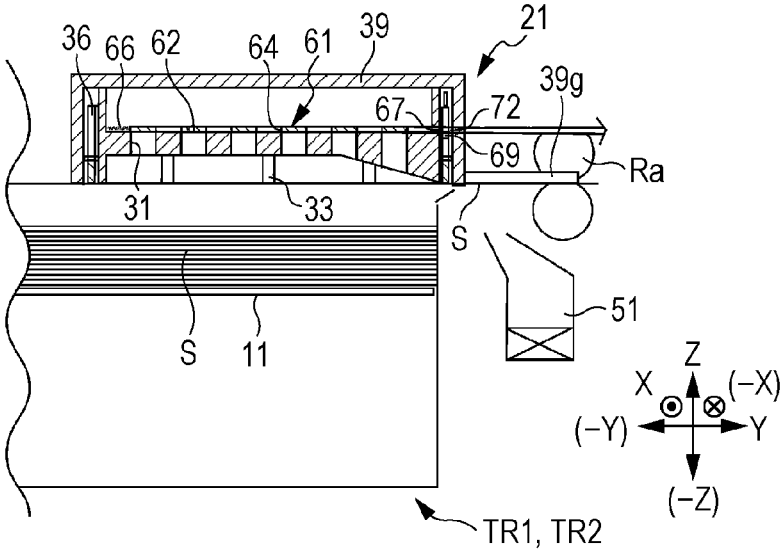

FIGS. 13A to 13C are sectional views illustrating the suction head 22 according to the first exemplary embodiment. FIG. 13A illustrates a state where the leading end guide 39*g* has reached the transport rollers Ra after the state illustrated in FIG. 12A. FIG. 13B illustrates a state where the sheet S has reached the transport rollers Ra after the state illustrated in FIG. 13A. FIG. 13C illustrates a state where the suction head 22 has been moved to the feed position, illustrated in FIG. 12B, after the state illustrated in FIG. 13B.

In the first exemplary embodiment, when the suction head 22 is moved toward the right and the leading end guide 39*g* reaches the transport rollers Ra, the pushing bars 73 pass through the through holes 67, 69, and 72 and come into contact with the suction port shutter 61 as illustrated in FIG. 13A. As the suction head 22 is further moved toward the right, the pushing bars 73 push the suction port shutter 61 toward the left as illustrated in FIGS. 13B and 13C. Thus, the suction port shutter 61 is moved from the open position illustrated in FIG. 10A beyond the half shut position illustrated in FIG. 10B to the fully shut position illustrated in FIG. 10C. Accordingly, the area of each suction port 31 that allows air to flow therethrough becomes smaller. Consequently, the air suction capability is reduced.

That is, in the first exemplary embodiment, with reference to the timing at which the transport rollers Ra start to transport the sheet S, the shutting portions 62 of the suction port shutter 61 gradually cover the suction ports 31 from the right side as illustrated in FIG. 13B, whereby the path of the air flowing from the suction ports 31 to the exhaust fan HF is narrowed. Accordingly, the suction force applied to the sheet S is reduced. Consequently, in the image forming apparatus U according to the first exemplary embodiment, damage to the sheet S, such as scratches and wrinkles, is reduced compared with the case of the related art that does not employ a mechanism that gradually reduces the suction force applied to the sheet (S) when the transport rollers (Ra) start to transport the sheet S.

Particularly, in the first exemplary embodiment, the suction force applied to the sheet S starts to be reduced before the sheet S reaches the transport rollers Ra, and the frictional force produced between the sheet S and the suction head 22 is also reduced even immediately after the sheet S starts to be transported by the transport rollers Ra Consequently, in the image forming apparatus U according to the first exemplary embodiment, damage to the sheet S is further reduced compared with the case where the suction force applied to the sheet S starts to be reduced when the sheet S has reached the transport rollers Ra.

If the suction port shutter 61 is moved to the fully shut position before the sheet S reaches the transport rollers Ra, the suction force having been applied to the sheet S is removed and the sheet S may drop from the suction head 22 before the sheet S is received by the transport rollers Ra.

To avoid such a situation, in the first exemplary embodiment, the suction port shutter 61 is configured to reach the fully shut position after the sheet S has reached the transport rollers Ra. That is, the suction force starts to be reduced before the sheet S reaches the transport rollers Ra and, after the sheet S has reached the transport rollers Ra, the suction port shutter 61 reaches the fully shut position and the suction force is removed. Simultaneously, the suction head 22 reaches the feed position, and the exhaust fan HF is stopped.

To summarize, in the image forming apparatus U according to the first exemplary embodiment, the sheet S is kept attracted to the suction head 22 with the sealing skirt 36 also kept lifted until the sheet S reaches the transport rollers Ra, and the suction force is further reduced after the sheet S has reached the transport rollers Ra, whereby the frictional force produced between the suction head 22 and the sheet S that is being transported toward the downstream side in the sheet transport direction is also further reduced. Consequently; damage to the sheet S is reduced compared with the case of the related art in which the sheet (S) continues to be attracted to the suction head (22) with a constant suction force until the suction head (22) reaches the feed position.

In the image forming apparatus U according to the first exemplary embodiment of the present invention configured as above, mechanical members such as the urging springs 66 and the pushing bars 73 are provided so as to move the suction port shutter 61 toward the left relative to the suction head 22 along with the movement of the suction head 22 toward the right. That is, when the suction port shutter 61 is moved relative to the suction head 22 and the suction ports 31 is thus opened or closed in the first exemplary embodiment, the suction head 22 is moved in the same way as in a sheet feeding operation employed in the related art. Therefore, the suction force applied to the sheet S is reduced without providing an additional driving member, such as a motor or a solenoid, for moving the suction port shutter 61.

Consequently, in the image forming apparatus U according to the first exemplary embodiment, the mechanism of reducing the suction force is simpler, the probability of failure is lower, and the reliability is therefore higher than in a case where an additional driving member and a controller that controls the additional driving member are provided. Moreover, manufacturing costs for reducing the suction force are lower than in the case where an additional motor or solenoid and other associated elements are provided.

Second Exemplary Embodiment

In the following description of a second exemplary embodiment of the present invention, elements the same as those in the first exemplary embodiment are denoted by the corresponding reference numerals, and detailed description thereof is omitted.

The second exemplary embodiment differs from the first exemplary embodiment in features described, below. The other features of the second exemplary embodiment are the same as those of the first exemplary embodiment.

Figure 14A:
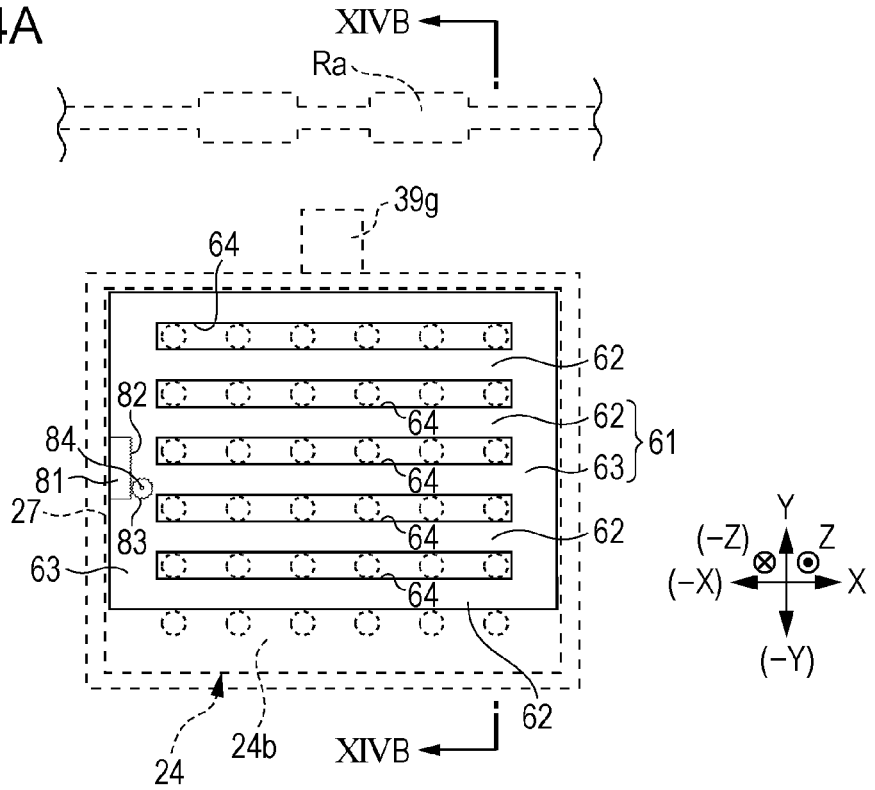
FIGS. 14A to 14C correspond to FIGS. 9A to 9C illustrating the first exemplary embodiment, and are a plan view of a suction port shutter according to a second exemplary embodiment of the present invention seen from above inside the suction head, a sectional view taken along line XIVB-XIVB illustrated in FIG. 14A, and a perspective view of a rack and a pinion, respectively.
Figure 14B:
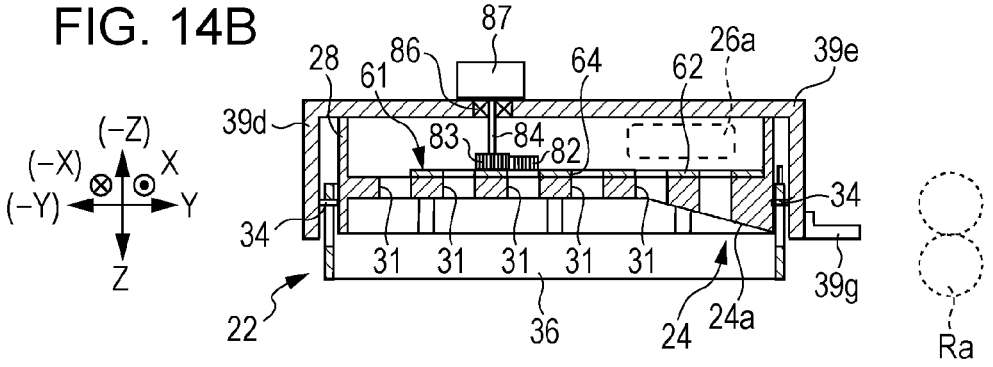
Figure 14C:
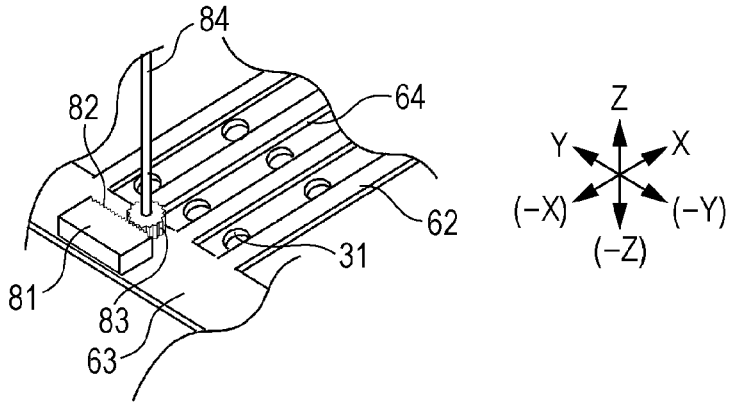

FIGS. 14A to 14C correspond to FIGS. 9A to 9C illustrating the first exemplary embodiment. FIG. 14A is a plan view illustrating the suction port shutter 61 seen from above inside the suction head 22. FIG. 14B is a sectional view taken along line XIVB-XIVB illustrated in FIG. 14A. FIG. 14C is a perspective view of a rack 81 and a pinion 83.

Referring to FIGS. 14A to 14C, the second exemplary embodiment does not employ the urging springs 66, the inner through holes 67, the inner covering members 68, the intermediate through holes 69, the intermediate covering members 71, the outer through holes 72, and the pushing bars 73 that are employed in the first exemplary embodiment.

In the second exemplary embodiment, the rear one of the connecting portions 63 supports in a laterally central portion of the upper surface thereof the rack 81 as an exemplary flat-plate gear extending in the lateral direction. The rack 81 has on the front face thereof a teeth portion 82 as an exemplary gear teeth portion extending in the lateral direction.

The pinion 83 is an exemplary disc-shaped gear and is provided in front of the teeth portion 82 and in mesh with the teeth portion 82. The pinion 83 is provided on the connecting portion 63 so as not to overlap any of the suction ports 31, and is supported by a motor shaft 84 as an exemplary driving shaft extending vertically. The motor shaft 84 according to the second exemplary embodiment is rotatable with the aid of a bearing 86 provided in the top plate 39*a* of the head body 23. The motor shaft 84 is connected to an opening-and-closing motor 87 as an exemplary opening-and-closing driving source with a transmission mechanism (not illustrated) interposed therebetween, whereby the driving force of the opening-and-closing motor 87 is transmitted to the motor shaft 84.

Thus, in the second exemplary embodiment, when the pinion 83 is driven to rotate with the normal or reverse rotation of the opening-and-closing motor 87, the suction port shutter 61 is moved in the lateral direction.

Figure 15A:
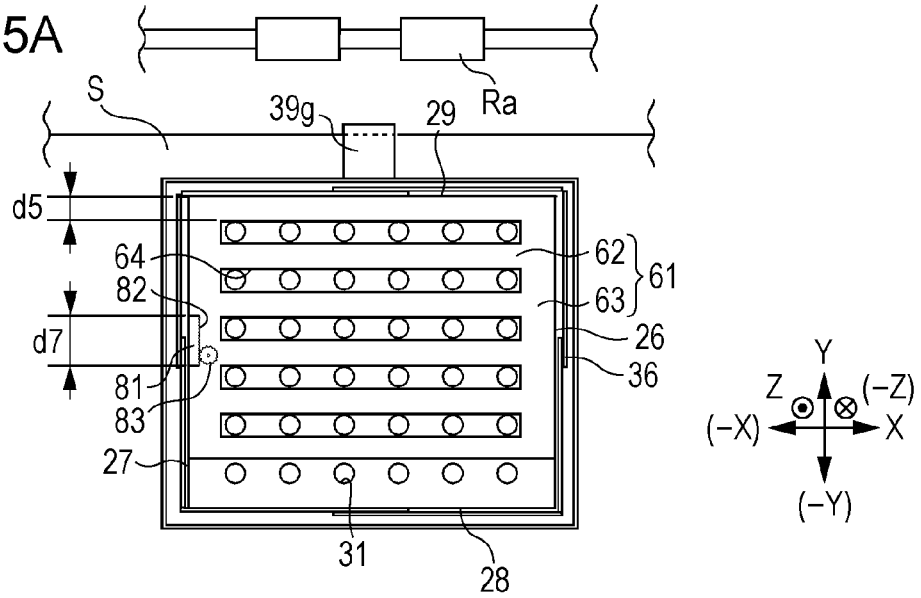
FIGS. 15A to 15C correspond to FIGS. 10A to 10C illustrating the first exemplary embodiment, and illustrate the suction port shutter according to the second exemplary embodiment at an open position, at a half shut position, and at a fully shut position, respectively.
Figure 15B:
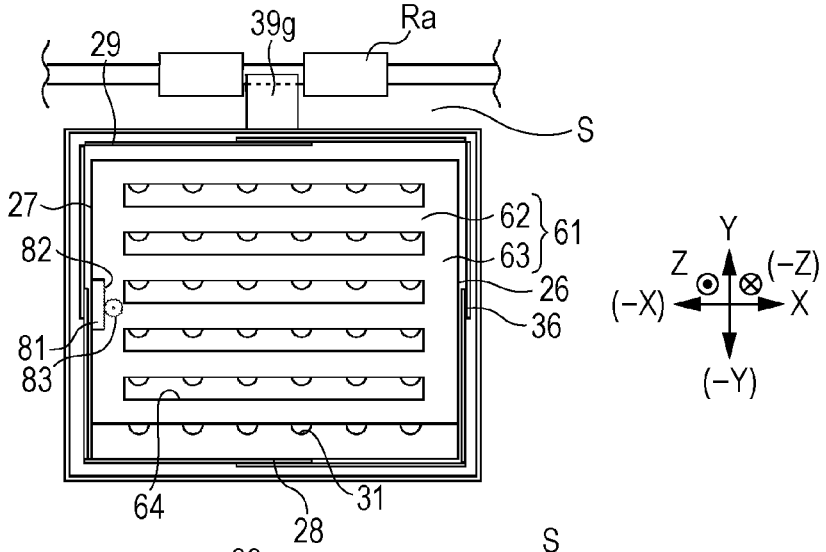
Figure 15C:
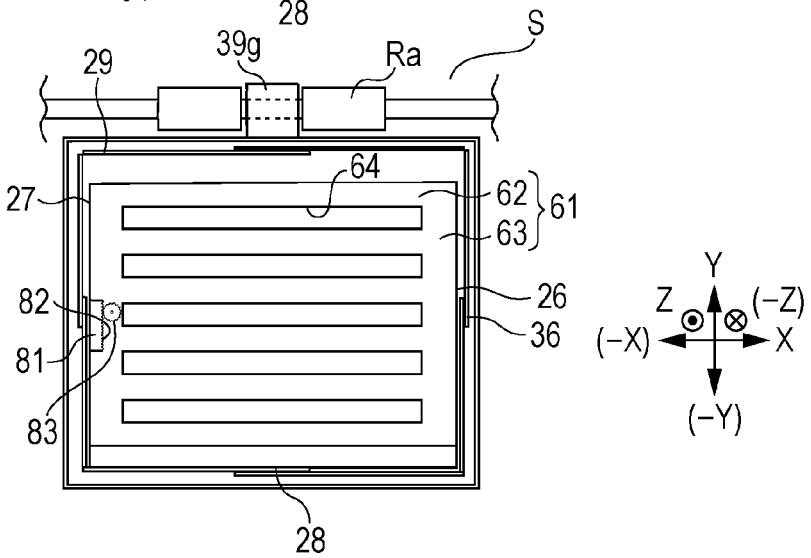

FIGS. 15A to 15C correspond to FIGS. 10A to 10C illustrating the first exemplary embodiment and illustrate the suction port shutter 61 according to the second exemplary embodiment. In FIG. 15A, the suction port shutter 61 is at the open position. In FIG. 15B, the suction port shutter 61 is at the half shut position. In FIG. 15*c*, the suction port shutter 61 is at the fully shut position.

In the second exemplary embodiment, a lateral length d7 of the teeth portion 82 is greater than the length of lateral movement d5, and the suction port shutter 61 is movable among the open position illustrated in FIG. 15A, the half shut position illustrated in FIG. 15B, and the fully shut position illustrated in FIG. 15C.

The elements denoted by reference numerals 81 to 87 together form the opening-and-closing mechanism "81 to 87" according to the second exemplary embodiment. The suction port shutter 61, the opening-and-closing mechanism "81 to 87", and the controller C together form a suction-force-changing mechanism "61, 81 to 87, and C" according to the second exemplary embodiment.

Figure 16:
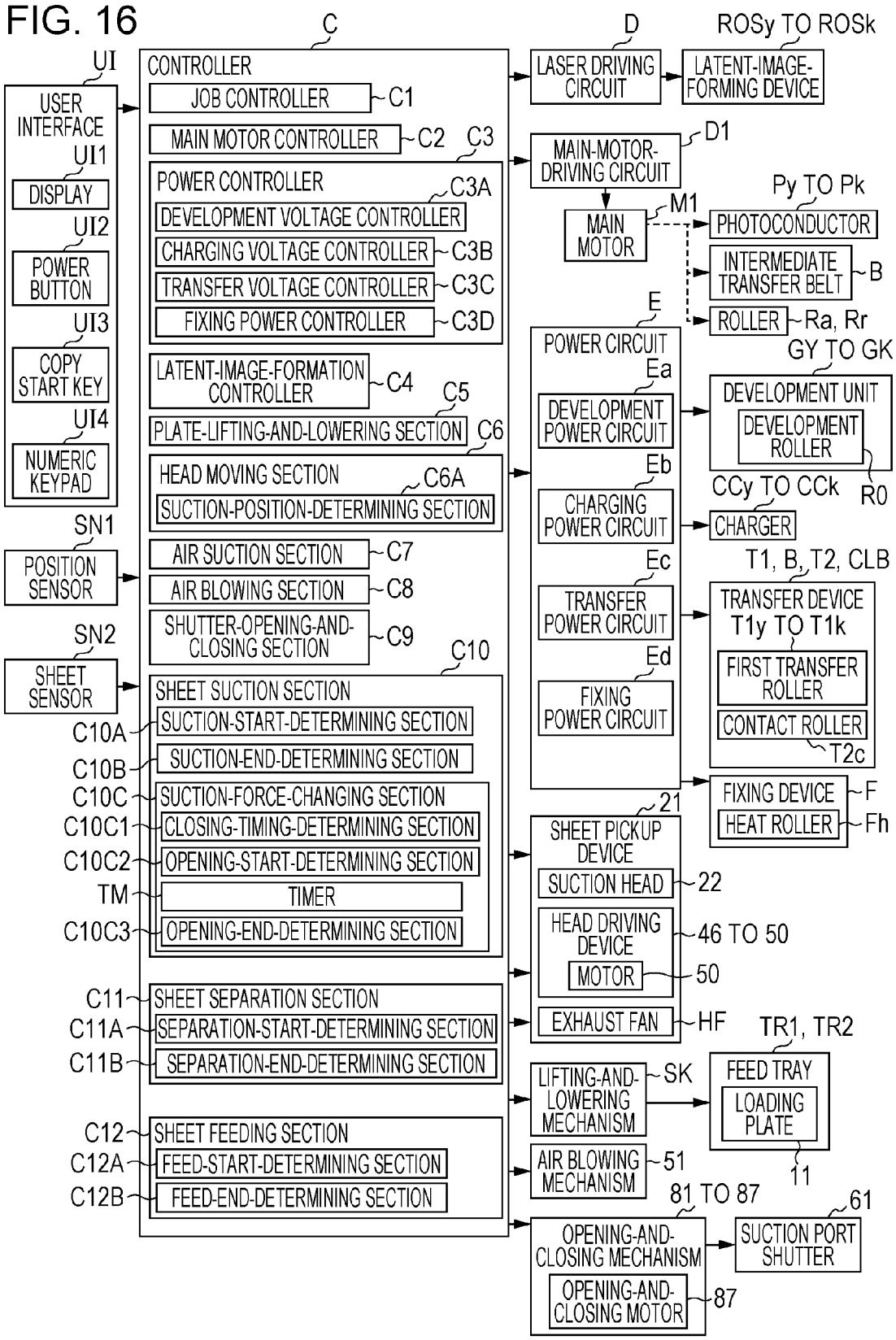
FIG. 16 is a block diagram illustrating functions of a controller of the image forming apparatus according to the second exemplary embodiment.

FIG. 16 is a block diagram illustrating functions of the controller C of the image forming apparatus U according to the second exemplary embodiment.

Referring to FIG. 16, the controller C includes a small information processing device, i.e., a microcomputer, including an input/output interface (I/O) that performs input, output, and so forth of signals to and from an external device, a read-only memory (ROM) that stores programs, information, and the like for performing processing operations, a random access memory (RAM) that temporarily stores data, a central processing unit (CPU) that performs processing operations corresponding to the programs stored in the ROM, and other associated elements such as an oscillator. The controller C realizes various functions by executing programs stored in the ROM.

The controller C receives signals that are output from signal outputting elements such as the user interface UI and the sensors SN1 and SN2.

The user interface UI includes the display UI1, a power button UI2, and, as exemplary input buttons, a copy start key UI3, a numeric keypad UI4, and so forth.

The position sensor SN1 detects the presence/absence of the on-head light-blocking portion 39*a*1 and determine whether or not the suction head 22 is at the home position, i.e., the suction position.

The sheet sensor SN2 detects the presence/absence of a sheet S that has been fed from the suction head 22 to the transport rollers Ra.

The controller C is connected to the laser driving circuit D, a main-motor-driving circuit D1 as an exemplary driving circuit for a main driving source, the power circuit E, and other controlled elements (not illustrated). The controller C outputs signals for controlling operations of the foregoing elements.

The laser driving circuit D drives the latent-image-forming devices ROSy, ROSm, ROSc, and ROSk such that latent images are formed on the respective photoconductors Py, Pm, Pc, and Pk.

The main-motor-driving circuit D1 causes a main motor M1 as an exemplary main driving source to drive the photoconductors Py, Pm, Pc, and Pk, the intermediate transfer belt B, and other associated elements to rotate.

The power circuit E includes a development power circuit Ea, a charging power circuit Eb, a transfer power circuit Ec, and a fixing power circuit Ed.

The development power circuit Ea applies a development voltage to the development rollers R0 of the development units GY, GM, GC, and GK.

The charging power circuit Eb applies a charging voltage to the chargers CCy, CCm, CCc, and CCk.

The transfer power circuit Ec applies a transfer voltage to the first transfer rollers T1*y*, T1*m*, T1*c*, and T1*k* and the contact roller T2*c* included in the transfer device "T1, B, T2, and CLB".

The fixing power circuit Ed supplies a heating power to a heater as an exemplary heating member that heats the heat roller Fh of the fixing device F.

The controller C includes below-described sections that realize various functions through programs for controlling the operations of the above controlled elements D, D1, and E in accordance with the signals that are output from the above signal outputting elements SN1, and SN2.

A job controller C1 as an exemplary image formation controller controls the latent-image-forming devices ROSy, ROSm, ROSc, and ROSk, the toner-image-forming members "UY and GY", "UM and GM", "UC and GC", and "UK and GK", the fixing device F, the sheet transport system SU, and other associated elements in accordance with information that is input through the copy start key UI3, and thus executes a job as an exemplary image forming operation.

A main motor controller C2 as an exemplary driving controller for a main driving source controls the rotation of the main motor M1 through the main-motor-driving circuit D1 and thus controls the rotational driving of the photoconductors Py, Pm, Pc, and Pk, the development rollers R0 of the development units GY, GM, GC, and GK, the heat roller Fh of the fixing device F, the transport rollers Ra, and other associated elements.

A power controller C3 includes a development voltage controller C3A, a charging voltage controller C3B, a transfer voltage controller C3C, and a fixing power controller C3D. The power controller C3 controls the operation of the power circuit E and thus controls the application of voltages and the supplying of power with respect to the associated elements.

The development voltage controller C3A controls the development power circuit Ea and thus controls the development voltage to be applied to the development rollers R0 of the development units GY, GM, GC, and GK.

The charging voltage controller C3B controls the charging power circuit Eb and thus controls the charging voltage to be placed on the chargers CCy, CCm, CCc, and CCk.

The transfer voltage controller C3C controls the transfer power circuit Ec and thus controls the transfer voltage to be applied to the rollers T1*y*, T1*m*, T1*c*, and T1*k* and T2*c* of the transfer device "T1, B, T2, and CLB".

The fixing power controller C3D controls the fixing power circuit Ed and thus controls the temperature, i.e., the fixing temperature, of the heater provided to the heat roller Fh of the fixing device F.

A latent-image-formation controller C4 controls the latent-image-forming devices ROSy, ROSm, ROSc, and ROSk through the laser driving circuit D such that electrostatic latent images are formed on the photoconductors Py, Pm, Pc, and Pk.

A plate-lifting-and-lowering section C5 as an exemplary controller for the loading-member-moving mechanism controls the lifting-and-lowering mechanism SK and thus controls the movement of the loading plate 11 between the lowered position illustrated in FIG. 4A and the lifted position illustrated in FIG. 4B. The plate-lifting-and-lowering section C5 according to the second exemplary embodiment moves the loading plate 11 from the lowered position to the lifted position when a job is started, and from the lifted position to the lowered position after the job ends.

A head moving section C6 as an exemplary controller for the holding-member-moving mechanism includes a suction-position-determining section C6A that determines whether or not the position sensor SN1 has detected the on-head light-blocking portion 39*a*1, and thus determines whether or not the suction head 22 has been moved to the suction position. The head moving section C6 controls the normal and reverse rotations of the motor 50 included in the head driving device "46 to 50" and thus controls the movement of the suction head 22 between the suction position illustrated in FIG. 8A and the feed position illustrated in FIG. 8B.

An air suction section C7 as an exemplary suction device controller controls the operation of the exhaust fan HF included in the sheet pickup device 21 and thus controls the suction of air taken in from the suction ports 31 of the suction head 22 and flowing through the exhaust port 26*a*, the exhaust duct 39*f*, and the bellows 40.

An air blowing section C8 is an exemplary cleaning member controller, an exemplary blower device controller, and an exemplary medium-separating-mechanism controller. The air blowing section C8 controls the air blowing mechanism 51 and thus controls the blowing of air toward the target area AR1 illustrated in FIG. 2.

A shutter-opening-and-closing section C9 as an exemplary opening-and-closing-mechanism controller controls the normal and reverse rotations of the opening-and-closing motor 87 included in the opening-and-closing mechanism "81 to 87" and thus controls the movement of the suction port shutter 61 among the open position illustrated in FIG. 15A, the half shut position illustrated in FIG. 15B, and the fully shut position illustrated in FIG. 15C.

A sheet suction section C10 is an exemplary suction controller and an exemplary medium suction section. The sheet suction section C10 includes a suction-start-determining section C10A, a suction-end-determining section C10B, and a suction-force-changing section C10C and causes, through the air suction section C7, the suction head 22 to attract a sheet S.

The suction-start-determining section C10A determines whether or not a suction timing ta at which suction of the sheet S is to be started has arrived and thus determines whether or not to start suction of the sheet S. The suction timing ta according to the second exemplary embodiment is set by counting backward from the transfer timing at which a set of toner images reaches the second transfer area Q4.

The suction-end-determining section C10B determines whether or not a feed time t1 has elapsed and thus determines whether or not to end the suction of the sheet S. The feed time t1 is a time period from when air suction is started at the suction timing ta until when the suction head 22 reaches the feed position.

The suction-force-changing section C10C includes a closing-timing-determining section C10C1, an opening-start-determining section C10C2, a timer TM, and an opening-end-determining section C10C3. The suction-force-changing section C10C causes, through the shutter-opening-and-closing section C9, the suction port shutter 61 to be opened or closed and thus changes the suction force. The suction-force-changing section C10C according to the second exemplary embodiment moves the suction port shutter 61 from the open position to the fully shut position after a sheet S is attracted to the suction head 22. Thus, the suction-force-changing section C10C reduces the area of each suction port 31 that allows air to flow therethrough, whereby the suction force for attracting the sheet S is reduced.

The closing-timing-determining section C10C1 determines whether or not a closing timing tb at which closing of the suction port shutter 61 is to be started has arrived. In the second exemplary embodiment, letting, the velocity at which the suction port shutter 61 is moved in the lateral direction by the opening-and-closing motor 87 be V (mm/s) and the time period taken to move the suction port shutter 61 by the length of lateral movement d5 (mm), illustrated in FIG. 15C, be shutter moving time t4, the following holds: t4=(d5/V) (sec). Therefore, in the second exemplary embodiment, the closing timing tb is set so that the suction port shutter 61 having been at the open position reaches the fully shut position when the suction head 22 reaches the feed position at the time when the feed time t1 from the suction timing to has elapsed. There is a time lag t5 (sec) from the start of the feed time t1 to the start of the shutter moving time t4. Considering the time lag t5, the closing timing tb is set to a point of time when the time lag t5 from the suction timing ta has elapsed. In the second exemplary embodiment, the velocity V of the suction port shutter 61 is equal to the velocity of the suction head 22. Therefore, in the second exemplary embodiment, the feed time t1 that starts at the suction timing ta ends when the shutter moving time t4 that starts at the closing timing tb has elapsed.

The opening-start-determining section C10C2 determines whether or not the suction-end-determining section C10B has determined to stop the suction when the feed time t1 from the suction timing ta has elapsed, and thus determines whether or not to end the closing of the suction port shutter 61 and to start opening the suction port shutter 61.

The timer TM as an exemplary movement-time-counting section counts the shutter moving time t4 from the start of the opening of the suction port shutter 61.

The opening-end-determining section C10C3 determines whether or not the timer TM has counted the shutter moving time t4 and thus determines whether or not to end the opening of the suction port shutter 61.

Thus, in the second exemplary embodiment, if the suction-start-determining section C10A has determined that the suction timing ta has arrived, the sheet suction section C10 causes the exhaust fan HF to perform air suction from the suction ports 31, whereby the topmost one of the sheets S on the loading plate 11 is attracted to the lower surface 36*b* of the sealing skirt 36. As the air in the suction space 37 whose bottom is substantially sealed by the sheet S is further exhausted, the pressure in the suction space 37 is further lowered and the sealing skirt 36 is lifted together with the topmost sheet. S. Thus, the sheet S is attracted to the suction head 22.

After the sheet S has been attracted to the suction head 22 and the suction head 22 has started to move toward the feed position, the sheet suction section C10 causes the suction-force-changing section C10C to close the suction port shutter 61, whereby the suction force is reduced. Specifically, if the closing-timing-determining section C10C1 has determined that the closing timing tb has arrived, the sheet suction section C10 causes the opening-and-closing motor 87 to rotate in the normal direction, whereby the suction port shutter 61 is moved from the open position beyond the half shut position to the fully shut position. Consequently, the suction force is reduced.

If the suction-end-determining section C10B has determined that the feed time t1 from the suction timing to has elapsed, the sheet suction section C10 stops the suction of air and thus stops attracting the sheet S to the suction head 22. If the opening-start-determining section C10C2 has determined that the suction of air has been stopped and the time to start opening of the suction port shutter 61 has arrived, the sheet suction section C10 causes the opening-and-closing motor 87 to rotate in the reverse direction until the opening-end-determining section C10C3 determines that the timer TM has counted the shutter moving time t4, whereby the suction port shutter 61 returns from the fully shut position to the open position.

A sheet separation section C11 is an exemplary separation controller and an exemplary medium separating section. The sheet separation section C11 includes a separation-start-determining section C11A and a separation-end-determining section C11B. The sheet separation section C11 causes, through the air blowing section. C8, air to be blown toward the sheet S attracted to the suction head 22. If plural sheets S are attracted to the suction head 22 because of static electricity or the like, the plural sheets S are separated from one another.

The separation-start determining section C11A determines whether or not a suction time t2 from the suction timing to has elapsed and thus determines whether or not to start sheet separation. The suction time t2 is a time period for which the sheet S that has been lifted together with the sealing skirt 36 is kept attracted to the suction head 22 so that the sheet S can have a wavy shape by bending along the sloping surface 32 and the ribs 33. In the second exemplary embodiment, the suction time t2 is set on the basis of an experiment or the like and in accordance with the suction force produced by the exhaust fan HF and the associated elements so as to be a time period during which the sheet S assuredly has a wavy shape while being in contact with the sloping surface 32 and the ribs 33.

The separation-end-determining section CHB determines whether or not separation time t3 from the start of sheet separation has elapsed and thus determines whether or not to end sheet separation. The separation time t3 is a time period for which sheet separation performed by blowing air is continued. The separation time t3 according to the second exemplary embodiment is set on the basis of an experiment or the like and in accordance with the wind force produced by the air blowing mechanism 51 so as to be a time period during which sheets S, if plural, are assuredly separated from one another.

In the second exemplary embodiment, the topmost sheet S is attracted to the suction head 22 and thus has a wavy shape. If two or more sheets S are attracted to the suction head 22, since the topmost sheet Sand the second-topmost and subsequent sheets S have different wavy shapes, gaps are produced thereamong. In the second exemplary embodiment, an area corresponding to the leading end of one or more sheets. S attracted to the suction head 22 that is at the suction position is defined as the target area AR1. That is, ends of the gaps at the leading ends of the sheets S reside in the target area AR1.

Therefore, in the second exemplary embodiment, if the separation-start-determining section C11A has determined that the suction time t2 from the suction timing to has elapsed, the sheet separation section C11 starts the blowing of air toward the gaps produced in the target area AR1. Thus, the second-topmost and subsequent sheets S are separated from the topmost sheet S attracted to the suction head 22. From the start of sheet separation, the sheet separation section C11 continues the blowing of air for the separation time t3. If the separation-end-determining section C11B has determined that the separation time t3 has elapsed, the sheet separation section C11 stops the blowing of air, whereby the sheet separation ends.

A sheet feeding section C12 as an exemplary medium feeding section includes a feed-start-determining section C12A and a feed-end-determining section C12B. The sheet feeding section C12 causes, through the head moving section C6, the sheet S attracted to the suction head 22 to be fed to the transport rollers Ra provided on the downstream side in the sheet transport direction.

The feed-start-determining section C12A determines whether or not the separation-end-determining section C11B has ended the blowing of air and thus determines whether or not to start moving the suction head 22 to the feed position.

The feed-end-determining section C12B determines, through the suction-end-determining section C10B, whether or not the feed time t1 from the suction timing ta has elapsed and thus determines whether or not to end the moving of the suction head 22 to the feed position.

Thus, in the second exemplary embodiment, if the feed-start-determining section C12A has determined that the blowing of air has ended, the sheet feeding section C12 causes the motor 50 included in the head driving device 46-50 to rotate in the normal direction, whereby the suction head 22 is moved from the suction position to the feed position. Thus, the sheet S attracted to the suction head 22 is fed to the transport rollers Ra.

Furthermore, if the feed-end-determining section C12B has determined that the feed time t1 from the suction timing ta has elapsed, the sheet feeding section C12 ends the moving of the suction head 22 to the feed position and causes the motor 50 to rotate in the reverse direction, whereby the suction head 22 return from the feed position to the suction position.

Figure 17:
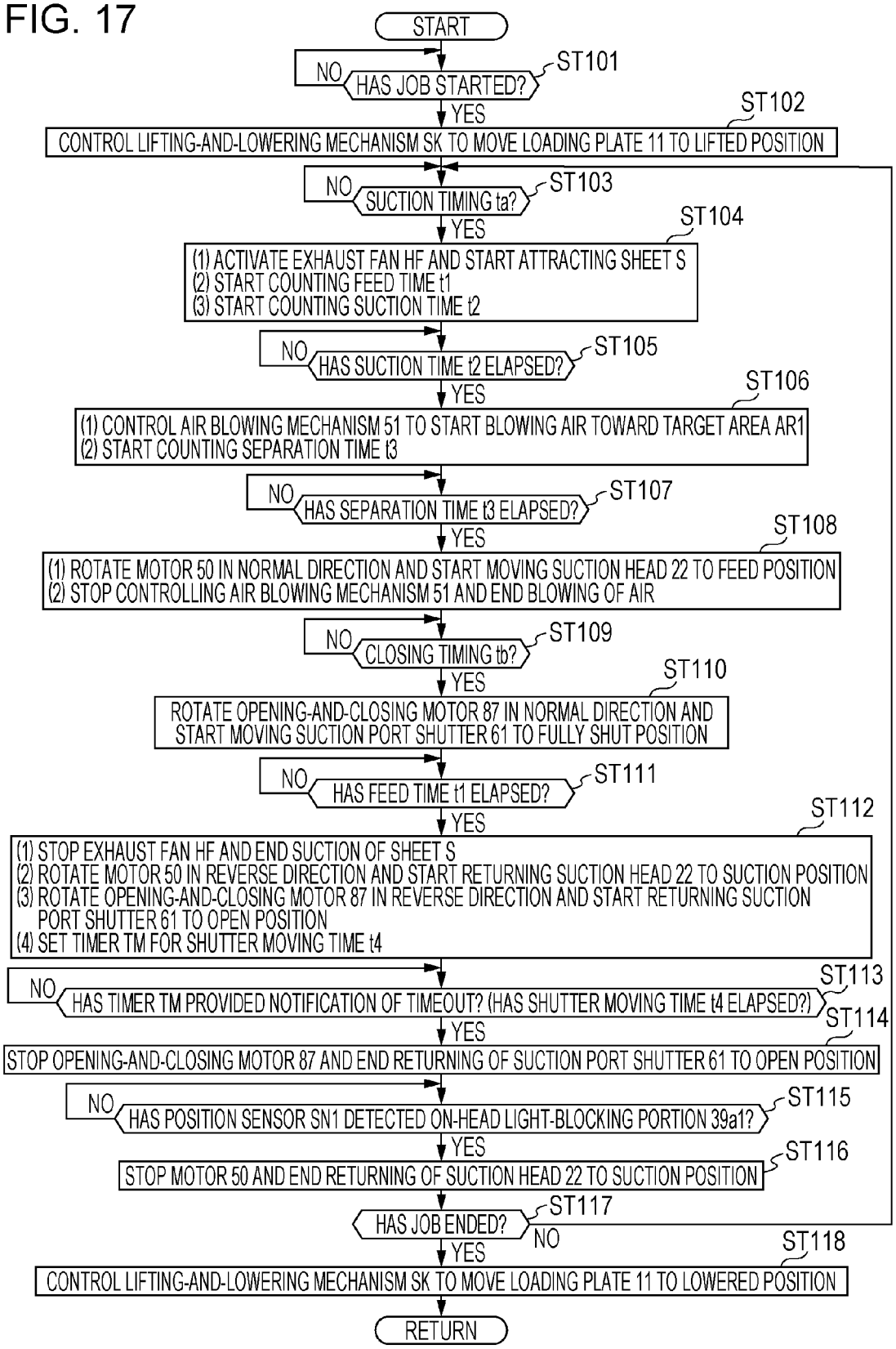
FIG. 17 is a flowchart of a sheet feeding operation according to the second exemplary embodiment.

FIG. 17 is a flowchart of a sheet feeding operation according to the second exemplary embodiment.

Individual steps ST in the flowchart illustrated in FIG. 17 are performed in accordance with programs stored in the controller C of the image forming apparatus U and in parallel with other operations performed in the image forming apparatus U.

The operation illustrated in FIG. 17 starts with powering the image forming apparatus U.

In step ST101 in FIG. 17, whether or not a job has been started is determined. If yes, the operation proceeds to step ST102. If no, step ST101 is repeated.

In step ST102, the lifting-and-lowering mechanism SK is controlled to move the loading plate 11 from the lowered position to the lifted position. Then, the operation proceeds to step ST103.

In step ST103, whether or not the suction timing ta at which attraction of the sheet S is to be started has arrived is determined. If yes, the operation proceeds to step ST104. If no, step ST103 is repeated.

In step ST104, the following sub-steps are performed:

(1) activate the exhaust fan HF and start attraction of the sheet S;

(2) start counting the feed time t1 taken from when air suction is started at the suction timing ta until when the sheet S attracted to the suction head 22 that is at the feed position is fed to the transport rollers Ra; and (3) start counting the suction time t2 for which the sheet S lifted together with the sealing skirt 36 is to be kept attracted to the suction head 22.

Then, the operation proceeds to step ST105.

In step ST105, whether or not the suction time t2 has elapsed is determined, whereby whether or not to start sheet separation is determined. If yes, the operation proceeds to step ST106. If no, step ST105 is repeated.

In step ST106, the following sub-steps are performed:

(1) control the air blowing mechanism 51 to start blowing of air toward the target area AR1, that is, start sheet separation; and (2) start counting the separation time t3 for which blowing of air for sheet separation is continued.

Then, the operation proceeds to step ST107.

In step ST107, whether or not the separation time t3 has elapsed is determined, whereby whether or not to start moving the suction head 22 toward the feed position is determined. If yes, the operation proceeds to step ST108. If no, step ST107 is repeated.

In step ST108, the following sub-steps are performed:

(1) rotate the motor 50 in the normal direction and start moving the suction head 22 from the suction position to the feed position; and (2) stop controlling the air blowing mechanism 51 and end the blowing of air, that is, end sheet separation.

Then, the operation proceeds to step ST109.

In step ST109, whether or not the closing timing tb at which closing of the suction port shutter 61 is to be started has arrived is determined. If yes, the operation proceeds to step ST110. If no, step ST109 is repeated.

In step ST110, the opening-and-closing motor 87 is rotated in the normal direction, whereby the suction port shutter 61 starts, to be moved from the open position to the fully shut position. Then, the operation proceeds to step ST111.

In step ST111, whether or not the feed time t1 has elapsed is determined, whereby whether or not to end the moving of the suction head 22 to the feed position and to start returning the suction head 22 to the suction position is determined. If yes, the operation proceeds to step ST112. If no, step ST111 is repeated.

In step ST112, the following sub-steps are performed:

(1) stop the exhaust fan HF and end the suction of the sheet S;

(2) rotate the motor 50 in the reverse direction and start returning the suction head 22 from the feed position to the suction position;

(3) rotate the opening-and-closing motor 87 in the reverse direction and start returning the suction port shutter 61 from the fully shut position to the open position; and (4) set the timer TM for the shutter moving time t4.

Then, the operation proceeds to step ST113.

In step ST113, whether or not the timer TM has provided a notification of a timeout indicating that the shutter moving time t4 has elapsed is determined. If yes, the operation proceeds to step ST114. If no, step ST113 is repeated.

In step ST114, the opening-and-closing motor 87 is stopped and the returning of the suction port shutter 61 to the open position ends. Then, the operation proceeds to step ST115.

In step ST115, whether or not the position sensor SN1 has detected the on-head light-blocking portion 39*a*1 is determined, whereby whether or not the returning of the suction head 22 from the feed position to the suction position has ended is determined. If yes, the operation proceeds to step ST116. If no, step ST115 is repeated.

In step ST116, the motor 50 is stopped and the returning of the suction head 22 to the suction position ends. Then, the operation proceeds to step ST117.

In step ST117, whether or not the job has ended is determined. If yes, the operation proceeds to step ST118. If no, the operation returns to step ST103.

In step ST118, the lifting-and-lowering mechanism SK is controlled to move the loading plate 11 from the lifted position to the lowered position. Then, the operation returns to step ST101.

Figure 18A:
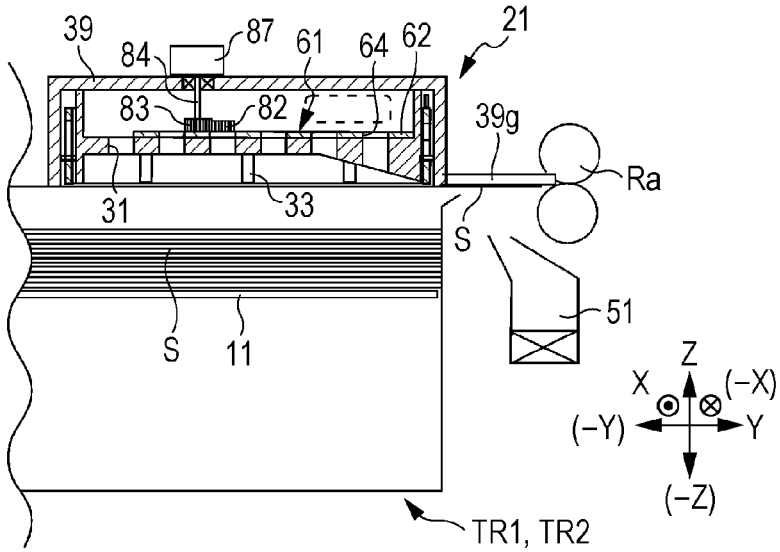
FIGS. 18A to 18C correspond to FIGS. 13A to 13C illustrating the first exemplary embodiment, and are sectional views illustrating the suction head according to the second exemplary embodiment in a state where the leading end guide has reached the transport rollers, in a state where the sheet has reached the transport rollers after the state illustrated in FIG. 18A, and in a state where the suction head has been moved to the feed position after the state illustrated in FIG. 18B, respectively.
Figure 18B:
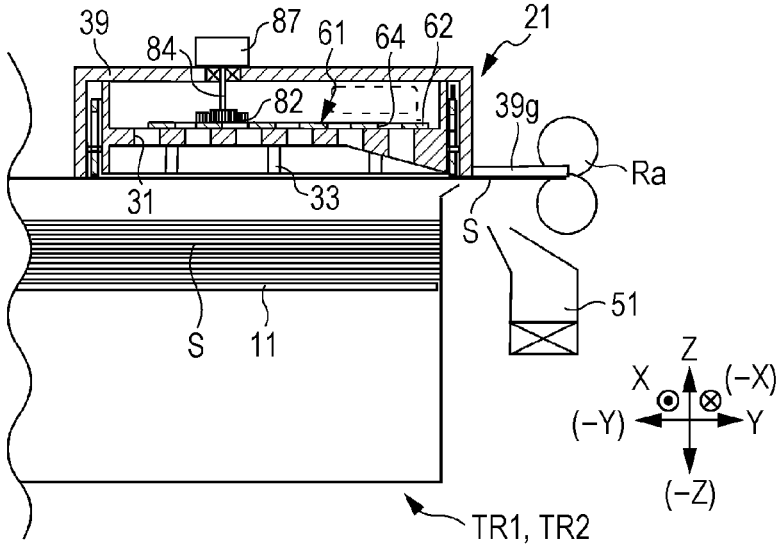
Figure 18C:
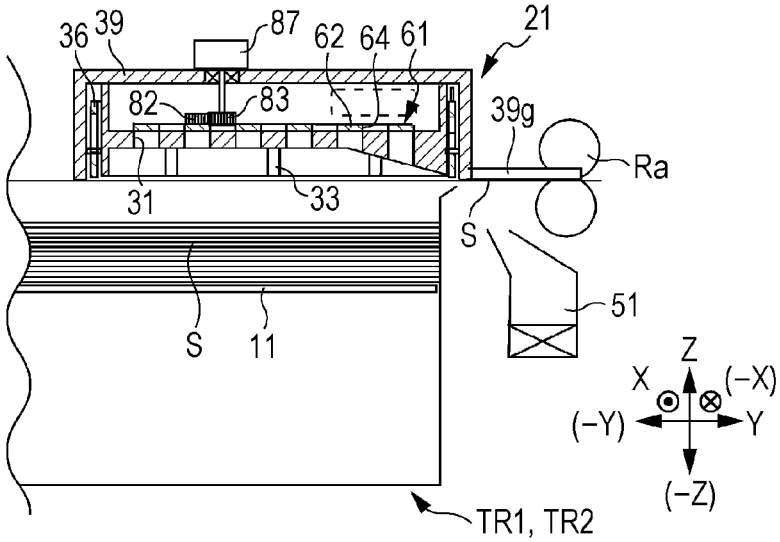

FIGS. 18A to 18C correspond to FIGS. 13A to 13C illustrating the first exemplary embodiment and are sectional views illustrating the suction head 22 according to the second exemplary embodiment. FIG. 18A illustrates a state where the leading end guide 39*g* has reached the transport rollers Ra. FIG. 18B illustrates a state where the sheet S has reached the transport rollers Ra after the state illustrated in FIG. 18A. FIG. 18C illustrates a state where the suction head 22 has been moved to the feed position after the state illustrated in FIG. 18B.

In the image forming apparatus U according to the second exemplary embodiment of the present invention configured as above, when the sheet feeding operation is started while a job is being executed, the motor 50 is rotated in the normal direction and the suction head 22 having the topmost sheet S attracted thereto starts to move from the suction position toward the feed position, as in the first exemplary embodiment.

In the second exemplary embodiment, when the suction head 22 has moved toward the right and the time lag t5 (sec) from the suction timing ta has elapsed, it is determined that the closing timing tb at which closing of the suction port shutter 61 is to be started has arrived. That is, as illustrated in FIG. 18A, the leading end guide 39*g* reaches the transport rollers Ra, and the remaining length of movement of the suction head 22 becomes equal to the length of lateral movement d5 (mm) of the suction port shutter 61. At this point of time, the opening-and-closing motor 87 included in the opening-and-closing mechanism "81 to 87" is rotated in the normal direction, and the suction port shutter 61 starts to move toward the left relative to the suction head 22. As the suction head 22 further advances toward the right as illustrated in FIGS. 18B and 18C, the suction port shutter 61 is further moved toward the left relative to the suction head 22. Thus, the suction port shutter 61 moves from the open position illustrated in FIG. 15A beyond the half shut position illustrated in FIG. 15B to the fully shut position illustrated in FIG. 15C. Accordingly, the area of each suction port 31 that allows air to flow therethrough is reduced, whereby the path of the air flowing from the suction port 31 to the exhaust fan HF is narrowed. Consequently, the suction force is reduced.

To summarize, in the image forming apparatus U according to the second exemplary embodiment, with reference to the timing at which the transport rollers Ra start to transport the sheet S, the shutting portions 62 gradually close the suction ports 31, whereby the suction force is reduced, as in the first exemplary embodiment. Therefore, damage to the sheet S is reduced compared with the case of the related art.

Furthermore, in the image forming apparatus U according to the second exemplary embodiment, the suction force starts to be reduced before the sheet S reaches the transport rollers Ra, and the frictional force produced between the sheet S and the suction head 22 continues to be reduced even immediately after the sheet S starts to be transported by the transport rollers Ra, as in the first exemplary embodiment. Therefore, damage to the sheet S is further reduced compared with the case where the suction force starts to be reduced when the sheet S has reached the transport rollers Ra.

Furthermore, in the image forming apparatus U according to the second exemplary embodiment, the suction port shutter 61 reaches the fully shut position after the sheet S has reached the transport rollers Ra, and the suction force is thus removed, as in the first exemplary embodiment. Therefore, compared with the case of the related art in which the sheet (S) continues to be attracted to the suction head (22) with a constant suction force until the suction head (22) reaches the feed position, damage to the sheet S is reduced and the probability that the sheet S may drop from the suction head 22 before the leading end of the sheet S reaches the transport rollers Ra is reduced.

Third Exemplary Embodiment

In the following description of a third exemplary embodiment of the present invention, elements the same as those in the first exemplary embodiment are denoted by the corresponding reference numerals, and detailed description thereof is omitted.

The third exemplary embodiment differs from the first exemplary embodiment in features described below. The other features of the third exemplary embodiment are the same as those of the first exemplary embodiment.

Figure 19A:
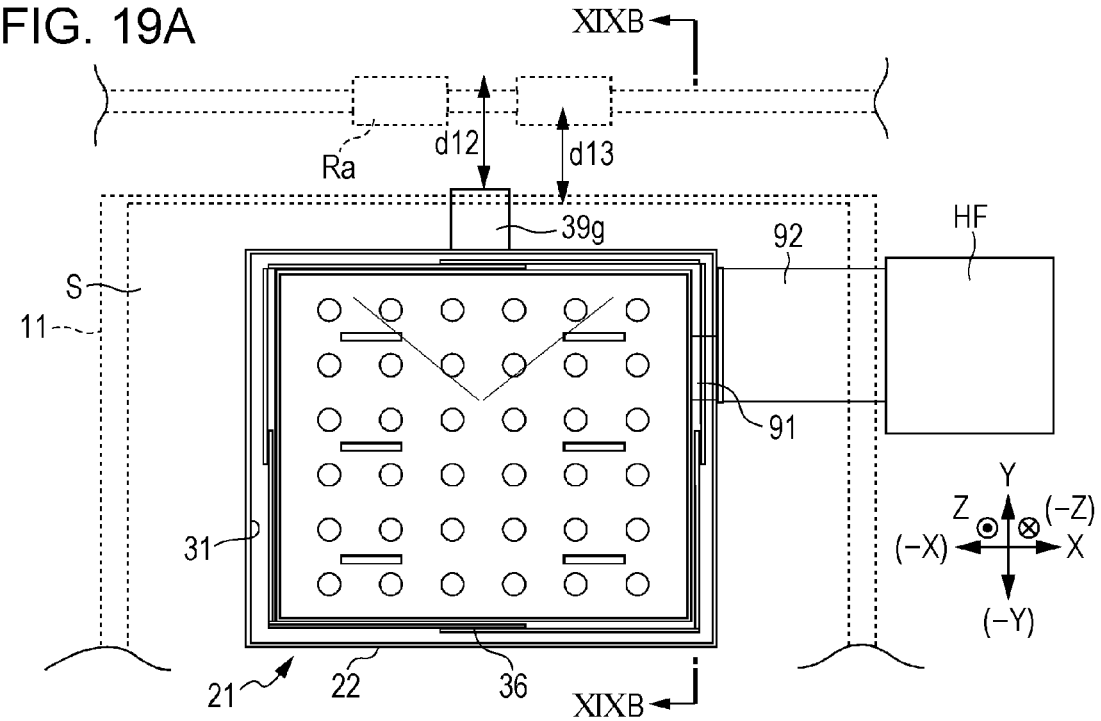
FIGS. 19A to 19C correspond to FIGS. 9A to 9C illustrating the first exemplary embodiment, and illustrate a connection-and-separation mechanism according to a third exemplary embodiment of the present invention as a plan view illustrating an exhaust duct seen from above inside the suction head, as a sectional view taken along line XIXB-XIXB illustrated in FIG. 19A, and as a front view of the connection-and-separation mechanism, respectively.
Figure 19B:
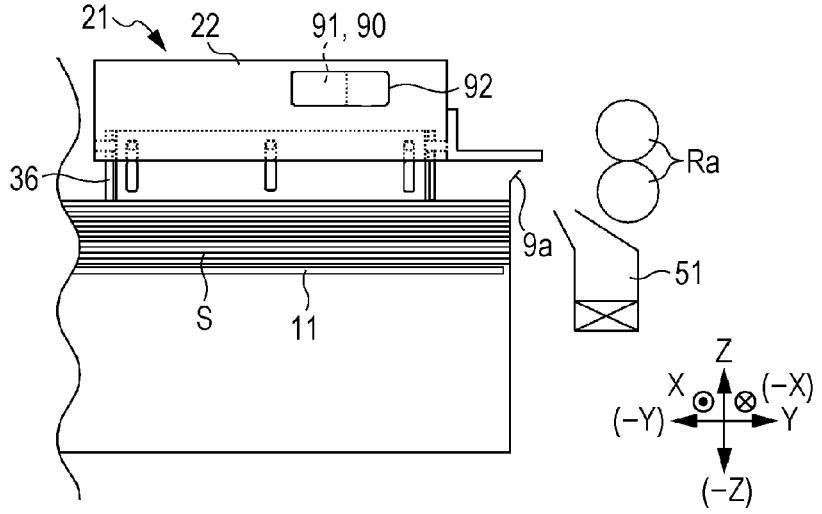
Figure 19C:
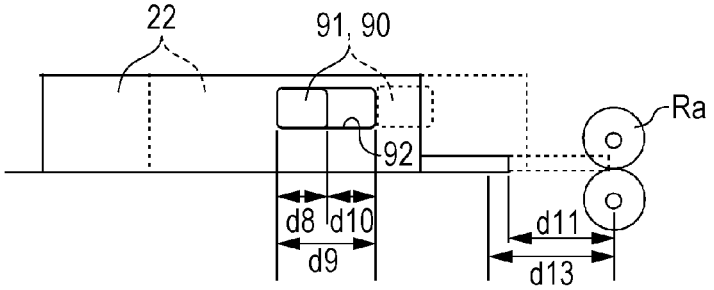

FIGS. 19A to 19C correspond to FIGS. 9A to 9C illustrating the first exemplary embodiment and illustrate a connection-and-separation mechanism "90 to 92" according to the third exemplary embodiment. FIG. 19A is a plan view illustrating an exhaust duct 92 seen from above inside the suction head 22. FIG. 19B is a sectional view taken along line XIXB-XIXB illustrated in FIG. 19A. FIG. 19C is a front view of the connection-and-separation mechanism "90 to 92".

Referring to FIGS. 19A to 19C, the third exemplary embodiment does not employ the exhaust duct 39*f*, the bellows 40, the suction port shutter 61, and the opening-and-closing mechanism "66 to 73" that are employed in the first exemplary embodiment. Instead, in the third exemplary embodiment, an exhaust port 91 as an exemplary gas-passage-allowing opening is provided in right part of the front side plate 39*b*. The exhaust port 91 allows air taken from the suction ports 31 into an internal space 90 defined in the suction head 22 to flow therethrough. Furthermore, the exhaust duct 92 as an exemplary connector portion and having a cylindrical shape is provided in front of the exhaust port 91 in such a manner as to extend in the anteroposterior direction.

In the third exemplary embodiment, when the suction head 22 is at the suction position, the exhaust duct 92 has one end, or the rear end, thereof connected to the exhaust port 91 and the other end, or the front end, thereof connected to the exhaust fan HF. Therefore, when the exhaust fan HF is activated with the suction head 22 residing at the suction position, the gas, or the air, taken from the suction ports 31 into the internal space 90 is exhausted, as in the first exemplary embodiment.

Furthermore, in the third exemplary embodiment, the suction head 22 is movable between the suction position and the feed position as in the first exemplary embodiment. In addition, the exhaust port 91 is slidable in the lateral direction relative to the exhaust duct 92.

In the third exemplary embodiment, referring to FIG. 19C, when the suction head 22 is at the suction position, the left end of the exhaust port 91 resides in front of the left end of the exhaust duct 92 while the right end of the exhaust port 91 resides on the left side with respect to the right end of the exhaust duct 92. That is, a width d8 (mm) of the exhaust port 91 from the left end to the right end thereof is smaller than a width d9 (mm) of the exhaust duct 92 from the left end to the right end thereof. Hence, letting the difference in width between the exhaust port 91 and the exhaust duct 92 be d10 (mm), the following holds: d10=(d9−d8). Accordingly, after the suction head 22 has been moved from the suction position by the difference in width d10, right part of the exhaust port 91 advances beyond the exhaust duct 92 toward the right, whereby the exhaust port 91 is connected to the outside, that is, right part of the exhaust port 91 becomes open to the outside.

Referring to FIGS. 19A to 19C, a lateral distance d11 from the right end of the leading end guide 39*g* to the nip area at the transport rollers Ra is equal to the difference in width d10. A length of movement d12 of the suction head 22 between the suction position and the feed position is equal to the width d9 of the exhaust duct 92. A lateral distance d13 from the leading end of the sheet S attracted to the suction head 22 to the nip area at the transport rollers Ra is greater than the difference in width d10 and less than the width d9 of the exhaust duct 92 and the lateral distance d11. Therefore, after the leading end guide 39*g* has reached the nip area and the length of movement of the suction head 22 toward the feed position has become greater than the difference in width d10, the right part of the exhaust port 91 starts to become open to the outside. Subsequently, the leading end of the sheet S reaches the nip area. When the suction head 22 is further moved toward the right and has reached the feed position, the left end of the exhaust port 91 is positioned in front of the right end of the exhaust duct 92, whereby the entirety of the exhaust port 91 becomes open to the outside.

Figure 20A:
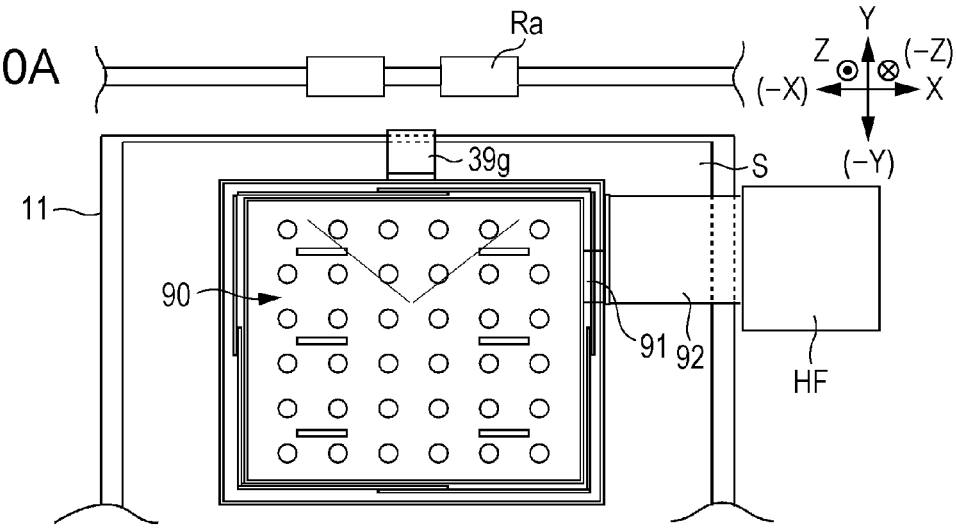
FIGS. 20A to 20C correspond to FIGS. 10A to 10C illustrating the first exemplary embodiment, and illustrate an exhaust port according to the third exemplary embodiment at a fully connected position, at a half connected position, and at a separated position, respectively.
Figure 20B:
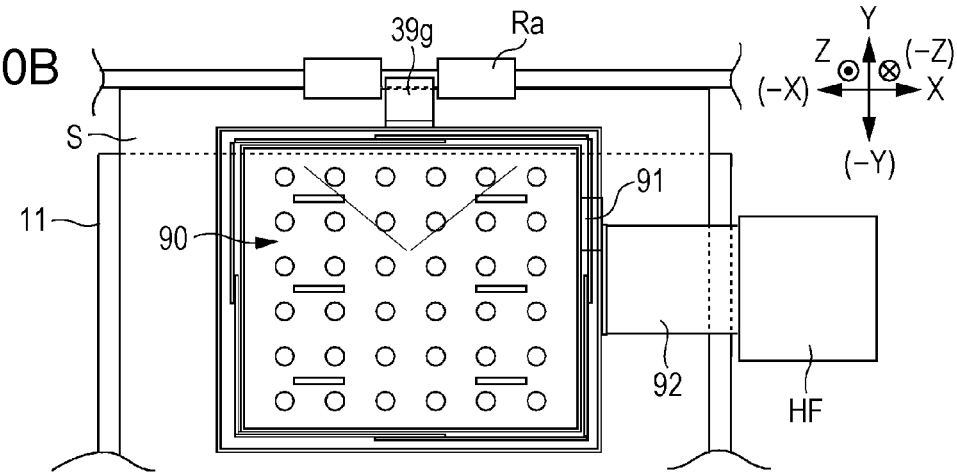
Figure 20C:
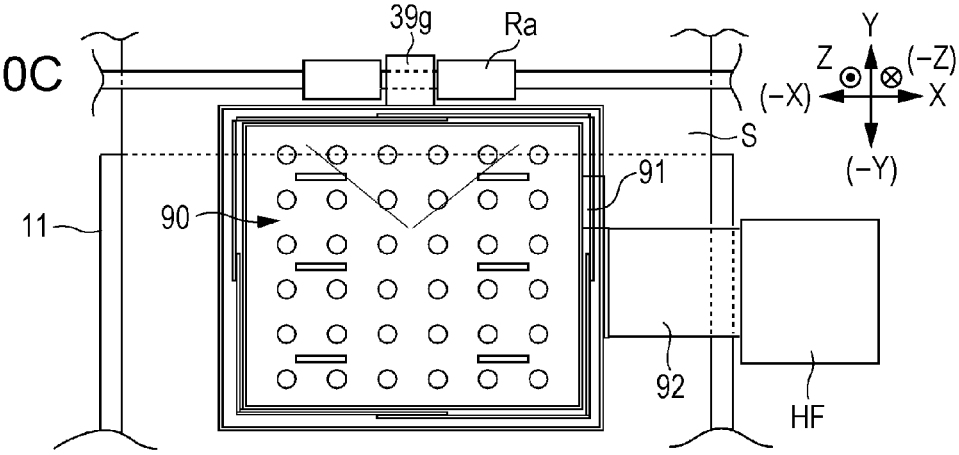

FIGS. 20A to 20C correspond to FIGS. 10A to 10C illustrating the first exemplary embodiment and illustrate the exhaust port 91 according to the third exemplary embodiment. In FIG. 20A, the exhaust port 91, is at a fully connected position. In FIG. 20B, the exhaust port 91 is at a half connected position. In FIG. 200, the exhaust port 91 is at a separated position.

In the third exemplary embodiment, when the suction head 22 is at the suction position, the exhaust port 91 is at the fully connected position as an exemplary entirely open position illustrated in FIG. 20A where the entirety of the exhaust port 91 is connected to the exhaust duct 92. As the suction head 22 is moved toward the right and the exhaust port 91 is thus moved toward the right, the exhaust port 91 goes beyond the half connected position as an exemplary partially open position illustrated in FIG. 20B. When the suction head 22 is further moved toward the right and has reached the feed position, the entirety of the exhaust port 91 is positioned on the right side with respect to the exhaust duct 92, that is, the exhaust port 91 reaches the separated position as an exemplary closed position and an exemplary disconnected position illustrated in FIG. 20C.

The internal space 90, the exhaust port 91, and the exhaust duct 92 together form the connection-and-separation mechanism "90 to 92" according to the third exemplary embodiment. Furthermore, the suction head 22, the head driving device "46 to 50", and the connection-and-separation mechanism "90 to 92" together form a suction-force-changing mechanism "22, 46 to 50, and 90 to 92" according to the third exemplary embodiment.

Figure 21A:
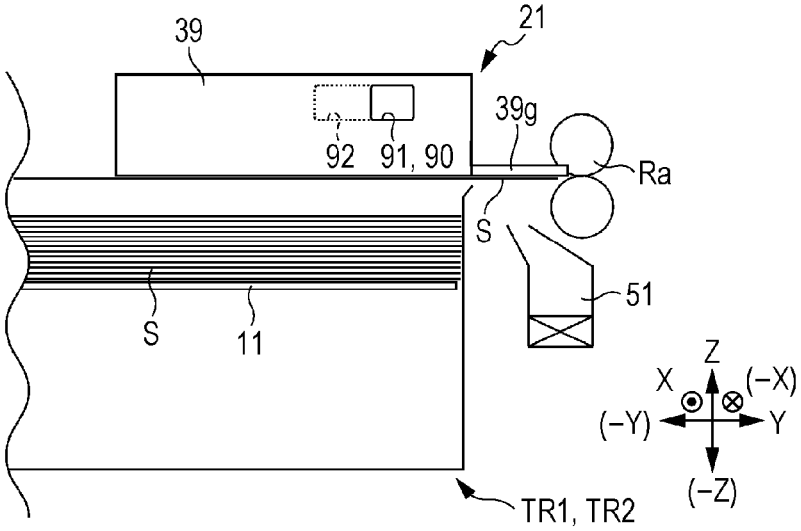
FIGS. 21A to 21C correspond to FIGS. 13A to 13C illustrating the first exemplary embodiment, and are sectional views illustrating the suction head according to the third exemplary embodiment in a state where the leading end guide has reached the transport rollers, in a state where the sheet has reached the transport rollers after the state illustrated in FIG. 21A, and in a state where the suction head has reached the feed position after the state illustrated in FIG. 21B, respectively.
Figure 21B:
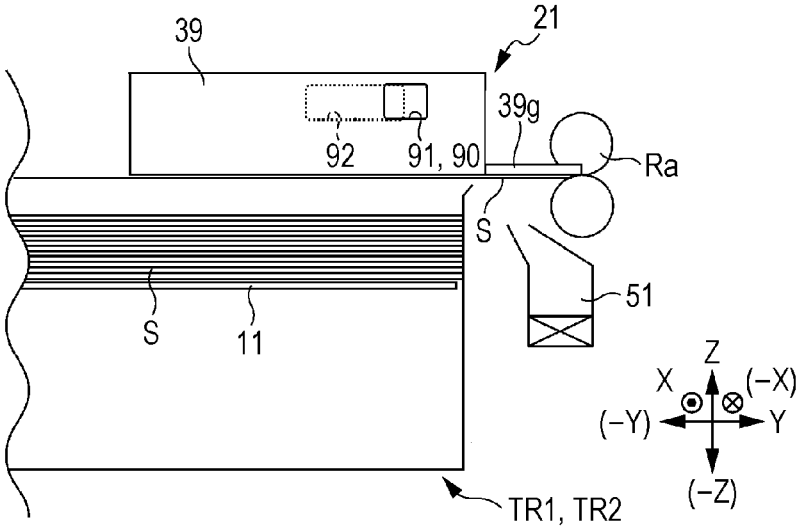
Figure 21C:
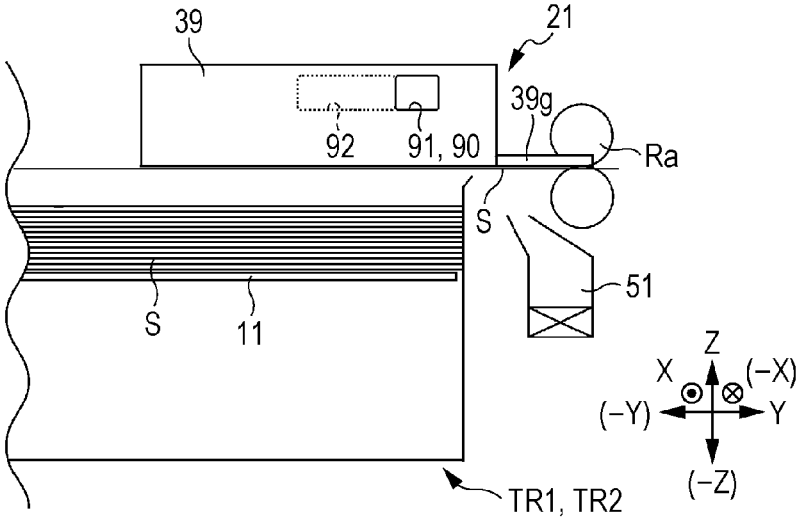

FIGS. 21A to 21C correspond to FIGS. 13A to 13C illustrating the first exemplary embodiment and are sectional views illustrating the suction head 22 according to the third exemplary embodiment. FIG. 21A illustrates a state where the leading end guide 39*g* has reached the transport rollers Ra. FIG. 21B illustrates a state where the sheet S has reached the transport rollers Ra after the state illustrated in FIG. 21A. FIG. 21C illustrates a state where the suction head 22 has reached the feed position after the state illustrated in FIG. 21B.

In the image forming apparatus U according to the third exemplary embodiment of the present invention configured as above, when the sheet feeding operation is started while a job is being executed, the motor 50 included in the head driving device "46 to 50" is rotated in the normal direction and the suction head 22 having the topmost sheet S attracted thereto starts to move from the suction position to the feed position, as in the first exemplary embodiment.

In the third exemplary embodiment, when the suction head 22 is at the suction position, referring to FIGS. 19A to 19C, the left end of the exhaust port 91 is positioned in front of the left end of the exhaust duct 92 while the right end of the exhaust port 91 is positioned on the left side with respect to the right end of the exhaust duct 92 by the difference in width d10. Therefore, the entirety of the exhaust port 91 is connected to the exhaust duct 92, allowing the suction head 22 to attract the sheet S.

When the suction head 22 starts to be moved from the suction position toward the feed position and has been moved toward the right by the difference in width d10 from the suction position, referring now to FIG. 21A, the leading end guide 39*g* reaches the transport rollers Ra. Simultaneously, the right end of the exhaust port 91 reaches the right end of the exhaust duct 92. When the suction head 22 is further moved toward the feed position, the exhaust port 91 goes beyond the exhaust duct 92 toward the right side, whereby the connection between the exhaust port 91 and the exhaust duct 92 starts to be displaced.

Thus, referring to FIGS. 21B and 21C also, along with the movement of the suction head 22 toward the right, the exhaust port 91 is moved from the fully connected position illustrated in FIG. 19A beyond the half connected position illustrated in FIG. 19B to the separated position illustrated in FIG. 19C. As the suction head 22 advances toward the feed position, the area of the exhaust port 91 that is connected to the exhaust duct 92 becomes smaller while the area of the exhaust port 91 that is connected to the outside becomes larger. That is, as the area of the exhaust duct 92 that allows air to flow therethrough becomes smaller, the area of the exhaust port 91 that is connected to the outside becomes larger, whereby the suction force is reduced.

To summarize, in the third exemplary embodiment, as illustrated in FIG. 21B, before the sheet S reaches the transport rollers Ra, the area of the exhaust duct 92 that is connected to the exhaust port 91 starts to decrease and right part of the exhaust port 91 starts to be open to the outside. That is, when the sheet S reaches the transport rollers Ra, the suction force has already started to decrease.

Thus, in the image forming apparatus U according to the third exemplary embodiment, with reference to the timing at which the transport rollers Ra start to transport the sheet S, the suction force is gradually reduced, as in the first exemplary embodiment. Therefore, damage to the sheet S is reduced compared with the case of the related art. Particularly, in the image forming apparatus U according to the third exemplary embodiment, the suction force starts to be reduced before the sheet S reaches the transport rollers Ra and the frictional force produced between the sheet S and the suction head 22 continues to be reduced even immediately after the sheet S starts to be transported by the transport rollers Ra, as in the first exemplary embodiment. Therefore, damage to the sheet S is further reduced compared with the case where the suction force starts to be reduced when the sheet (S) has reached the transport rollers (Ra).

Furthermore, as illustrated in FIG. 21C, after the sheet S has reached the transport rollers Ra, the exhaust port 91 is moved to the separated position and the exhaust port 91 is disconnected from the exhaust duct 92, whereby the suction force is removed. At this time, the suction head 22 reaches the feed position, and the exhaust fan HF is stopped. Thus, in the third exemplary embodiment, before the sheet S reaches the transport rollers Ra, the sheet S is kept attracted to the suction head 22 and the sealing skirt 36 is kept lifted, as in the first exemplary embodiment. Moreover, the suction force is further reduced after the sheet S has reached the transport rollers Ra, and the frictional force produced between the suction head 22 and the sheet S that is being transported toward the downstream side in the transport direction is further reduced. Therefore, in the image forming apparatus U according to the third exemplary embodiment, damage to the sheet S is reduced and the probability that the sheet S may drop from the suction head 22 before the leading end of the sheet S reaches the transport rollers Ra is reduced as in the first exemplary embodiment, compared with the case of the related art in which the sheet (S) continues to be attracted to the suction head (22) with a constant suction force until the suction head (22) reaches the feed position.

Fourth Exemplary Embodiment

In the following description of a fourth exemplary embodiment of the present invention, elements the same as those in the first and second exemplary embodiments are denoted by the corresponding reference numerals, and detailed description thereof is omitted.

The fourth exemplary embodiment differs from the first and second exemplary embodiments in features described below. The other features of the fourth exemplary embodiment are the same as those of the first and second exemplary embodiments.

Figure 22A:
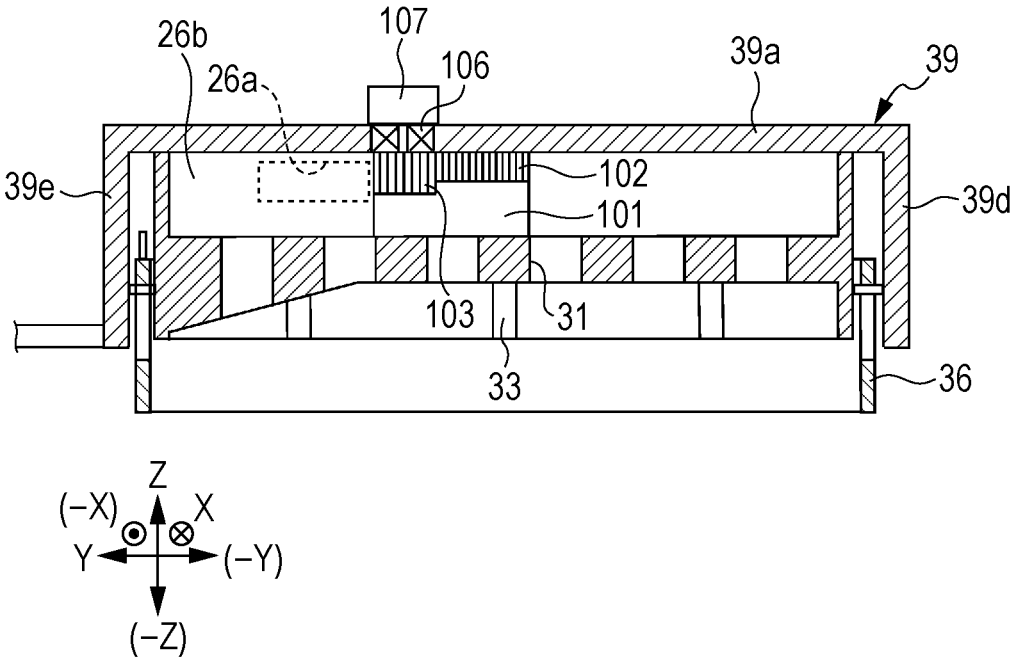
FIGS. 22A and 22B correspond to FIGS. 14B and 14C illustrating the second exemplary embodiment, and illustrate an opening-and-closing mechanism according to a fourth exemplary embodiment of the present invention as a view seen from the rear inside the suction head and as a perspective view illustrating a rack and a pinion, respectively.
Figure 22B:
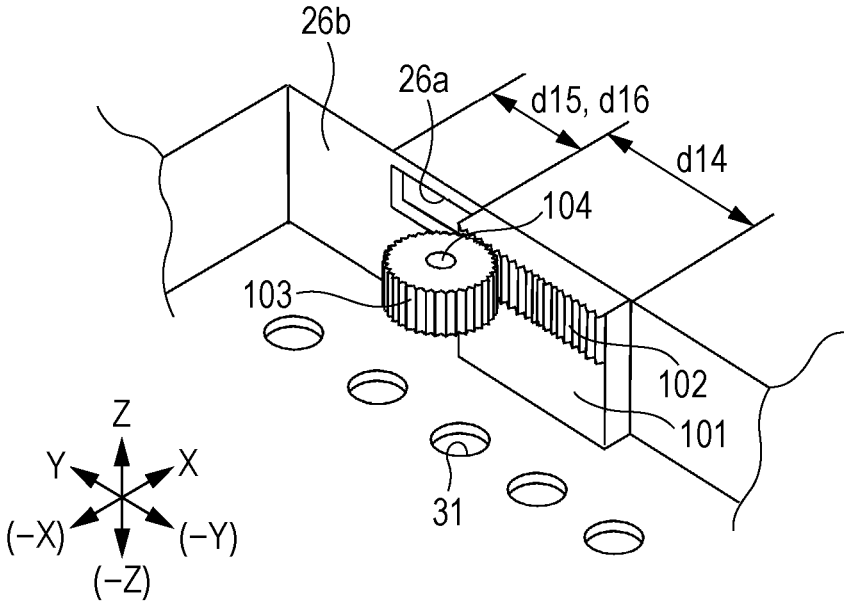

FIGS. 22A and 22B correspond to FIGS. 14B and 14C illustrating the second exemplary embodiment and illustrate an opening-and-closing mechanism "102 to 107" according to the fourth exemplary embodiment. FIG. 22A is a view seen from the rear inside the suction head 22. FIG. 22B is a perspective view of a rack 102 and a pinion 103.

Referring to FIGS. 22A and 22B, the fourth exemplary embodiment does not employ the suction port shutter 61 and the opening-and-closing mechanism "66 to 73"/"81 to 87" that are employed in the first and second exemplary embodiments. Instead, a flat plate-shaped exhaust port shutter 101 as an exemplary closing member is supported at the front end of the upper surface 24*b* of the bottom plate 24.

The exhaust port shutter 101 according to the fourth exemplary embodiment has the front surface thereof being in contact with a rear surface 26*b* of the front sidewall 26 and the upper and lower ends thereof being in contact with the top plate 39*a* and the bottom plate 24, respectively, of the head body 23. Thus, the exhaust port shutter 101 is supported in such a manner as to be in contact with the rear surface 26*b* and to be movable in the lateral direction with the upper and lower ends thereof being guided by the respective plates 39*a* and 24.

Referring to FIGS. 22A and 22B, the exhaust port shutter 101 includes the rack 102. The rack 102 is an exemplary flat-plate gear and is provided on upper part of the rear surface of the exhaust port shutter 101 in such a manner as to extend in the lateral direction.

The pinion 103 is an exemplary disc-shaped gear and is provided in front of the rack 102 and in mesh with the rack 102. The pinion 103 according to the fourth exemplary embodiment is provided at a position not overlapping the suction ports 31, as in the second exemplary embodiment, and is supported by a motor shaft 104 as an exemplary driving shaft extending vertically. The motor shaft 104 according to the fourth exemplary embodiment is supported in such a manner as to be rotatable with the aid of a bearing 106 supported by the top plate 39*a*. The motor shaft 104 is connected to an opening-and-closing motor 107 as an exemplary opening-and-closing driving source with a transmission mechanism (not illustrated) interposed therebetween, whereby the driving force of the opening-and-closing motor 107 is transmitted to the motor shaft 104.

Thus, in the fourth exemplary embodiment, when the pinion 103 is driven to rotate with the normal or reverse rotation of the opening-and-closing motor 107, the exhaust port shutter 101 is moved in the lateral direction.

Figure 23A:
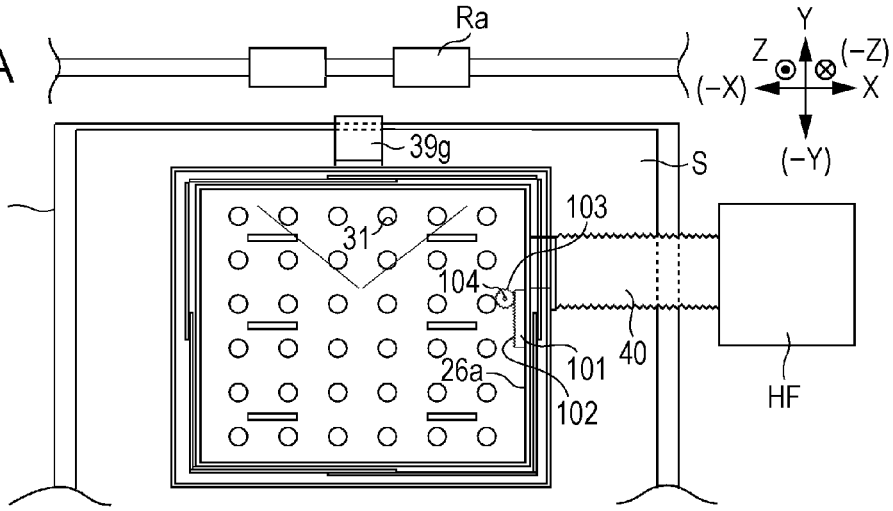
FIGS. 23A to 23C correspond to FIGS. 15A to 15C illustrating the second exemplary embodiment, and illustrate an exhaust port shutter according to the fourth exemplary embodiment at an open position, at a half shut position, and at a fully shut position, respectively.
Figure 23B:
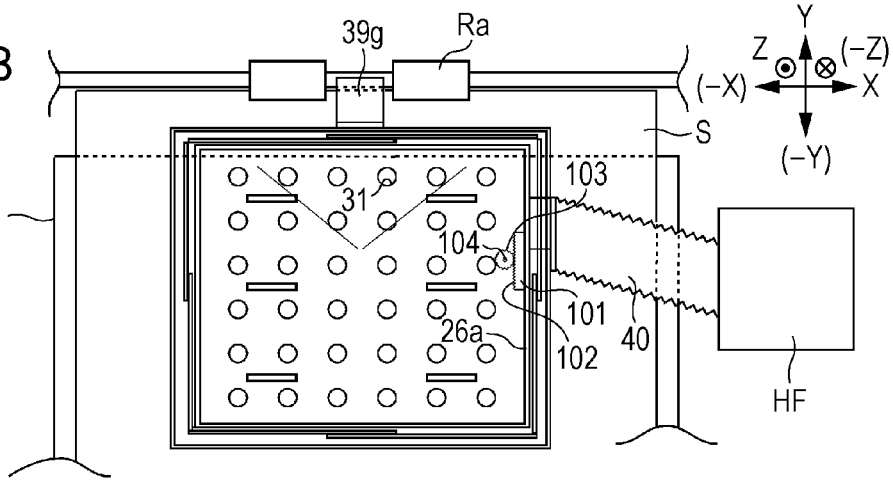
Figure 23C:
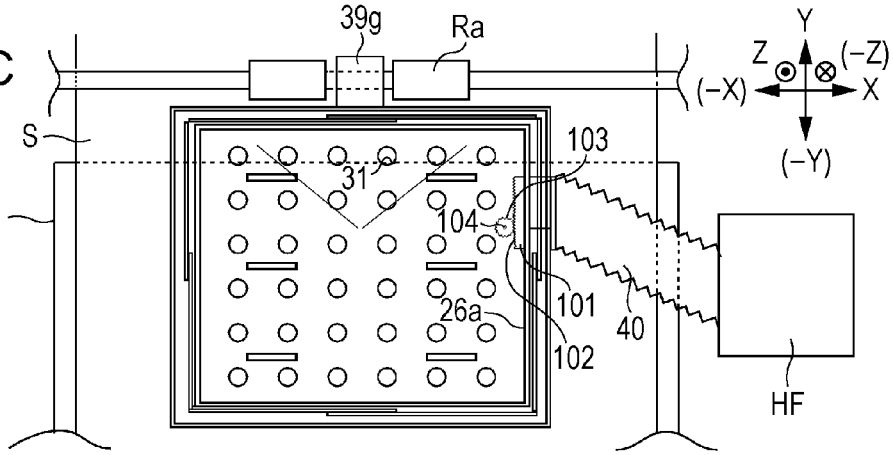

FIGS. 23A to 23C correspond to FIGS. 15A to 15C illustrating the second exemplary embodiment and illustrate the exhaust port shutter 101 according to the fourth exemplary embodiment. In FIG. 23A, the exhaust port shutter 101 is at an open position. In FIG. 23B, the exhaust port shutter 101 is at a half shut position. In FIG. 23C, the exhaust port shutter 101 is at a fully shut position.

In the fourth exemplary embodiment, a width d14 of the rack 102 is greater than a lateral width d15 of the exhaust port 26*a* and a length of lateral movement d16 of the exhaust port shutter 101. In the fourth exemplary embodiment, the length of lateral movement d16 is equal to the lateral width d15.

Hence, in the fourth exemplary embodiment, the exhaust port shutter 101 is movable among the following positions: the open position illustrated in FIG. 23A where the right end of the exhaust port shutter 101 is positioned in front of the left end of the exhaust port 26*a* and the exhaust port 26*a* is thus open, the half shut position as an exemplary partially closed position illustrated in FIG. 23B where right part of the exhaust port shutter 101 closes left part of the exhaust port 26*a*, and the fully shut position as an exemplary entirely closed position illustrated in FIG. 23C where the exhaust port shutter 101 closes the entirety of the exhaust port 26*a*.

The elements denoted by reference numerals 102 to 107 together form the opening-and-closing mechanism "102 to 107" according to the fourth exemplary embodiment. Furthermore, the exhaust port shutter 101, the opening-and-closing mechanism "102 to 107", and the controller C together form a suction-force-changing mechanism "101 to 107 and C" according to the fourth exemplary embodiment.

Figure 24:
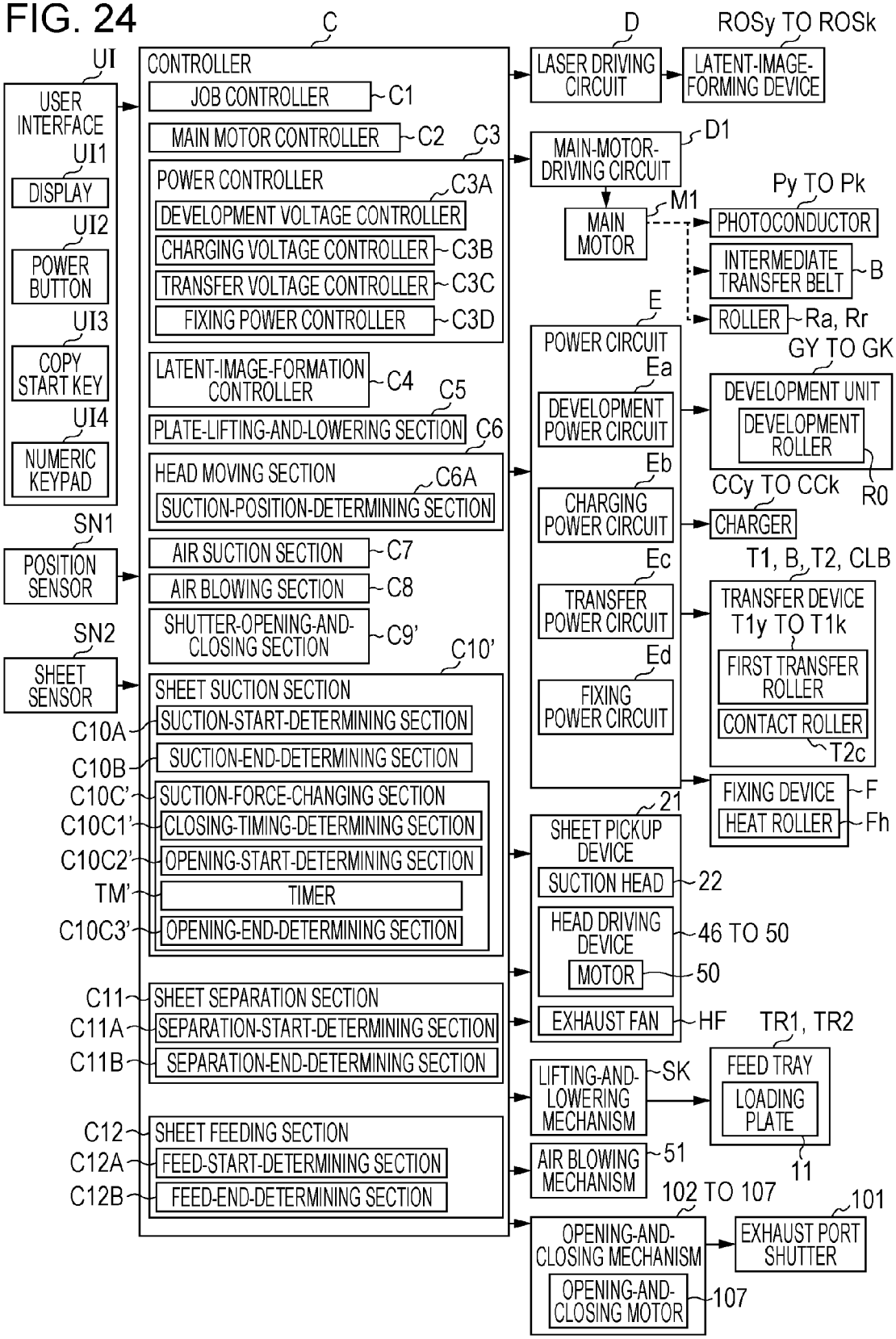
FIG. 24 corresponds to FIG. 16 illustrating the second exemplary embodiment and is a block diagram illustrating controller of the image forming apparatus according to the fourth exemplary embodiment.

FIG. 24 corresponds to FIG. 16 illustrating the second exemplary embodiment and is a block diagram illustrating the controller C of the image forming apparatus U according to the fourth exemplary embodiment.

Referring to FIG. 24, the controller C according to the fourth exemplary embodiment receives signals that are output from the signal outputting elements U1, SN2, and so forth, and also outputs signals for controlling operations of the controlled elements D, D1, E, and so forth, as in the second exemplary embodiment. The controller C includes a shutter-opening-and-closing section C9' and a sheet suction section C10', instead of the shutter-opening-and-closing section C9 and the sheet suction section C10 of the second exemplary embodiment.

The shutter-opening-and-closing section C9' as an exemplary controller for the opening-and-closing mechanism controls the normal and reverse rotations of the opening-and-closing motor 107 included in the opening-and-closing mechanism "102 to 107" and thus controls the movement of the exhaust port shutter 101 among the open position illustrated in FIG. 23A, the half shut position illustrated in FIG. 23B, and the fully shut position illustrated in FIG. 23C.

The sheet suction section C10' is an exemplary suction controller and an exemplary medium suction section. The sheet suction section C10' includes the suction-start-determining section C10A and the suction-end-determining section C10B that are employed in the second exemplary embodiment and a suction-force-changing section C10C' that is different from that of the second exemplary embodiment. The sheet suction section C10' causes, through the air suction section C7, the suction head 22 to attract a sheet S.

The suction-force-changing section C10C' includes a closing-timing-determining section C10C1', an opening-start-determining section C10C2', a timer TM', and an opening-end-determining section C10C3'. The suction-force-changing section C10C' causes, through the shutter-opening-and-closing section C9', the exhaust port shutter 101 to be opened or closed and thus changes the suction force. The suction-force-changing section C10C' according to the fourth exemplary embodiment moves the exhaust port shutter 101 from the open position to the fully shut position after a sheet S is attracted to the suction head 22. Thus, the suction-force-changing section C10C' reduces the area of the exhaust port 26*a* that allows air to flow therethrough, whereby the suction force for attracting the sheet S is reduced.

The closing-timing-determining section C10C1' determines whether or not a closing timing tb' at which closing of the exhaust port shutter 101 is to be started has arrived. In the fourth exemplary embodiment, letting the velocity at which the exhaust port shutter 101 is moved in the lateral direction by the opening-and-closing motor 107 be V' (mm/s) and the time period taken to move the exhaust port shutter 101 by the length of lateral movement d16 (mm) illustrated in FIG. 22B be shutter moving time t6, the following holds: t6=(d16/V') (sec). Therefore, in the fourth exemplary embodiment, the closing timing tb' is set so that the exhaust port shutter 101 reaches the fully shut position when the suction head 22 reaches the feed position at the time when the feed time t1 from the suction timing ta has elapsed. There is a time lag t7 (sec) from the start of the feed time t1 to the start of the shutter moving time t6. Considering the time lag t7, the closing timing tb' is set to a point of time when the time lag t7 from the suction timing ta has elapsed. In the fourth exemplary embodiment, the shutter moving time t6 is set to a time period taken to move the suction head 22 by the remaining length of lateral movement d5 at the velocity V (d5/V). The closing timing tb' according to the fourth exemplary embodiment is set so as to be the same as the closing timing tb according to the second exemplary embodiment. Hence, the closing-timing-determining section C10C1' according to the fourth exemplary embodiment determines that the closing timing tb' has arrived when the leading end guide 39*g* has reached the transport rollers Ra and the remaining length of lateral movement of the suction head 22 has become d5 (mm), as in the second exemplary embodiment.

The opening-start-determining section C10C2' determines whether or not the suction-end-determining section C10B has determined to stop the suction of air at the time when the feed time t1 from the suction timing to has elapsed, and thus determines whether or not to end the closing of the exhaust port shutter 101 and to start opening the exhaust port shutter 101.

The timer TM' as an exemplary movement-time-counting section counts the shutter moving time t6 from the start of the opening of the exhaust port shutter 101.

The opening-end-determining section C10C3' determines whether or not the timer TM' has counted the shutter moving time t6 and thus determines whether or not to end the opening of the exhaust port shutter 101.

Thus, in the fourth exemplary embodiment, after a sheet S has been attracted to the suction head 22 at the start of the sheet feeding operation and the suction head 22 has started to move toward the feed position, the sheet suction section C10' causes the suction-force-changing section C10C' to close the exhaust port shutter 101 and thus reduces the suction force. Specifically, if the closing-timing-determining section C10C1' has determined that the closing timing tb' has arrived after the suction head 22 has started to move, the opening-and-closing motor 107 is rotated in the normal direction and the exhaust port shutter 101 is moved from the open position beyond the half shut position to the fully shut position, whereby the suction force is reduced. Furthermore, if the opening-start-determining section C10C2' has determined that the suction of air has been stopped and the time to start opening of the exhaust port shutter 101 has arrived, the sheet suction section C10' causes the opening-and-closing motor 107 to rotate in the reverse direction until the opening-end-determining section C10C3' determines that the timer TM' has counted the shutter moving time t6, whereby the exhaust port shutter 101 returns from the fully shut position to the open position.

Figure 25:
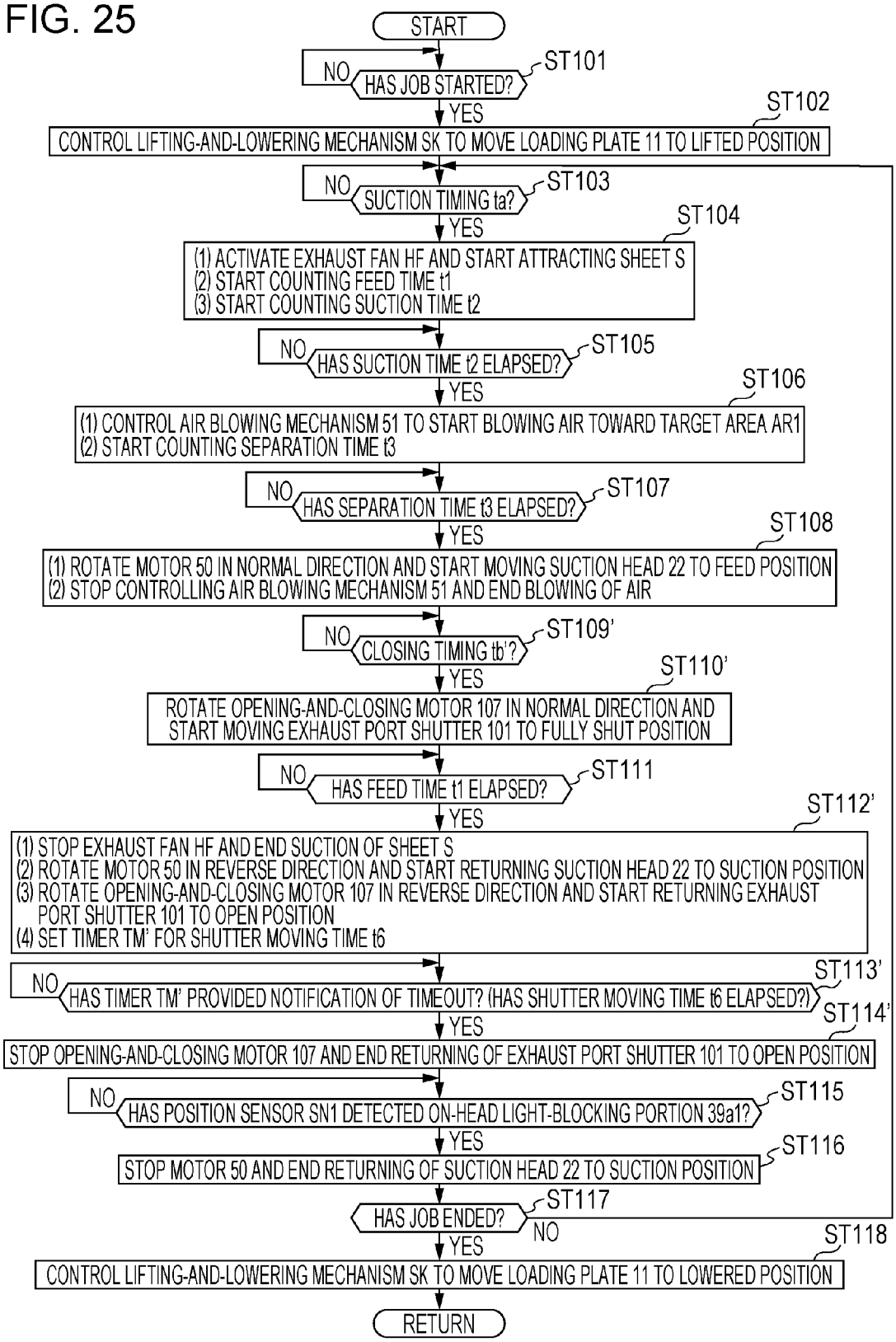
FIG. 25 corresponds to FIG. 17 illustrating the second exemplary embodiment and is a flowchart of a sheet feeding operation according to the fourth exemplary embodiment.

FIG. 25 corresponds to FIG. 17 illustrating the second exemplary embodiment and is a flowchart of a sheet feeding operation according to the fourth exemplary embodiment.

Referring to FIG. 25, the sheet feeding operation according to the fourth exemplary embodiment includes steps. ST109', ST110', and ST112' to ST114' described below, instead of steps ST109, ST110, and ST112 to ST114 included in the sheet feeding operation according to the second exemplary embodiment. Other steps ST101 to ST108 and ST115 to ST118 are the same as those of the second exemplary embodiment, and detailed description thereof is omitted.

After steps ST101 to ST108 illustrated in FIG. 25 are performed, the operation proceeds to step ST109'.

In step ST109', whether or not the closing timing tb' at which closing of the exhaust port shutter 101 is to be started has arrived is determined. If yes, the operation proceeds to step ST110'. If no, step ST109' is repeated.

In step ST110', the opening-and-closing motor 107 is rotated in the normal direction and the exhaust port shutter 101 starts to be moved from the open position toward the fully shut position. Then, the operation proceeds to step ST111.

In step ST111, whether or not the feed time t1 has elapsed is determined, whereby whether or not to end the moving of the suction head 22 to the feed position and to start returning the suction head 22 to the suction position is determined. If yes, the operation proceeds to step ST112'. If no, step ST111 is repeated.

In step ST112', the following sub-steps are performed:

(1) stop the exhaust fan HF and end the suction of the sheet S;

(2) rotate the motor 50 in the reverse direction and start returning the suction head 22 from the feed position to the suction position;

(3) rotate the opening-and-closing motor 107 in the reverse direction and start returning the exhaust port shutter 101 from the fully shut position to the open position; and (4) set the timer TM' for the shutter moving time t6.

Then, the operation proceeds to step ST113'.

In step ST113', whether or not the timer TM' has provided a notification of a timeout indicating that the shutter moving time t6 has elapsed is determined. If yes, the operation proceeds to step ST114'. If no, step ST113' is repeated.

In step ST114', the opening-and-closing motor 107 is stopped and the returning of the exhaust port shutter 101 to the open position ends. Then, the operation proceeds to step ST115.

After steps ST115 to ST118 are performed, the operation returns to step ST101.

Figure 26A:
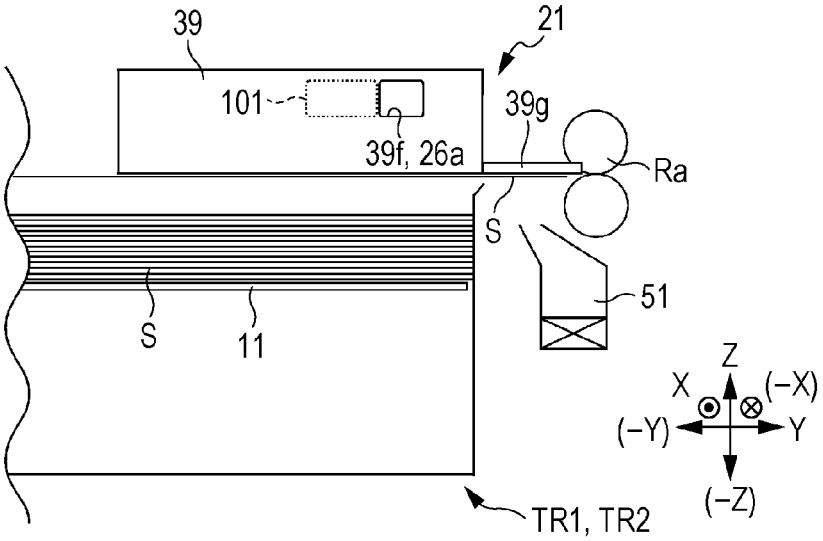
FIGS. 26A to 26C correspond to FIGS. 13A to 13C illustrating the first exemplary embodiment, and are sectional views illustrating the suction head according to the fourth exemplary embodiment in a state where the leading end guide has reached the transport rollers, in a state where the sheet has reached the transport rollers after the state illustrated in FIG. 26A, and in a state where the suction head has been moved to the feed position after the state illustrated in FIG. 26B, respectively.
Figure 26B:
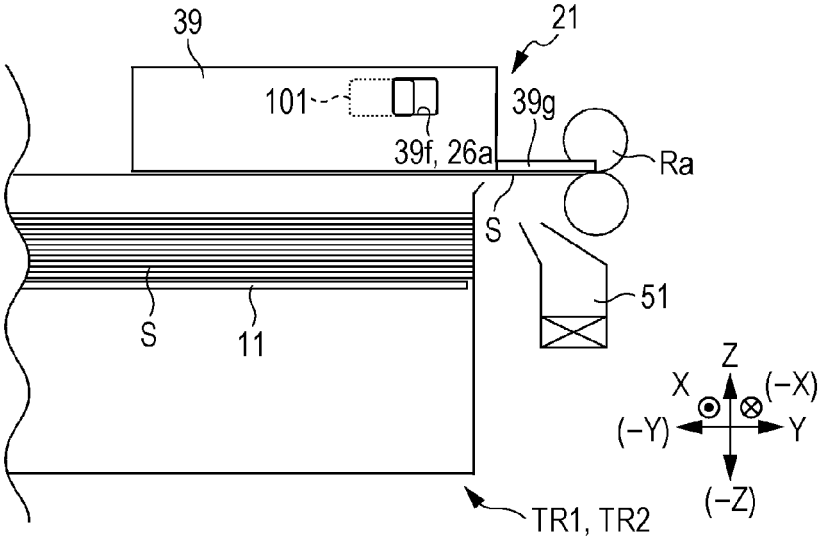
Figure 26C:
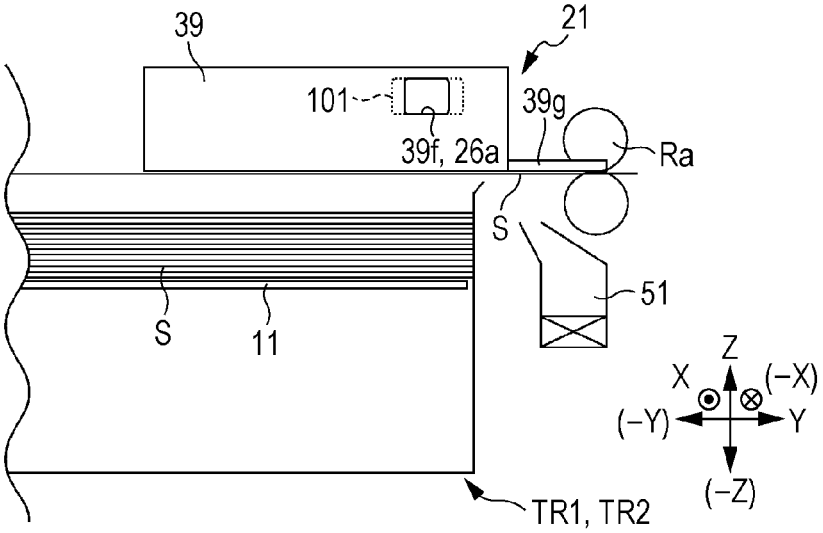

FIGS. 26A to 26C correspond to FIGS. 13A to 13C illustrating the first exemplary embodiment and are sectional views illustrating the suction head 22 according to the fourth exemplary embodiment. FIG. 26A illustrates a state where the leading end guide 39*g* has reached the transport rollers Ra. FIG. 26B illustrates a state where the sheet S has reached the transport rollers Ra after the state illustrated in FIG. 26A. FIG. 26C illustrates a state where the suction head 22 has been moved to the feed position after the state illustrated in FIG. 26B.

In the image forming apparatus U according to the fourth exemplary embodiment of the present invention configured as above, when the sheet feeding operation is started while a job is being executed, the motor 50 is rotated in the normal direction and the suction head 22 having the topmost sheet S attracted thereto is moved from the suction position to the feed position, as in the first and second exemplary embodiments.

In the fourth exemplary embodiment, when the suction head 22 has moved toward the right and it has been determined that the closing timing tb' has arrived, the leading end guide 39*g* reaches the transport rollers Ra as illustrated in FIG. 26A. At this point of time, as in the first and second exemplary embodiments, the opening-and-closing motor 107 is rotated in the normal direction and the exhaust port shutter 101 starts to be moved toward the right relative to the suction head 22. As the suction head 22 further advances toward the right, the exhaust port shutter 101 further moves toward the right relative to the suction head 22. Then, as illustrated in FIG. 26B, the exhaust port shutter 101 reaches the half shut position before the sheet S reaches the transport rollers Ra, and the area of the exhaust port 26*a* that allows air to flow therethrough is reduced. Consequently, the suction force is reduced.

To summarize, in the image forming apparatus U according to the fourth exemplary embodiment, with reference to the timing at which the transport rollers Ra start to transport the sheet S, the exhaust port shutter 101 gradually closes the exhaust port 26*a*, whereby the path of air flowing from the suction ports 31 to the exhaust fan HF is narrowed as in the first and second exemplary embodiments. Accordingly, the suction force is reduced. Therefore, damage to the sheet S is reduced compared with the case of the related art.

Moreover, as illustrated in FIGS. 26A to 26C, in the image forming apparatus U according to the fourth exemplary embodiment, the suction force starts to be reduced before the sheet S reaches the transport rollers Ra and, after the sheet S has reached the transport rollers Ra, the exhaust port shutter 101 reaches the fully shut position, whereby the suction force is removed. Therefore, while damage to the sheet S is reduced, the probability that the sheet S may drop from the suction head 22 before the leading end of the sheet S reaches the transport rollers Ra is reduced.

Fifth Exemplary Embodiment

In the following description of a fifth exemplary embodiment of the present invention, elements the same as those in the fourth exemplary embodiment are denoted by the corresponding reference numerals, and detailed description thereof is omitted.

The fifth exemplary embodiment differs from the fourth exemplary embodiment in features described below. The other features of the fifth exemplary embodiment are the same as those of the fourth exemplary embodiment.

Figure 27A:
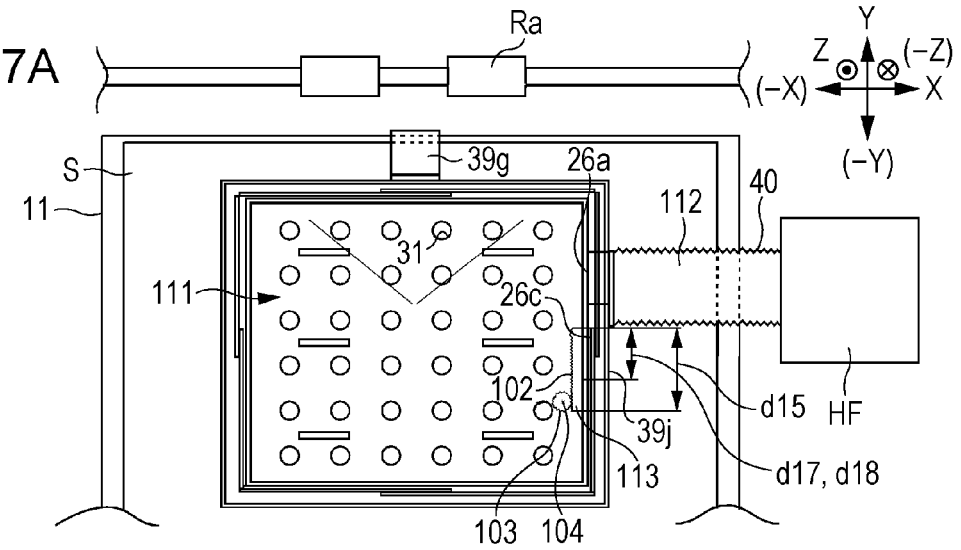
FIGS. 27A to 27C correspond to FIGS. 23A to 23C illustrating the fourth exemplary embodiment, and illustrate an opening shutter according to a fifth exemplary embodiment of the present invention at a shut position, at a half open position, and at a fully open position, respectively.
Figure 27B:
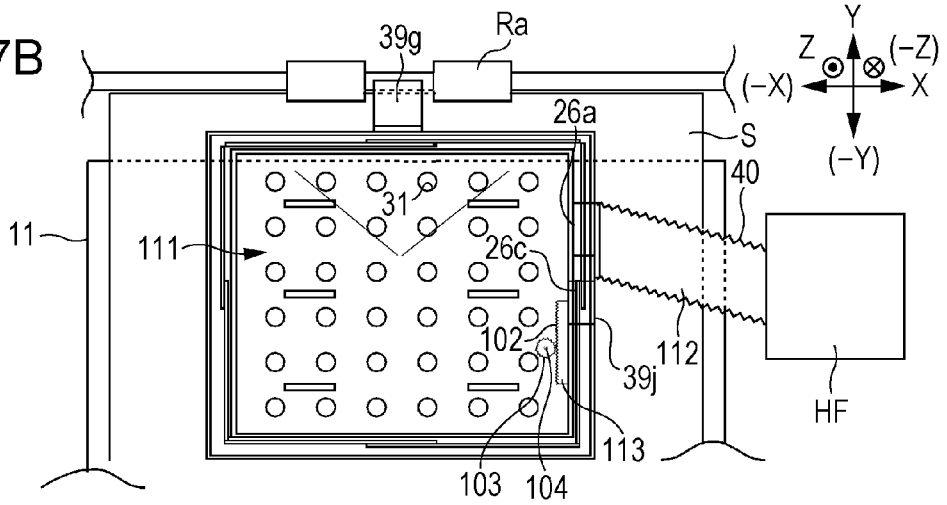
Figure 27C:
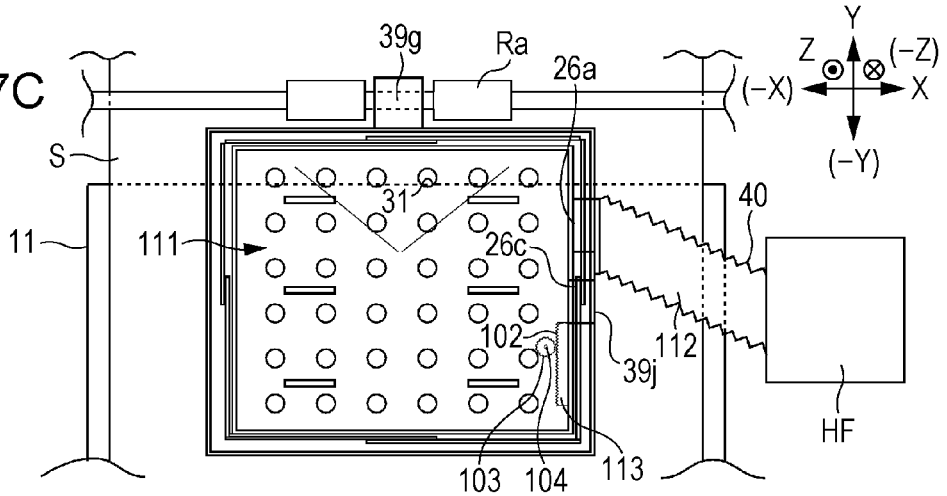

FIGS. 27A to 27C correspond to FIGS. 23A to 23C illustrating the fourth exemplary embodiment and illustrate an opening shutter 113 according to the fifth exemplary embodiment. In FIG. 27A, the opening shutter 113 is at a shut position. In FIG. 27B, the opening shutter 113 is at a half open position. In FIG. 27C, the opening shutter 113 is at a fully open position.

Referring to FIGS. 27A to 27C, in the fifth exemplary embodiment, the front sidewall 26 of the head body 23 has an inner opening 26*c* provided on the left side with respect to the exhaust port 26*a*. Furthermore, the front side plate 39*b* of the covering 39 has an outer opening 39*j* provided on the left side with respect to the exhaust duct 39*f*. The outer opening 39*j* is connected to the inner opening 26*c*.

In the fifth exemplary embodiment, an internal space 111 of the suction head 22 enclosed by the head body 23 and the covering 39 and an internal space 112 of the bellows 40 together form a flow path "111 and 112" extending from the suction ports 31 to the exhaust fan HF and through which air flows. The flow path "111 and 112" is connectable to the outside through the openings 26*c* and 39*j*.

The inner opening 26*c* and the outer opening 39*j* together form an outside connection port "26*c* and 39*j*" according to the fifth exemplary embodiment.

Instead of the exhaust port shutter 101 employed in the fourth exemplary embodiment, the fifth exemplary embodiment employs the opening shutter 113. The opening shutter 113 is an exemplary outside opening member and is also an exemplary closing member. The opening shutter 113 is flat plate-shaped and closes the inner opening 26*c*.

As with the exhaust port shutter 101 according to the fourth exemplary embodiment, the opening shutter 113 according to the fifth exemplary embodiment has the front surface thereof being in contact with the rear surface 26*b* of the front sidewall 26 and the upper and lower ends thereof being supported by the top plate 39*a* and the bottom plate 24, respectively, thereby being movable in the lateral direction along the top plate 39*a* and the bottom plate 24.

Thus, in the fifth exemplary embodiment, the opening shutter 113 is movable among the following positions: the shut position illustrated in FIG. 27A where the right end of the opening shutter 113 is positioned in front of the right end of the inner opening 26*c* and the inner opening 26*c* is thus closed, the half open position as an exemplary partially open position illustrated in FIG. 27B where the opening shutter 113 is positioned on the left side with respect to the shut position and right part of the inner opening 26*c* is thus open to the outside, and the fully open position as an exemplary entirely open position illustrated in FIG. 27C where the opening shutter 113 is positioned on the left side with respect to the half open position and the entirety of the inner opening 26*c* is thus open to the outside.

Referring to FIGS. 27A to 27C, the fifth exemplary embodiment employs, as an exemplary outside connection member, the opening-and-closing mechanism "102 to 107" that is employed in the fourth exemplary embodiment.

In the fifth exemplary embodiment, the lateral width d15 of the rack 102 is longer than a lateral width d17 of the inner opening 26*c* and a length of lateral movement d18 of the opening shutter 113. In the fifth exemplary embodiment, the length of lateral movement d18 is equal to the lateral width d17.

The opening shutter 113, the opening-and-closing mechanism "102 to 107", and the controller C together form a suction-force-changing mechanism "113, 102 to 107, and C" according to the fifth exemplary embodiment.

Figure 28:
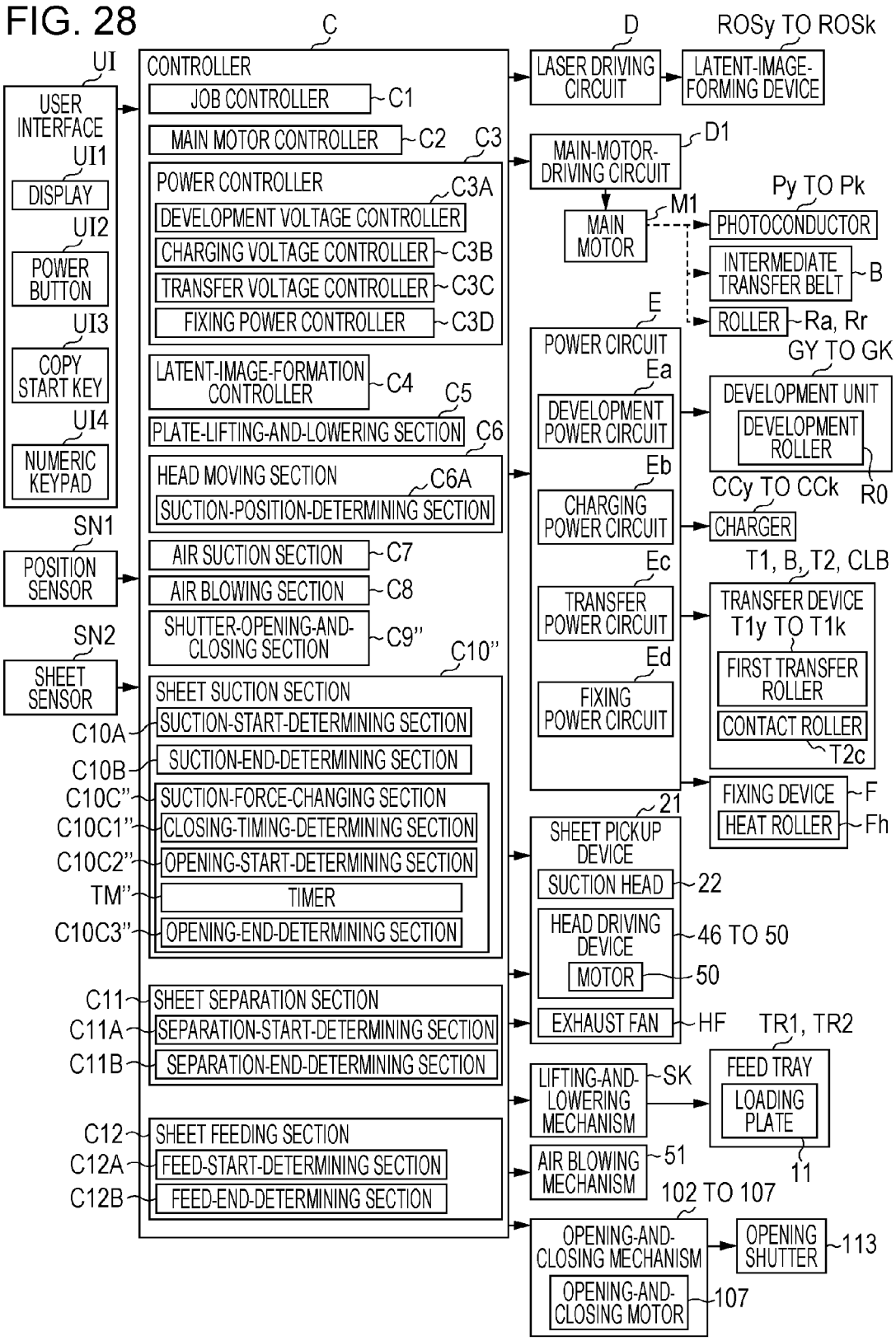
FIG. 28 corresponds to FIG. 24 illustrating the fourth exemplary embodiment and is a block diagram illustrating a controller of the image forming apparatus according to the fifth exemplary embodiment.

FIG. 28 corresponds to FIG. 24 illustrating the fourth exemplary embodiment and is a block diagram illustrating the controller C of the image forming apparatus U according to the fifth exemplary embodiment.

Referring to FIG. 28, the controller C according to the fifth exemplary embodiment receives signals that are output from the signal outputting elements U1, SN1, SN2, and so forth, and also outputs signals for controlling operations of the controlled elements D, D1, E, and so forth, as in the fourth exemplary embodiment. The controller C includes a shutter-opening-and-closing section C9" and a sheet suction section C10", instead of the shutter-opening-and-closing section C9' and the sheet suction section C10' of the fourth exemplary embodiment.

The shutter-opening-and-closing section C9" as an exemplary controller for the opening-and-closing mechanism controls the normal and reverse rotations of the opening-and-closing motor 107 and thus controls the movement of the opening shutter 113 among the shut position illustrated in FIG. 27A, the half open position illustrated in FIG. 27B, and the fully open position illustrated in FIG. 27C.

The sheet suction section C10" is an exemplary suction controller and an exemplary medium suction section. The sheet suction section C10" includes the suction-start-determining section C10A and the suction-end-determining section C10B that are employed in the fourth exemplary embodiment and a suction-force-changing section C10C" that is different from that of the fourth exemplary embodiment. The sheet suction section C10" causes, through the air suction section C7, the suction head 22 to attract a sheet S.

The suction-force-changing section C10C" includes an opening-timing-determining section C10C1", a closing-start-determining section C10C2", a timer TM", and a closing-end-determining section C10C3". The suction-force-changing section C10C" opens and closes the opening shutter 113 through the shutter-opening-and-closing section C9" and thus changes the suction force. The suction-force-changing section C10C" according to the fifth exemplary embodiment moves the opening shutter 113 from the shut-position to the fully open position after a sheet S is attracted to the suction head 22, whereby the area of the outside connection port "26*c* and 39*j*" that is connected to the outside is increased. Thus, the suction force for attracting the sheet S is reduced.

The sections C10C1" to C10C3" and the timer TM" according to the fifth exemplary embodiment can be described by borrowing the description of the sections C10C1' to C10C3' and the timer TM' according to the fourth exemplary embodiment, except that the terms "exhaust port shutter 101", "open", "close", "FIG. 22", "d16", "fully shut position", "half shut position", "open position", and "tb'" are replaced with the terms "opening shutter 113", "close", "open", "FIG. 27", "d18", "fully open position", "half open position", "shut position", and "td", respectively. Therefore, detailed description of the sections C10C1" to C10C3" and the timer TM" is omitted.

In the fifth exemplary embodiment, after a sheet S has been attracted to the suction head 22 at the start of the sheet feeding operation and the suction head 22 has started to move toward the feed position, the sheet suction section C10" causes the suction-force-changing section C10C" to open the opening shutter 113 and thus reduces the suction force. Specifically, if the opening-timing-determining section C10C1" has determined that the opening timing td has arrived after the suction head 22 has started to move, the opening-and-closing motor 107 is rotated in the normal direction and the opening shutter 113 is moved from the shut position beyond the half open position to the fully open position, whereby the suction force is reduced. Furthermore, if the closing-start-determining section C10C2" has determined that the suction of air has been stopped and the time to start closing of the opening shutter 113 has arrived, the sheet suction section C10" causes the opening-and-closing motor 107 to rotate in the reverse direction until the closing-end-determining section C10C3" determines that the timer TM" has counted the shutter moving time t6, whereby the opening shutter 113 returns from the fully open position to the shut position.

The sheet feeding operation according to the fifth exemplary embodiment can be described by borrowing the description of the sheet feeding operation according to the fourth exemplary embodiment, except that the terms "exhaust port shutter 101", "open", "close", "tb'", "open position", "half shut position", "fully shut position", and "TM'" are replaced with the terms "opening shutter 113", "close", "open", "td", "shut position", "half open position", "fully open position", and "TM'", respectively. Therefore, illustration and detailed description of the sheet feeding operation according to the fifth exemplary embodiment is omitted.

Figure 29A:
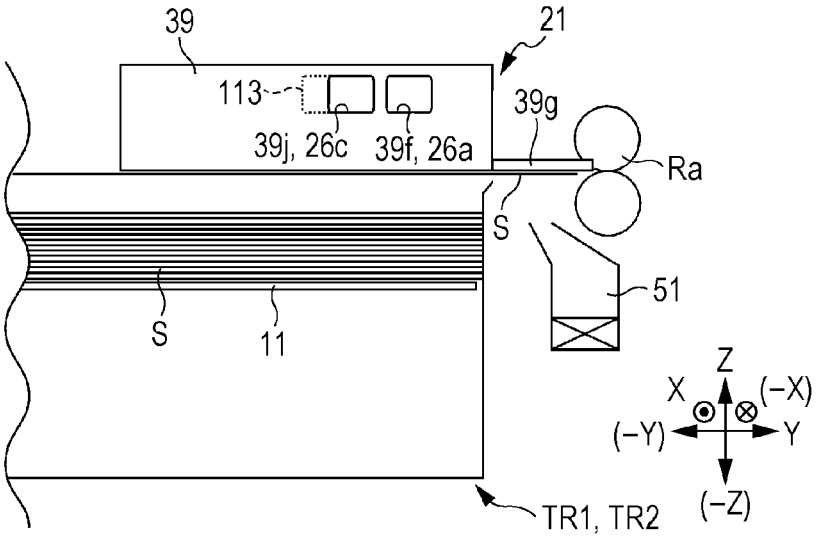
FIGS. 29A to 29C correspond to FIGS. 26A to 26C illustrating the fourth exemplary embodiment, and are sectional views illustrating the suction head according to the fifth exemplary embodiment in a state where the leading end guide has reached the transport rollers, in a state where the sheet has reached the transport rollers after the state illustrated in FIG. 29A, and in a state where the suction head has been moved to the feed position after the state illustrated in FIG. 29B, respectively.
Figure 29B:
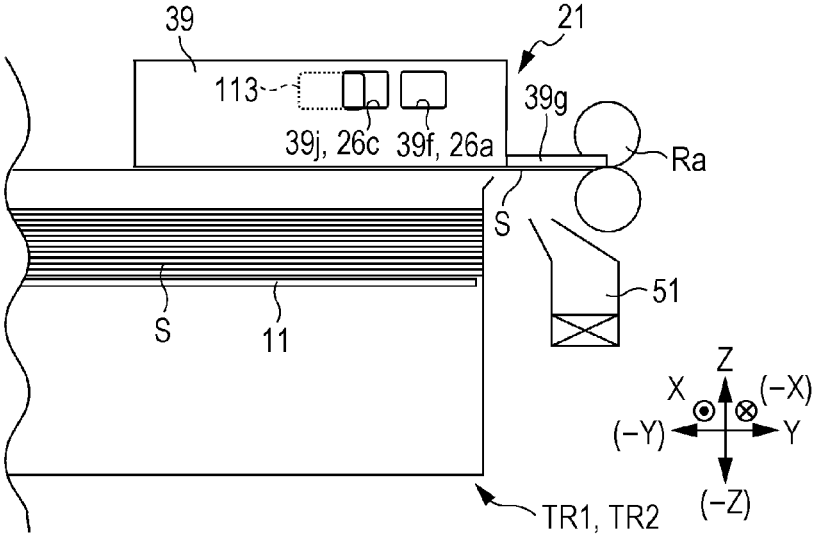
Figure 29C:
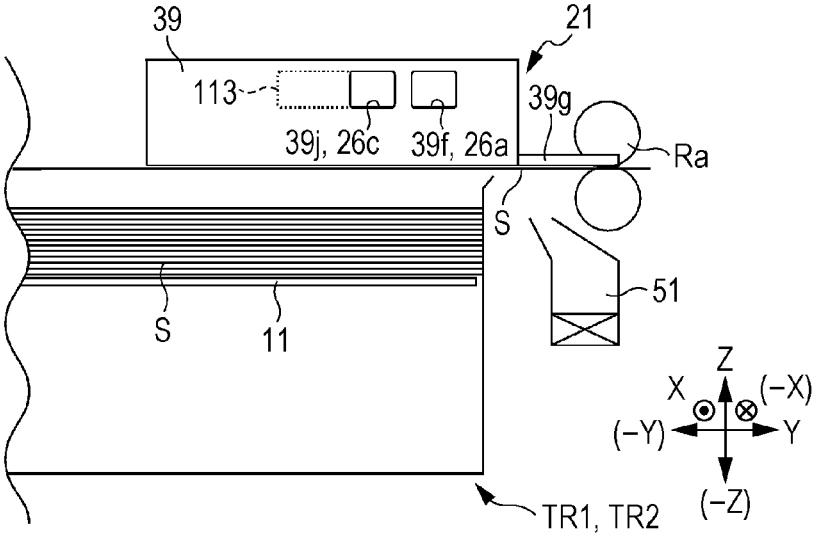

FIGS. 29A to 29C'correspond to FIGS. 26A to 26C illustrating the fourth exemplary embodiment and are sectional views illustrating the suction head 22 according to the fifth exemplary embodiment. FIG. 29A illustrates a state where the leading end guide 39*g* has reached the transport rollers Ra. FIG. 29B illustrates a state where the sheet S has reached the transport rollers Ra after the state illustrated in FIG. 29A. FIG. 29C illustrates a state where the suction head 22 has been moved to the feed position after the state illustrated in FIG. 29B.

In the image forming apparatus U according to the fifth exemplary embodiment of the present invention configured as above, if the opening timing td has arrived after the suction head 22 has started to move toward the right from the suction position toward the feed position, the leading end guide 39*g* reaches the transport rollers Ra as illustrated in FIG. 29A. Then, as in the fourth exemplary embodiment, the opening-and-closing motor 107 is rotated in the normal direction, and the opening shutter 113 starts to move toward the left relative to the suction head 22.

As the suction head 22 advances toward the right, the opening shutter 113 is further moved toward the left relative to the suction head 22. Then, as illustrated in FIG. 29B, the opening shutter 113 reaches the half open position before the sheet S reaches the transport rollers Ra, whereby the area of the outside connection port "26*c* and 39*f*" that is connected to the outside increases. Accordingly, the outside air is allowed to flow into the internal space 111 of the suction head 22, and the airtightness in the internal space 111 is gradually reduced. As the pressure inside the internal space 111 becomes closer to the outside pressure, the difference between the pressure inside the internal space 111 and the outside pressure becomes smaller. Thus, the suction force for attracting the sheet S is reduced. Subsequently, referring to FIG. 29C, after the sheet S has reached the transport rollers Ra, the opening shutter 113 reaches the fully open position and the exhaust fan HF is stopped.

Thus, in the image forming apparatus U according to the fifth exemplary embodiment, with reference to the timing at which the transport rollers Ra start to transport the sheet S, the outside connection port "26*c* and 39*f*" is gradually opened, whereby the suction force is reduced. Therefore, damage to the sheet S is reduced compared with the case of the related art.

Moreover, in the image forming apparatus U according to the fifth exemplary embodiment, the suction force starts to be reduced before the sheet S reaches the transport rollers Ra. Furthermore, after the sheet S has reached the transport rollers Ra, the opening shutter 113 reaches the fully open position, whereby the suction force is removed. Therefore, while damage to the sheet S is reduced, the probability that the sheet S may drop from the suction head 22 before the leading end of the sheet S reaches the transport rollers Ra is reduced.

Sixth Exemplary Embodiment

In the following description of a sixth exemplary embodiment of the present invention, elements the same as those in the first and second exemplary embodiments are denoted by the corresponding reference numerals, and detailed description thereof is omitted.

The sixth exemplary embodiment differs from the first and second exemplary embodiments in features described below. The other features of the sixth exemplary embodiment are the same as those of the first and second exemplary embodiments.

Figure 30:
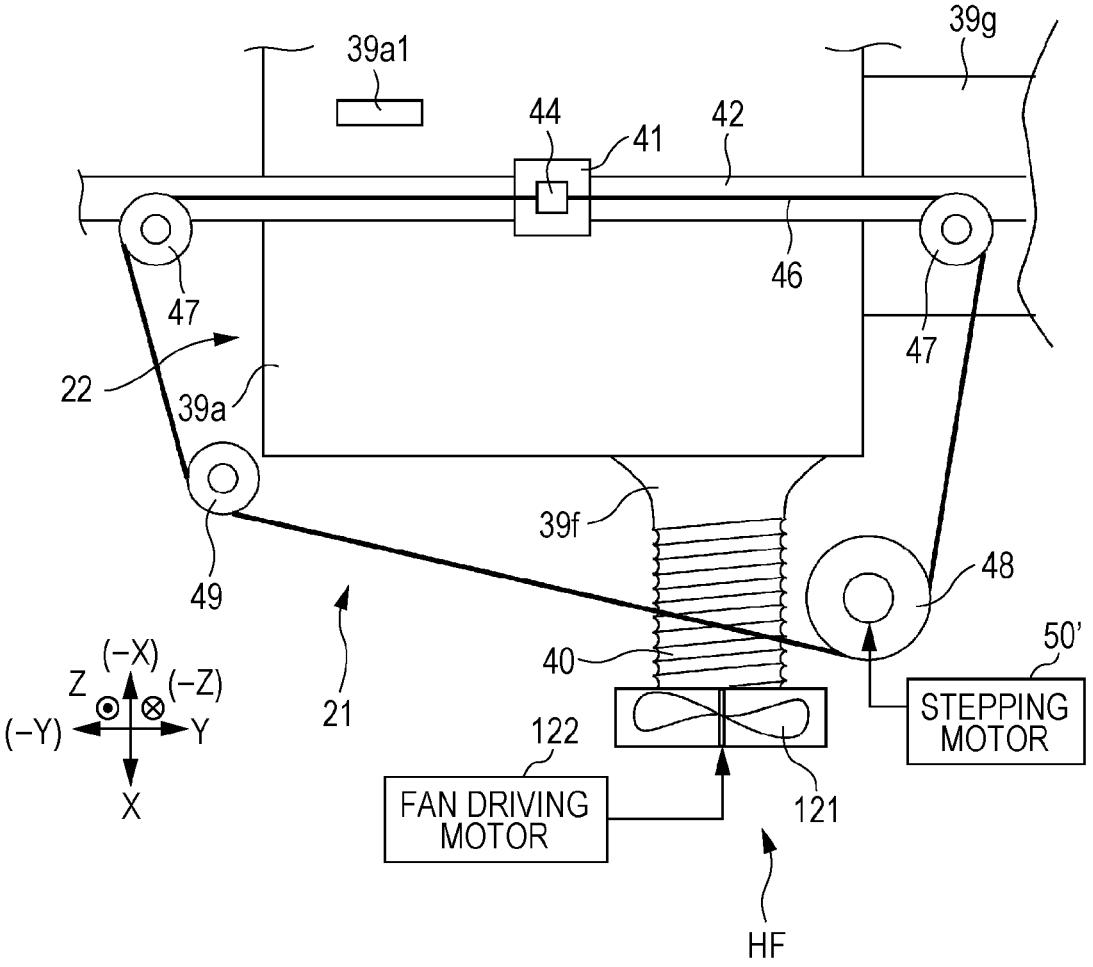
FIG. 30 corresponds to FIG. 5B illustrating the first exemplary embodiment and is a plan view of a suction head according to a sixth exemplary embodiment of the present invention.

FIG. 30 corresponds to FIG. 5B illustrating the first exemplary embodiment and is a plan view of the suction head 22 according to the sixth exemplary embodiment.

Referring to FIG. 30, the sixth exemplary embodiment does not employ the suction port shutter 61 and the opening-and-closing mechanism "66 to 73"/"81 to 87" that are employed in the first and second exemplary embodiments. Moreover, instead of the motor 50 employed in the first and second exemplary embodiments, the sixth exemplary embodiment employs a pulse motor, or a stepping motor 50', as an exemplary feed driving source that undergoes the normal and reverse rotations in accordance with a pulse signal that is input thereto. The pulse signal is an exemplary rectangular signal that forms rectangular waves. The stepping motor 50' rotates by a preset angle at every input of one pulse as one exemplary rectangular wave. The number of revolutions per unit time, i.e., the rotation speed, of the stepping motor 50' is controlled by controlling the number of pulses per unit time (pulses per second: pps).

In the sixth exemplary embodiment, the wire 46 and the pulleys 47 to 49 that are employed in the first and second exemplary embodiments, the stepping motor 50', and other associated elements together form a head driving device "46 to 50'" as an exemplary holding-member-moving mechanism.

Referring to FIG. 30, the exhaust fan HF according to the sixth exemplary embodiment includes a blade member 121 and a fan driving motor 122. The blade member 121 is driven to rotate by the fan driving motor 122 and thus exhausts air toward the downstream side. The fan driving motor 122 is an exemplary rotation driving source. The rotation speed of the fan driving motor 122 is changeable on the basis of a control signal from the controller C.

Figure 31:
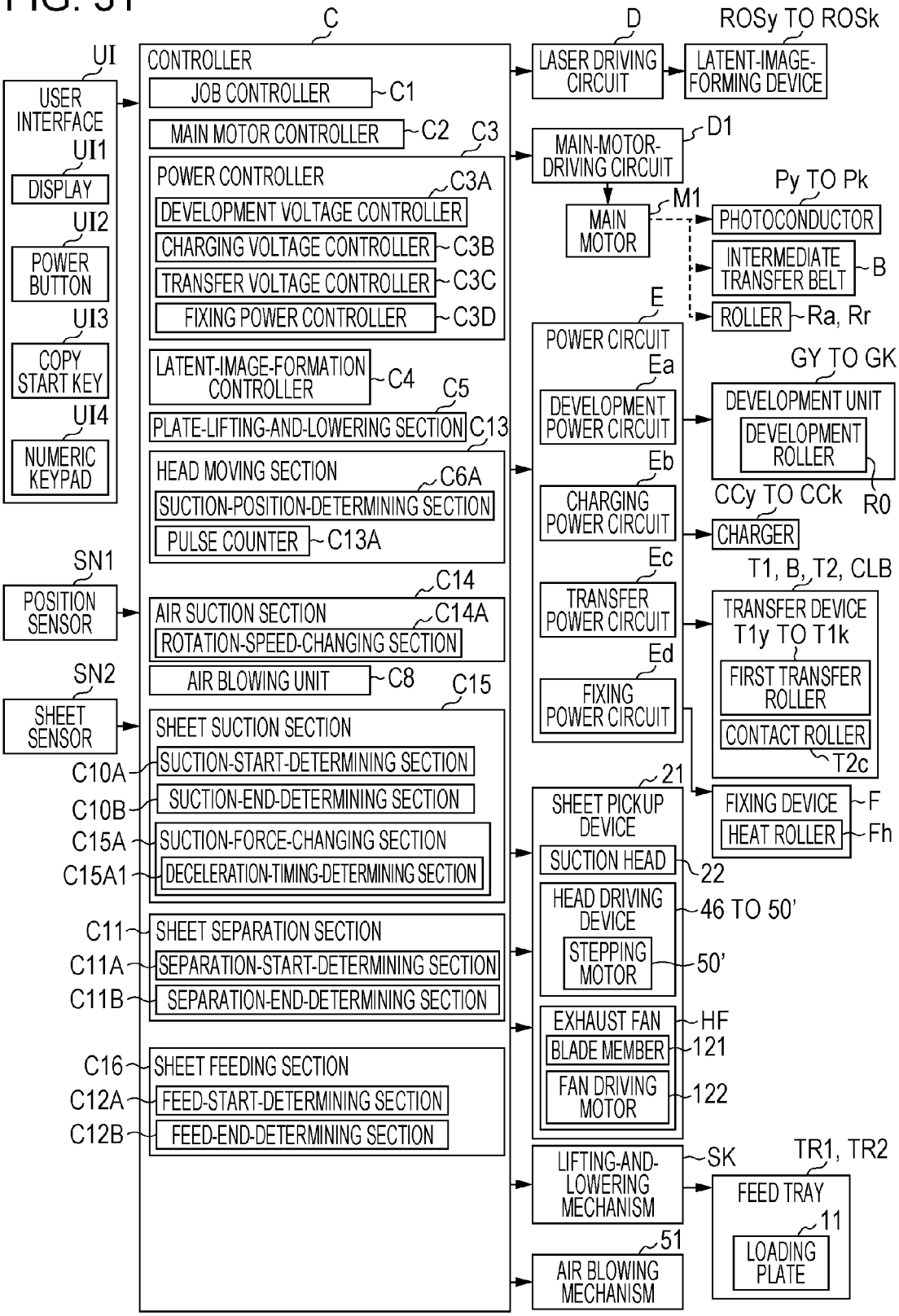
FIG. 31 corresponds to FIG. 16 illustrating the second exemplary embodiment and is a block diagram illustrating a controller of the image forming apparatus according to the sixth exemplary embodiment.

FIG. 31 corresponds to FIG. 16 illustrating the second exemplary embodiment and is a block diagram illustrating the controller C of the image forming apparatus U according to the sixth exemplary embodiment.

Referring to FIG. 31, the controller C according to the sixth exemplary embodiment receives signals that are output from the signal outputting elements U1, SN1, SN2, and so forth, and also outputs signals for controlling operations of the controlled elements D, D1, E, and so forth, as in the second exemplary embodiment. The controller C does not include the shutter-opening-and-closing section C9 that is employed in the second exemplary embodiment, and includes a head moving section C13, an air suction section C14, a sheet suction section C15, and a sheet feeding section C16, instead of the head moving section C6, the air suction section C7, the sheet suction section C10, and the sheet feeding section C12 that are employed in the second exemplary embodiment. The sheet feeding section C16 can be described by borrowing the description of the sheet feeding section C12 according to the second exemplary embodiment, except that the terms "C6" and "motor 50" are replaced with the terms "C13" and "stepping motor 50'", respectively. Therefore, detailed description of the sheet feeding section C16 is omitted.

The head moving section C13 is an exemplary controller for the holding-member-moving mechanism and includes the suction-position-determining section C6A employed in the second exemplary embodiment and a pulse counter C13A. The head moving section C13 controls the normal and reverse rotations of the stepping motor 50' included in the head driving device "46 to 50'" and thus controls the movement of the suction head 22 between the suction position illustrated in FIG. 8A and the feed position illustrated in FIG. 8B.

The pulse counter C13A is an exemplary rectangular-wave-counting section. When the suction head 22 starts to move from the suction position, the pulse counter C13A starts to count a total number of pulse inputs i that are supplied to the stepping motor 50'.

The air suction section C14 is an exemplary suction device controller and includes a rotation-speed-changing section C14A that controls the fan driving motor 122 to change the rotation speed of the blade member 121. The air suction section C14 controls the operation of the exhaust fan HF included in the sheet pickup device 21 and thus controls the suction of air from the suction ports 31 of the suction head 22 through the exhaust port 26*a*, the exhaust duct 39*f*, and the bellows 40.

The sheet suction section C15 is an exemplary suction controller and an exemplary, medium suction section. The sheet suction section C15 includes the suction-start-determining section C10A and the suction-end-determining section C10B that are employed in the second exemplary embodiment and a suction-force-changing section C15A that is different from that of the second exemplary embodiment. The sheet suction section C15 causes, through the air suction section C14, the suction head 22 to attract a sheet S.

The suction-force-changing section C15A is an exemplary suction-force-changing mechanism and includes a deceleration-timing-determining section C15A1. The suction-force-changing section C15A changes, through the rotation-speed-changing section C14A, the rotation speed of the blade member 121 of the exhaust fan HF and thus changes the suction force. The suction-force-changing section C15A according to the sixth exemplary embodiment reduces the rotation speed of the blade member 121 after a sheet S is attracted to the suction head 22, whereby the suction force for attracting the sheet S is reduced. In the sixth exemplary embodiment, the suction-force-changing section C15A reduces the rotation speed of the blade member 121 from a first rotation speed ωa (rad/s), which is realized at the time of sheet suction, to a second rotation speed ωb (rad/s). In the sixth exemplary embodiment, the second rotation speed ωb is preset on the basis of an experiment or the like so as to be lower than the first rotation speed ωa and to be such a speed that the sheet S does not drop from the suction head 22.

The deceleration-timing-determining section C15A1 determines whether or not a deceleration timing te at which reduction of the rotation speed of the blade member 121 is to be started has arrived. The deceleration-timing-determining section C15A1 according to the sixth exemplary embodiment determines whether or not the deceleration timing te has arrived by determining whether or not the total number of pulse inputs i counted by the pulse counter C13A has reached a preset deceleration start number p1. In the sixth exemplary embodiment, the deceleration start number p1 is preset to a total number of pulse inputs expressed by p1 d19/d20 (number of pulse inputs), where d19 (mm) denotes the lateral distance from the right end of the leading end guide 39*g* of the suction head 22 that is at the suction position to the transport rollers Ra, and d20 (mm) denotes the length of movement of the suction head 22 per pulse.

Thus, in the sheet suction unit C15 according to the sixth exemplary embodiment, after a sheet S has been attracted to the suction head 22 and the suction head 22 has stated to move toward the feed position, the suction-force-changing section C15A reduces the rotation speed of the blade member 121 and thus reduces the suction force. Specifically, if the deceleration-timing-determining section C15A1 has determined that the deceleration timing to has arrived, the rotation speed of the blade member 121 is reduced from the first rotation speed ωa (rad/s) to the second rotation speed ωb (rad/s), whereby the suction force is reduced. Furthermore, when the feed time t1 from the suction timing to has elapsed and the suction head 22 has reached the feed position, the sheet suction section C15 stops the rotation of the blade member 121 and thus ends the suction of air.

Figure 32:
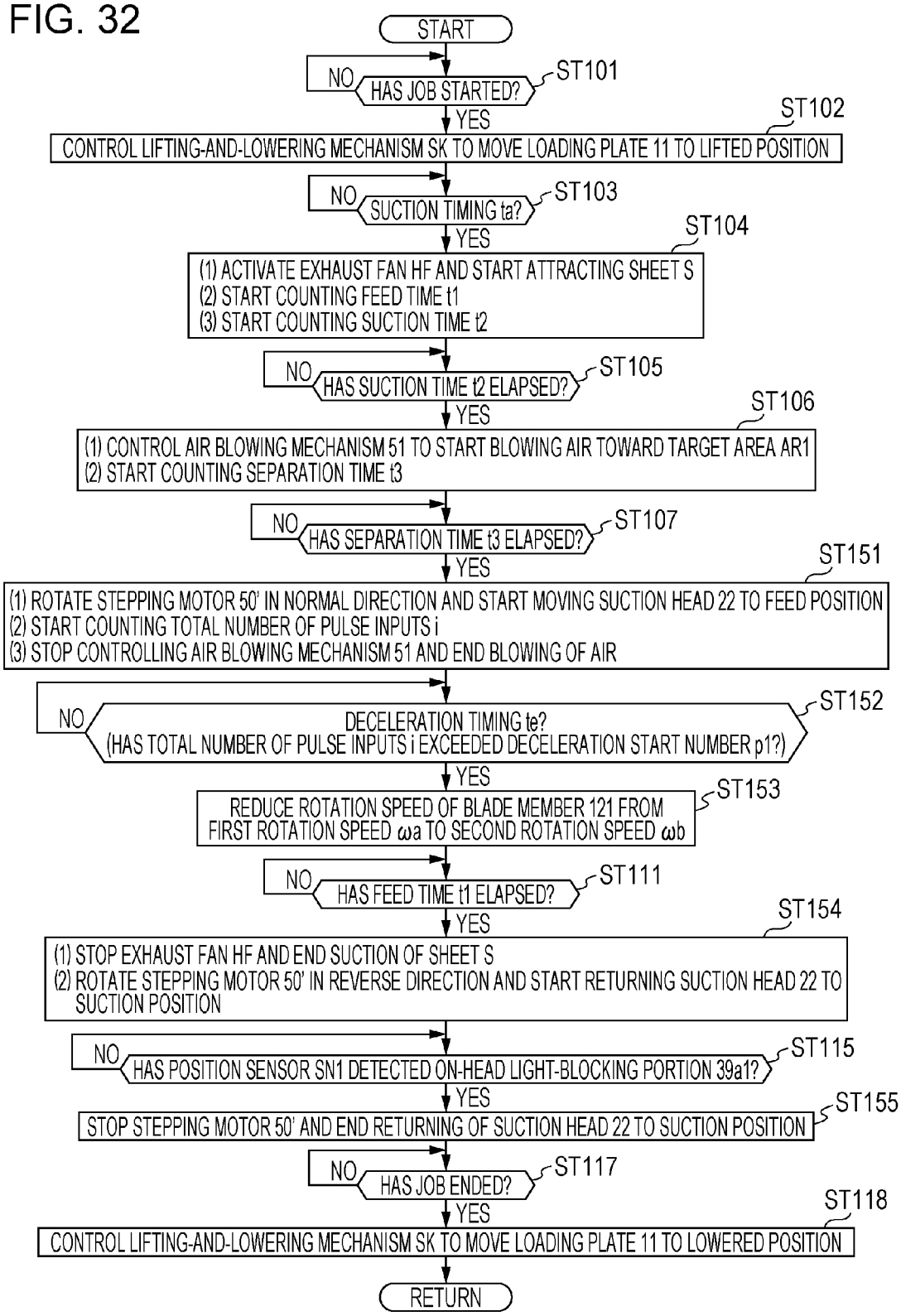
FIG. 32 corresponds to FIG. 17 illustrating the second exemplary embodiment and is a flowchart of a sheet feeding operation according to the sixth exemplary embodiment.

FIG. 32 corresponds to FIG. 17 illustrating the second exemplary embodiment and is a flowchart of a sheet feeding operation according to the sixth exemplary embodiment.

Referring to FIG. 32, the sheet feeding operation according to the sixth exemplary embodiment includes steps ST151 to ST155 described below, instead of steps ST108 to ST110, ST112 to ST114, and ST116 included in the sheet feeding operation according to the second exemplary embodiment. Other steps ST101 to ST107, ST117, and ST118 are the same as those of the second exemplary embodiment, and detailed description thereof is omitted.

After steps ST101 to ST107 illustrated in FIG. 32 are performed, the operation proceeds to step ST151.

In step ST151, the following sub-steps are performed:

(1) rotate the stepping motor 50' in the normal direction and start to move the suction head 22 from the suction position to the feed position;

(2) start counting the total number of pulse inputs i; and (3) stop the air blowing mechanism 51 and end the blowing of air, that is, end sheet separation.

Then, the operation proceeds to step ST152.

In step ST152, whether or not the total number of pulse inputs i has reached the deceleration start number p1 is determined, whereby whether or not the deceleration timing to at which reduction of the rotation speed of the blade member 121 is to be started has arrived is determined. If yes, the operation proceeds to step ST153. If no, step ST152 is repeated.

In step ST153, the rotation speed of the blade member 121 is reduced from the first rotation speed ωa to the second rotation speed ωb. Then, the operation proceeds to step ST111.

In step ST111, whether or not the feed time t1 has elapsed is determined, whereby whether or not to end the moving of the suction head 22 to the feed position and to start returning the suction head 22 to the suction position is determined. If yes, the operation proceeds to step ST154. If no, step ST111 is repeated.

In step ST154, the following sub-steps are performed:

(1) stop the exhaust fan HF and end the suction of the sheet S; and (2) rotate the stepping motor 50' in the reverse direction and start returning the suction head 22 from the feed position to the suction position.

Then, the operation proceeds to step ST115.

In step ST115, whether or not the position sensor SN1 has detected the on-head light-blocking portion 39*a*1 is determined, whereby whether or not the returning of the suction head 22 from the feed position to the suction position has ended is determined. If yes, the operation proceeds to step ST155. If no, step ST115 is repeated.

In step ST155, the stepping motor 50' is stopped and the returning of the suction head 22 to the suction position ends. Then, the operation proceeds to step ST117.

After steps ST117 and ST118 are performed, the operation returns to step ST101.

Figure 33A:
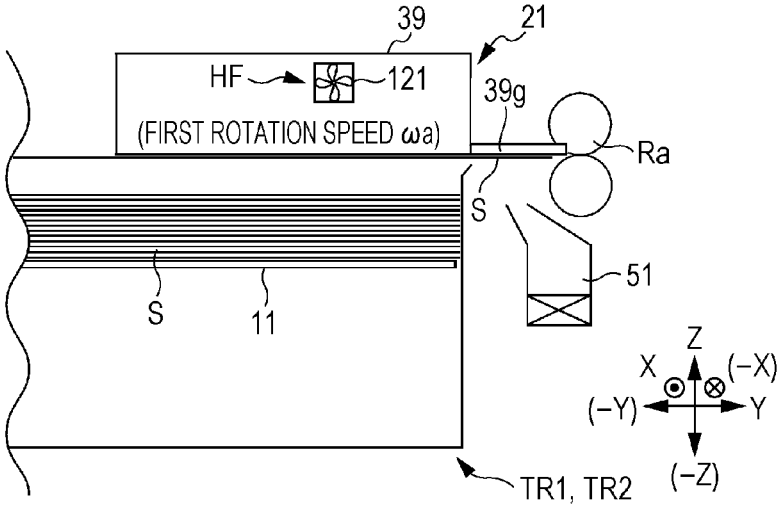
FIGS. 33A to 33C correspond to FIGS. 18A to 18C illustrating the second exemplary embodiment, and are sectional views illustrating the suction head according to the sixth exemplary embodiment in a state where the leading end guide has reached the transport rollers, in a state where the sheet has reached the transport rollers after the state illustrated in FIG. 33A, and in a state where the suction head has reached the feed position after the state illustrated in FIG. 33B, respectively.
Figure 33B:
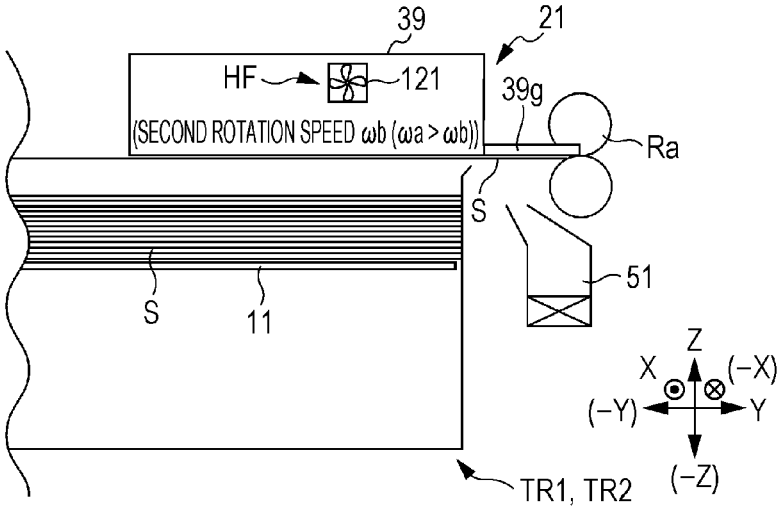
Figure 33C:
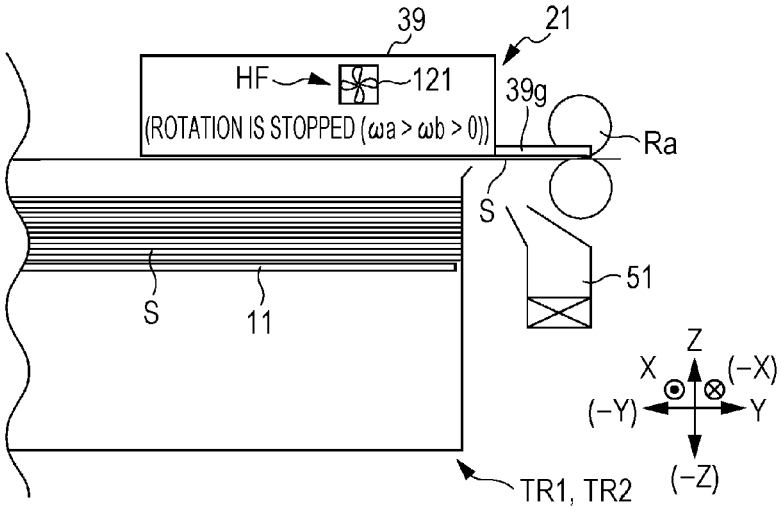

FIGS. 33A to 33C correspond to FIGS. 18A to 18C illustrating the second exemplary embodiment and are sectional views illustrating the suction head 22 according to the sixth exemplary embodiment. FIG. 33A illustrates a state where the leading end guide 39*g* has reached the transport rollers Ra. FIG. 33B illustrates a state where the sheet S has reached the transport rollers Ra after the state illustrated in FIG. 33A. FIG. 33C illustrates a state where the suction head 22 has reached the feed position after the state illustrated in FIG. 33B.

In the image forming apparatus U according to the sixth exemplary embodiment of the present invention configured as above, when the suction head 22 has moved toward the right from the suction position toward the feed position and it has been determined that the deceleration timing to has arrived, the leading end guide 39*g* reaches the transport rollers Ra as illustrated in FIG. 33A. Then, as illustrated in FIG. 33B, the rotation speed of the blade member 121 of the exhaust fan HF is reduced, whereby the force of air suction from the suction ports 31 is reduced. Then, after the sheet S has reached the transport rollers Ra as illustrated in FIG. 33C, the exhaust fan HF is stopped.

Thus, in the image forming apparatus U according to the sixth exemplary embodiment, with reference to the timing at which the transport rollers Ra start to transport the sheet S, the outside connection port "26*c* and 39*j*" is gradually opened, whereby the suction force is reduced. Therefore, damage to the sheet S is reduced compared with the case of the related art.

While some exemplary embodiments of the present invention have been described in detail, the present invention is not limited to the above exemplary embodiments, and various modifications can be made thereto within the scope of the present invention defined in the appended claims. Exemplary modifications H01 to H018 will be described below.

Modification H01

While the image forming apparatus U according to each of the above exemplary embodiments is a copier, the image forming apparatus according to the present invention may alternatively be a printer, a facsimile, or the like. Furthermore, the image forming apparatus according to the present invention is not limited to a color image forming apparatus and may be a monochrome image forming apparatus. Furthermore, the image forming apparatus according to the present invention is not limited to a tandem-type image forming apparatus and may be a rotary-type image forming apparatus.

Modification H02

While the second, fourth, and fifth exemplary embodiments concern a case where the shutter 61/101/111 is opened and closed by controlling the rotation of the opening-and-closing motor 87/107 included in the opening-and-closing mechanism "81 to 87"/"102 to 107", the mechanism of opening and closing the shutter 61/101/111 is not limited thereto. For example, the shutter 61/101/111 may be opened and closed by controlling the on/off state of an electromagnetic solenoid.

Modification H03

While the first to fourth exemplary embodiments concern a case where the suction port 31 or the exhaust port 26*a* are fully closeable with the shutter 61/101, the present invention is not limited thereto. For example, if an exhaust fan HF having a low exhaust capacity is employed so as to reduce costs and the sheet S may drop from the suction head 22 if the plural suction ports 31 are half closed, the shape and movable range of the shutter 61/101 may be set such that the shutter 61/101 is regarded as being at the shut position when the suction head 22 is at the feed position with each suction port 31 partially closed. Such a configuration also leads to a reduction of damage to the sheet S due to the friction between the sheet S and the suction head 22 occurring when the sheet S is transported by the transport rollers Ra even if the suction ports 31 or the exhaust port 26*a* is not completely closed. In the case of the opening shutter 113 according to the fifth exemplary embodiment also, a state where the inner opening 26*c* is partially open may be defined as the open position.

Modification H04

While the first to fifth exemplary embodiments concern a case where the openings 31 or the opening 26*a*/26*c* is opened and closed by sliding the flat plate-shaped shutter 61/101/111 so as to reduce the suction force, the element that opens and closes the openings 31 or the opening 26*a*/26*c* or the flow path "111 and 112" may have any configuration. For example, it is acceptable to provide, in the exhaust duct 39*f* or the like, a valve as an exemplary closing member including a partition plate that extends along the flow path and is rotatable about a rotating shaft by 90 degrees in such a manner as to close the path, i.e., a butterfly valve. Since a butterfly valve is a common device, illustration and detailed description thereof is omitted.

Modification H05

The first and second exemplary embodiments concern a case where the suction port shutter 61 is opened and closed such that all the suction ports 31 are open by the same area. Alternatively, for example, the lines of suction ports 31 may be closed sequentially from the left side by providing a suction port shutter on the left side of the most upstream line of suction ports 31 in the sheet transport direction, or the leftmost line of suction ports 31, and by moving the suction port shutter toward the right. Such a configuration is realized by, for example, providing a space for the flat plate-shaped suction port shutter on the left side of the suction ports 31 or by employing a sheet-type suction port shutter provided in the form of a roll and configured to be pulled out toward the right over the suction ports 31.

Modification H06

The first and second exemplary embodiments concern a case where the suction port shutter 61 is provided inside the suction head 22. The suction port shutter 61 is not limited to such a configuration. For example, a flat plate-shaped suction port shutter extending in the horizontal direction may be secured to a support member at a position on the right side of the suction head 22, and a member having an opening and a covering that covers the opening is also provided on the right side of the suction head 22 such that the suction port shutter can pass through the opening. The covering suppresses the leakage of air from the opening. That is, the suction port shutter may be provided outside the suction head 22.

Modification H07

The first to fourth exemplary embodiments concern a case where the shutter 61/101 reaches the fully shut position when the suction head 22 reaches the feed position. The present invention is not limited to such a case. The shutter 61/101 may reach the fully shut position before the suction head 22 reaches the feed position. For example, the shutter 61/101 may reach the fully shut position when the sheet S has reached the transport rollers Ra and is received by the transport rollers Ra, and the suction force produced in the suction head 22 may become zero when the transport rollers Ra start to transport the sheet S toward the downstream side in the sheet transport direction. In the fifth exemplary embodiment also, the opening shutter 113 may reach the fully open position before the suction head 22 reaches the feed position, for example, when the sheet S has reached the transport rollers Ra.

Modification H08

The second exemplary embodiment concerns a case where the velocity V of the suction port shutter 61 is equal to the velocity of the suction head 22. The present invention is not limited to such a case. The velocity V of the suction port shutter 61 may be greater than or less than the velocity of the suction head 22. In the fourth and fifth exemplary embodiments also, the velocity V' of the shutter 101/111 is not limited to be greater than the velocity of the suction head 22. For example, the velocity V' of the shutter 101/111 may be any value that is less than the velocity of the suction head 22. That is, the timing at which reduction of the suction force is to be started and the velocity of the shutter 61/101/111 are not limited to those described in the second, fourth, and fifth exemplary embodiments, and may be any values; as long as the occurrence of problematic situations, such as dropping of the sheet S from the suction head 22 that may occur because the suction force realized before the sheet S reaches the transport rollers Ra is reduced too much, is prevented.

Modification H09

The second and fourth to sixth exemplary embodiments, concern a case where whether or not the timing tb/tb'/td/te at which reduction of the suction force is to be started has arrived is determined by determining whether or not the time t7 taken for the leading end guide 39*g* to reach the transport rollers Ra after the start of suction of air has been counted, or by determining whether or not the total number of pulse inputs i supplied to the stepping motor 50' has reached the deceleration start number p1. The present invention is not limited to such a case. For example, whether or not the timing tb/tb'/td/te has arrived may be determined by determining whether or not a time period from when the motor 50/50' has started to be driven until when the leading end guide 39*g* reaches the transport rollers Ra has been counted, or by determining whether or not a sensor as an exemplary detecting member has detected the reaching of the leading end guide 39*g* to the transport rollers Ra.

Modification H010

The sixth exemplary embodiment concerns a case where the rotation speed of the blade member 121 starts to be reduced with the deceleration timing te at which the leading end guide 39*g* reaches the transport rollers Ra. The present invention is not limited to such a case. For example, the deceleration timing te may be defined as a point of time after a sheet S is attracted to the suction head 22 and before the suction head 22 starts to move from the suction position. That is, the rotation speed of the blade member 121 may be reduced before the suction head 22 starts to move.

Modification H011

The sixth exemplary embodiment concerns a case where the rotation speed of the blade member 121 is reduced by one level from the first rotation speed ωa to the second rotation speed cob at the deceleration timing te at which the leading end guide 39*g* reaches the transport rollers Ra. The present invention is not limited to such a case. The rotation speed of the blade member 121 may be reduced with plural deceleration timings and by plural levels, or may be continuously reduced from the deceleration timing te at a preset deceleration rate. If plural deceleration timings are defined, additional deceleration timings are not limited to a point of time before the sheet S reaches the transport rollers Ra and may be a point of time after the sheet S has reached the transport rollers Ra. If the rotation speed is continuously reduced, the rotation speed may continue to be reduced even after the sheet S has reached the transport rollers Ra.

Modification H012

The second, fourth, and fifth exemplary embodiment concern a case where the suction force is continuously reduced. Alternatively, the suction force may be reduced by one level, as in the sixth exemplary embodiment, or by plural levels. In such a case, the timing tb/tb'/td/te at which reduction of the suction force is to be started is desirably set to a point of time after a sheet S is attracted to the suction head 22 and before the sheet S reaches the transport rollers Ra and is received by the transport rollers Ra. In that case, the suction force starts to be reduced with reference to the timing at which the sheet S starts to be transported by the transport rollers Ra. Thus, damage, such as scratches or wrinkles, on the sheet S is reduced.

Modification H013

The second and fourth to sixth exemplary embodiments concern a case where, regardless of the kind of the sheet S, the shutter 61/101/111 is opened and closed or the rotation speed of the blade member 121 is reduced at the timing tb/tb'/td/te at which the leading end guide 39*g* reaches the transport rollers Ra, whereby the suction force is reduced. Alternatively, the timing at which reduction of the suction force is to be started may be changed in accordance with the kind of the sheet S. For example, the minimum suction force with which the sheet S can be kept attracted to the suction head 22 without, for example, dropping therefrom becomes smaller in order of thin paper, plain paper, and cardboard. Therefore, the timing at which reduction of the suction force is to be started may be delayed in order of thin paper, plain paper, and cardboard, whereby the rate of reduction in the suction force realized when the sheet S reaches the transport rollers Ra may be made smaller in the same order.

Modification H014

The above exemplary embodiments concern a case where the exhaust fan HF is stopped when the suction head 22 has reached the feed position. The timing at which the exhaust fan HF is to be stopped is not limited to such a point of time. For example, the exhaust fan HF may be stopped when the sheet S has reached the transport rollers Ra and is received by the transport rollers Ra. Thus, the timing at which the suction force becomes zero after the transport rollers Ra has started to transport the sheet S toward the downstream side in the sheet transport direction may be brought forward.

Modification H015

It is desirable to start reduction of the suction force before the sheet S reaches the transport rollers Ra, as in the above exemplary embodiments. The timing at which reduction of the suction force is to be started is not limited to such a point of time and may be a point of time after the sheet S has reached the transport rollers Ra. In that case, the sheet S is kept attracted to the suction head 22 until the sheet S reaches the transport rollers Ra, and, after the sheet S has reached the transport rollers Ra, the frictional force produced between the suction head 22 and the sheet S that is being transported is reduced. Thus, damage to the sheet S is reduced. For example, the suction force may start to be reduced before the trailing end of the sheet S passes over the most downstream line of suction ports 31, or the rightmost line of suction ports 31, so that the frictional force starts to be reduced before the sheet S passes over the rightmost line of suction ports 31. In such a case also, damage to the sheet S is reduced.

Modification H016

The second and fourth exemplary embodiment concern a case where the shutter 61/101 is continuously moved from the open position to the fully shut position. The shutter 61/101 is not limited to move in such a manner. For example, before the sheet S reaches the transport rollers Ra, the shutter 61/101 may be moved to the half shut position and be stopped there temporarily and, after the sheet S has reached the transport rollers Ra, the shutter 61/101 may be further moved toward the fully shut position.

Modification H017

The third and fifth exemplary embodiments concern a case where, when the flow path "111 and 112" is connected to the outside through the exhaust port 26*a* or the outside connection port "26*c* and 39*j*", the pressure inside the flow path "111 and 112" becomes closer to the outside pressure. The flow path "111 and 112" is not limited to be connected to the outside. For example, the flow path "111 and 112" may be connected to a high-pressure portion other than the outside, such as a gas cylinder, having a pressure higher than the pressure inside the flow path "111 and 112".

Modification H018

The third and fifth exemplary embodiments concern a case where the exhaust port 26*a* or the outside connection port "26*c* and 39*j*" is made to be open to the outside and thus the outside air is allowed to flow into the flow path "111 and 112", whereby the difference between the pressure inside the flow path "111 and 112" and the outside pressure is reduced. What is allowed to flow into the flow path "111 and 112" is not limited to the outside air. For example, the flow path "111 and 112" may be connected to a fan that feeds the outside air, or may be connected to a nitrogen gas cylinder so that gas other than the outside air is made to flow into the flow path "111 and 112".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium feeding device comprising:

a loading member on which mediums are loaded;

a holding member that includes a gas suction opening facing the mediums, and a suction device that is connected to the gas suction opening and performs suction of gas, the holding member being configured to attract the mediums at a suction position where each of the mediums on the loading member is attracted while the gas suction opening is performed by the suction device and moves to a feed position in which the medium is fed toward a downstream side in the medium transport direction with respect to the suction position; and a suction-force-changing mechanism that changes a suction force with which the medium is attracted to the holding member, the suction force being reduced after the medium is attracted to the holding member and before a trailing end, in the medium transport direction, of the medium attracted to the holding member passes over the gas suction opening; and wherein the suction-force-changing mechanism includes:

a closing member facing the gas suction opening, the closing member being movable between a closed position where at least part of the flow path is closed and an open position where the flow path is open; and an opening-and-closing mechanism that opens and closes the flow path by moving the closing member between the closed position and the open position, wherein the suction-force-changing mechanism reduces the suction force by controlling the opening-and-closing mechanism such that the closing member is moved from the open position to the closed position after the medium is attracted to the holding member and before the trailing end of the medium attracted to the holding member passes over the gas suction opening.

2. The medium feeding device according to claim 1, wherein the opening-and-closing mechanism provided on a flow path and with which the gas suction opening and the suction device are connected to each other such that the gas is allowed to flow therethrough, the opening-and-closing mechanism being configured to change a cross-sectional area of a part of the flow path, and wherein the suction-force-changing mechanism reduces the cross-sectional area of a part of the flow path to reduces the suction force by controlling the opening-and-closing mechanism such that the cross-sectional area of a part of the flow path starts to be reduced after the medium is attracted to the holding member and before the trailing end of the medium attracted to the holding member passes over the gas suction opening.

3. The medium feeding device according to claim 1, wherein the holding member includes an opening through which an outer gas is taken into an internal space of the holding member, wherein the suction-force-changing mechanism includes an outside opening member that is movable between an open position where the opening is open and a closed position where the opening is closed, and wherein the suction-force-changing mechanism increases the pressure in the internal space of the holding member and reduces the suction force by controlling the outside opening member such that the outside opening member is moved from the closed position to the open position after the medium is attracted to the holding member and before the trailing end of the medium attracted to the holding member passes over the gas suction opening.

4. The medium feeding device according to claim 1, wherein the suction device includes a blade member that rotates and exhausts the gas through the gas suction opening; and a rotation driving source that drives the blade member to rotate, wherein the suction-force-changing mechanism reduces the suction force by controlling the rotation driving source such that a rotation speed of the blade member is reduced after the medium is attracted to the holding member and before the trailing end of the medium attracted to the holding member passes over the gas suction opening.

5. The medium feeding device according to claim 1, wherein the suction-force-changing mechanism reduces the suction force after the medium is attracted to the holding member and before the holding member reaches the feed position.

6. An image forming apparatus comprising:

th medium feeding device according to claim 1; and an image recording device that records an image on each of the mediums that is fed from the medium feeding device.

7. A medium feeding device comprising:

a loading member on which mediums are loaded;

a holding member that includes a holding-member body that faces the loading member and is supported in such a manner as to be movable in a medium transport direction, the holding-member body having a gas suction opening facing the mediums, and a suction device that is connected to the gas suction opening and performs suction of gas, the holding member being configured to attract and hold each of the mediums while gas suction opening is performed by the suction device;

a holding-member-moving mechanism that moves the holding member between a suction position where each of the mediums on the loading member is attracted to the holding member and a feed position on a downstream side in the medium transport direction with respect to the suction position;

a transport member that transports the medium held by the holding member that is at the feed position toward the downstream side;

a suction-force-changing mechanism that changes a suction force with which the medium is attracted to the holding member, the suction force being reduced after the medium is attracted to the holding member and before a trailing end, in the medium transport direction, of the medium attracted to the holding member passes over the gas suction opening;

a closing member facing the gas suction opening, the closing member being movable between a closed position where at least part of the flow path is closed and an open position where the flow path is open; and an opening-and-closing mechanism that opens and closes the flow path by moving the closing member between the closed position and the open position, wherein the suction-force-changing mechanism reduces the suction force by controlling the opening-and-closing mechanism such that the closing member is moved from the open position to the closed position after the medium is attracted to the holding member and before the trailing end of the medium attracted to the holding member passes over the gas suction opening.

8. The medium feeding device according to claim 7, wherein the closed position includes an entirely closed position where the entirety of the flow path is closed by the closing member and a partially closed position where part of the flow path is closed by the closing member, and wherein the suction-force-changing mechanism causes the opening-and-closing mechanism to move the closing member from the open position to the partially closed position after the medium is attracted to the holding member and before a leading end, in the medium transport direction, of the medium attracted to the holding member reaches the transport member, and also causes the opening-and-closing mechanism to move the closing member from the partially closed position to the entirely closed position after the leading end of the medium attracted to the holding member reaches the transport member and before the trailing end of the medium attracted to the holding member passes over the gas suction opening.

9. The medium feeding device according to claim 8, wherein the opening-and-closing mechanism includes an urging member that urges the closing member toward the open position, and a pushing member that is provided on a body of the medium feeding device on a side of the transport member, wherein, when the holding member is moved toward the feed position, the pushing member pushes the closing member and moves the closing member from the open position to the closed position against an urging force exerted by the urging member.

10. The medium feeding device according to claim 9, wherein the suction-force-changing mechanism includes a connector portion that is supported in such a manner as to be movable relative to a gas-passage-allowing opening through which the gas taken into an internal space of the holding-member body is exhausted, the gas in the internal space being subjected to suction performed through the gas suction opening, the gas-passage-allowing opening being provided on a downstream side of the internal space in a gas suction direction, the gas-passage-allowing opening being movable with the movement of the holding member between the suction position and the feed position, the connector portion having a downstream end thereof in the gas suction direction connected to the suction device, wherein an upstream end of the connector portion in the gas suction direction is connected to the gas-passage-allowing opening when the holding member is moved to the suction position, and is disconnected from the gas-passage-allowing opening when the holding member is moved to the feed position such that an area of the gas-passage-allowing opening that allows the gas to flow therethrough to the connector portion is reduced.

11. The medium feeding device according to claim 8, wherein the opening-and-closing mechanism includes an opening-and-closing driving source that generates a driving force; and a transmission mechanism that transmits the driving force of the opening-and-closing driving source to the closing member and moves the closing member between the closed position and the open position, wherein the medium feeding device further includes an opening-and-closing-mechanism controller that controls the opening-and-closing driving source, and wherein the suction-force-changing mechanism reduces the suction force by controlling the opening-and-closing mechanism to cause the transmission mechanism to move the closing member from the open position to the closed position after the medium is attracted to the holding member and before the trailing end of the medium attracted to the holding member passes over the gas suction opening.

12. The medium feeding device according to claim 11, wherein the suction-force-changing mechanism includes a connector portion that is supported in such a manner as to be movable relative to a gas-passage-allowing opening through which the gas taken into an internal space of the holding-member body is exhausted, the gas in the internal space being subjected to suction performed through the gas suction opening, the gas-passage-allowing opening being provided on a downstream side of the internal space in a gas suction direction, the gas-passage-allowing opening being movable with the movement of the holding member between the suction position and the feed position, the connector portion having a downstream end thereof in the gas suction direction connected to the suction device, wherein an upstream end of the connector portion in the gas suction direction is connected to the gas-passage-allowing opening when the holding member is moved to the suction position, and is disconnected from the gas-passage-allowing opening when the holding member is moved to the feed position such that an area of the gas-passage-allowing opening that allows the gas to flow therethrough to the connector portion is reduced.

13. The medium feeding device according to claim 8, wherein the suction-force-changing mechanism includes a connector portion that is supported in such a manner as to be movable relative to a gas-passage-allowing opening through which the gas taken into an internal space of the holding-member body is exhausted, the gas in the internal space being subjected to suction performed through the gas suction opening, the gas-passage-allowing opening being provided on a downstream side of the internal space in a gas suction direction, the gas-passage-allowing opening being movable with the movement of the holding member between the suction position and the feed position, the connector portion having a downstream end thereof in the gas suction direction connected to the suction device, wherein an upstream end of the connector portion in the gas suction direction is connected to the gas-passage-allowing opening when the holding member is moved to the suction position, and is disconnected from the gas-passage-allowing opening when the holding member is moved to the feed position such that an area of the gas-passage-allowing opening that allows the gas to flow therethrough to the connector portion is reduced.

14. The medium feeding device according to claim 7, wherein the opening-and-closing mechanism includes an urging member that urges the closing member toward the open position, and a pushing member that is provided on a body of the medium feeding device on a side of the transport member, wherein, when the holding member is moved toward the feed position, the pushing member pushes the closing member and moves the closing member from the open position to the closed position against an urging force exerted by the urging member.

15. The medium feeding device according to claim 14, wherein the suction-force-changing mechanism includes a connector portion that is supported in such a manner as to be movable relative to a gas-passage-allowing opening through which the gas taken into an internal space of the holding-member body is exhausted, the gas in the internal space being subjected to suction performed through the gas suction opening, the gas-passage-allowing opening being provided on a downstream side of the internal space in a gas suction direction, the gas-passage-allowing opening being movable with the movement of the holding member between the suction position and the feed position, the connector portion having a downstream end thereof in the gas suction direction connected to the suction device, wherein an upstream end of the connector portion in the gas suction direction is connected to the gas-passage-allowing opening when the holding member is moved to the suction position, and is disconnected from the gas-passage-allowing opening when the holding member is moved to the feed position such that an area of the gas-passage-allowing opening that allows the gas to flow therethrough to the connector portion is reduced.

16. The medium feeding device according to claim 7, wherein the suction-force-changing mechanism includes a connector portion that is supported in such a manner as to be movable relative to a gas-passage-allowing opening through which the gas taken into an internal space of the holding-member body is exhausted, the gas in the internal space being subjected to suction performed through the gas suction opening, the gas-passage-allowing opening being provided on a downstream side of the internal space in a gas suction direction, the gas-passage-allowing opening being movable with the movement of the holding member between the suction position and the feed position, the connector portion having a downstream end thereof in the gas suction direction connected to the suction device, wherein an upstream end of the connector portion in the gas suction direction is connected to the gas-passage-allowing opening when the holding member is moved to the suction position, and is disconnected from the gas-passage-allowing opening when the holding member is moved to the feed position such that an area of the gas-passage-allowing opening that allows the gas to flow therethrough to the connector portion is reduced.

17. The medium feeding device according to claim 7, wherein the suction device includes a blade member that rotates and exhausts the gas through the gas suction opening; and a rotation driving source that drives the blade member to rotate, and wherein the suction-force-changing mechanism reduces the suction force by controlling the rotation driving source such that a rotation speed of the blade member is reduced after the medium is attracted to the holding member and before the trailing end of the medium attracted to the holding member passes over the gas suction opening.

18. The medium feeding device according to claim 7, wherein the suction-force-changing mechanism includes an outside opening member that is movable between an open position where an outside connection port that is connected to the outside is open and a closed position where the outside connection port is closed, the outside connection port being provided in a flow path that connects the gas suction opening and the suction device to each other and allows the gas to flow therethrough; and an outside connection member that is capable of connecting the flow path to the outside and is configured to open and close the outside connection port by moving the outside opening member between the open position and the closed position, wherein the suction-force-changing mechanism increases the pressure inside the flow path and reduces the suction force by controlling the outside connection member such that the outside opening member is moved from the closed position to the open position after the medium is attracted to the holding member and before the trailing end of the medium attracted to the holding member passes over the gas suction opening.

19. The medium feeding device according to claim 7, wherein the suction-force-changing mechanism reduces the suction force after the medium is attracted to the holding member and before a leading end, in the medium transport direction, of the medium attracted to the holding member reaches the transport member.

20. An image forming apparatus comprising:
the medium feeding device according to claim 7; and
an image recording device that records an image on each of the mediums that is fed from the medium feeding device.

* * * * *